US010035522B2

(12) United States Patent
Takayama

(10) Patent No.: US 10,035,522 B2
(45) Date of Patent: Jul. 31, 2018

(54) DOOR SUSPENSION DEVICE

(71) Applicant: NABTESCO CORPORATION, Tokyo (JP)

(72) Inventor: Yuki Takayama, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 5 days.

(21) Appl. No.: 15/019,182

(22) Filed: Feb. 9, 2016

(65) Prior Publication Data

US 2016/0229424 A1 Aug. 11, 2016

(30) Foreign Application Priority Data

Feb. 10, 2015 (JP) ..... 2015-024534

(51) Int. Cl.
*B61D 19/00* (2006.01)
*E05F 15/635* (2015.01)
(Continued)

(52) U.S. Cl.
CPC ..... *B61D 19/005* (2013.01); *E05D 15/063* (2013.01); *E05D 15/0643* (2013.01);
(Continued)

(58) Field of Classification Search
CPC .... B61D 19/005; E05F 15/632; E05F 15/635; E05F 15/638; E05F 15/641;
(Continued)

(56) References Cited

U.S. PATENT DOCUMENTS 5,896,952 A * 4/1999 Dohring ..... B66B 13/12 187/330
6,446,389 B1 * 9/2002 Heffner ..... B61D 19/02 49/118
(Continued)

FOREIGN PATENT DOCUMENTS

CN 102482910 5/2012
CN 102667042 9/2012
(Continued)

OTHER PUBLICATIONS

First Office Action dated Apr. 1, 2017 issued in Chinese Patent Application No. 201610080894.9 with English Translation.

*Primary Examiner* — Justin B Rephann
(74) *Attorney, Agent, or Firm* — Wenderoth, Lind & Ponack, L.L.P.

(57) ABSTRACT

A door suspension device includes a driving-side member, a hanger, an elastic member, pressed door rollers, and linking mechanisms. The driving-side member is displaceable in an opening direction and a closing direction when a drive force is imparted from an opening and closing drive mechanism. The hanger is displaced in conjunction with a displacement of the driving-side member and supports a door. The elastic member allows relative displacements of the driving-side member and the hanger by elastically deforming in accordance with a load that acts between the driving-side member and the hanger. The linking mechanisms convert a relative displacement operation of the driving-side member and the hanger into an operation in which the pressed door rollers are pressed against an upper rail.

11 Claims, 25 Drawing Sheets

(51) Int. Cl.
*E05D 15/06* (2006.01)
*E05F 15/632* (2015.01)

(52) U.S. Cl.
CPC ..... *E05F 15/632* (2015.01); *E05F 15/635* (2015.01); *E05Y 2201/614* (2013.01); *E05Y 2900/51* (2013.01)

(58) Field of Classification Search
CPC ..... E05F 15/643; E05F 15/646; E05F 15/649; E05F 15/652; E05D 15/0643
USPC ..... 49/116, 118, 120
See application file for complete search history.

(56) References Cited

U.S. PATENT DOCUMENTS

| | | | | |
|---|---|---|---|---|
| 8,127,494 | B2 * | 3/2012 | Kondash | E05F 15/684 49/197 |
| 9,403,422 | B2 * | 8/2016 | Takahashi | B61D 19/02 |
| 2014/0090301 | A1 | 4/2014 | Takahashi et al. | |
| 2015/0054294 | A1 * | 2/2015 | Uno | E05B 81/06 292/194 |

FOREIGN PATENT DOCUMENTS

| | | |
|---|---|---|
| EP | 2 476 848 | 7/2012 |
| EP | 2 503 087 | 9/2012 |
| JP | 11-36693 | 2/1999 |
| WO | 2012/157492 | 11/2012 |

* cited by examiner

WHEN DOOR CLOSES
MODIFICATION OF ARRANGEMENT
OF DOOR SUSPENSION DEVICE

MODIFICATION OF STATIC ADJUSTMENT MECHANISM

DOOR SUSPENSION DEVICE

TECHNICAL FIELD

The present invention relates to a door suspension device that suspends and supports a sliding door.

BACKGROUND ART

A railway vehicle and the like include sliding doors. Such a sliding door is suspended by a door suspension device (for example, refer to WO2012/157492). The door is driven to open or close by an opening/closing drive mechanism which uses air pressure or an output of an electric motor.

The door suspension device described in WO2012/157492 includes a first door roller which travels on a lower rail among an upper rail and the lower rail that are parallel to each other, a first door roller supporting member which suspends a door and which rotatably supports the first door roller, and swinging members coupled to the first door roller supporting member.

In addition, the door suspension device includes a second door roller which is supported by the swinging members and which is capable of coming into contact with the upper rail and a drive coupling section for holding and coupling the door with respect to the opening/closing drive mechanism. Furthermore, the door suspension device includes an elastic coupling mechanism which couples the swinging members and the drive coupling section to each other. The elastic coupling mechanism includes an elastic section capable of changing relative positions of the second door roller and the drive coupling section by elastically deforming. The elastic section is a coil spring.

The swinging members are respectively arranged on a door head side and a door tail side of the door and are coupled to two second door rollers. The door head-side swinging member is coupled to a swinging coupling member arranged on the door head side. In addition, the door tail-side swinging member is coupled to a swinging coupling member arranged on the door tail side. The respective swinging coupling members are linking members.

According to the configuration described above, a distance between the two swinging coupling members changes due to an elastic deformation of the elastic section and, as a result, each swinging member swings. Accordingly, the second door rollers coupled to the respective swinging members are displaced in a direction approaching or receding from the upper rail. As a result, during acceleration or deceleration when the door is being driven to open or close, due to the displacement of the swinging members with respect to the door in accordance with the elastic deformation of the elastic section, each second door roller is displaced in a direction approaching the upper rail. Accordingly, a load (surface pressure) acting on the upper rail from the second door rollers temporarily increases.

Subsequently, when the door starts moving at a uniform speed, the elastic section immediately returns to its original shape and a distance relationship between the upper rail and the second door rollers is restored to its original state. Accordingly, positions of the second door rollers with respect to the upper rail are positioned to appropriate positions. As a result, by installing the second door rollers so that the second door rollers come into contact with the upper rail relatively slightly, travel resistance is reduced with respect to a mechanism that prevents derailment when the door rollers travel on the rail. In addition, during acceleration and deceleration of the door and the like, the second door rollers are positioned at appropriate positions and derailment of the door rollers and tilting of the door are prevented.

With the configuration described above, when inserting the second door roller between a pair of upper and lower rails, the second door roller must be inserted between the pair of upper and lower rails while pressing down the second door roller toward the hanger. Since this operation requires pressing down the second door roller against a large spring force of the elastic section constituted by a coil spring, assembly of the door roller may take some effort.

SUMMARY OF INVENTION

An object of the present invention is to realize a simpler configuration in a door suspension device capable of changing relative positions of an opening/closing drive mechanism and a door by an elastic deformation of an elastic member.

(1) A door suspension device according to an aspect of the present invention is a door suspension device for supporting a door that is displaced in a prescribed opening/closing direction by a drive force from an opening/closing drive mechanism, the door suspension device including: a driving-side member which is displaceable in the opening/closing direction when the drive force is imparted from the opening/closing drive mechanism; a hanger which is configured to be displaceable in the opening/closing direction in conjunction with a displacement of the driving-side member and which supports the door; an elastic member which allows relative displacements of the driving-side member and the hanger in the opening/closing direction by elastically deforming in accordance with a load in the opening/closing direction that acts between the driving-side member and the hanger; a pressed door roller which is arranged between a pair of upper and lower rails; and a movement conversion mechanism which converts an operation in which the driving-side member and the hanger are relatively displaced in the opening/closing direction, into an operation in which the pressed door roller is pressed against one of the pair of rails.

DESCRIPTION OF EMBODIMENTS

Hereinafter, an embodiment of the present invention will be described with reference to the drawings. The present invention can be applied as a door suspension device. A door suspension device supports a door, which is provided in a structure and which is driven to open or close by an opening/closing drive mechanism, in a state where the door is suspended so as to be freely slidable with respect to the structure and is coupled to the opening/closing drive mechanism. Moreover, while an example of a door suspension device and a door apparatus applied to a railway vehicle will be described in the present embodiment, the present invention is not limited to this example. The present invention can be widely applied as a door suspension device to be provided in various types of structures.

Figure 1:
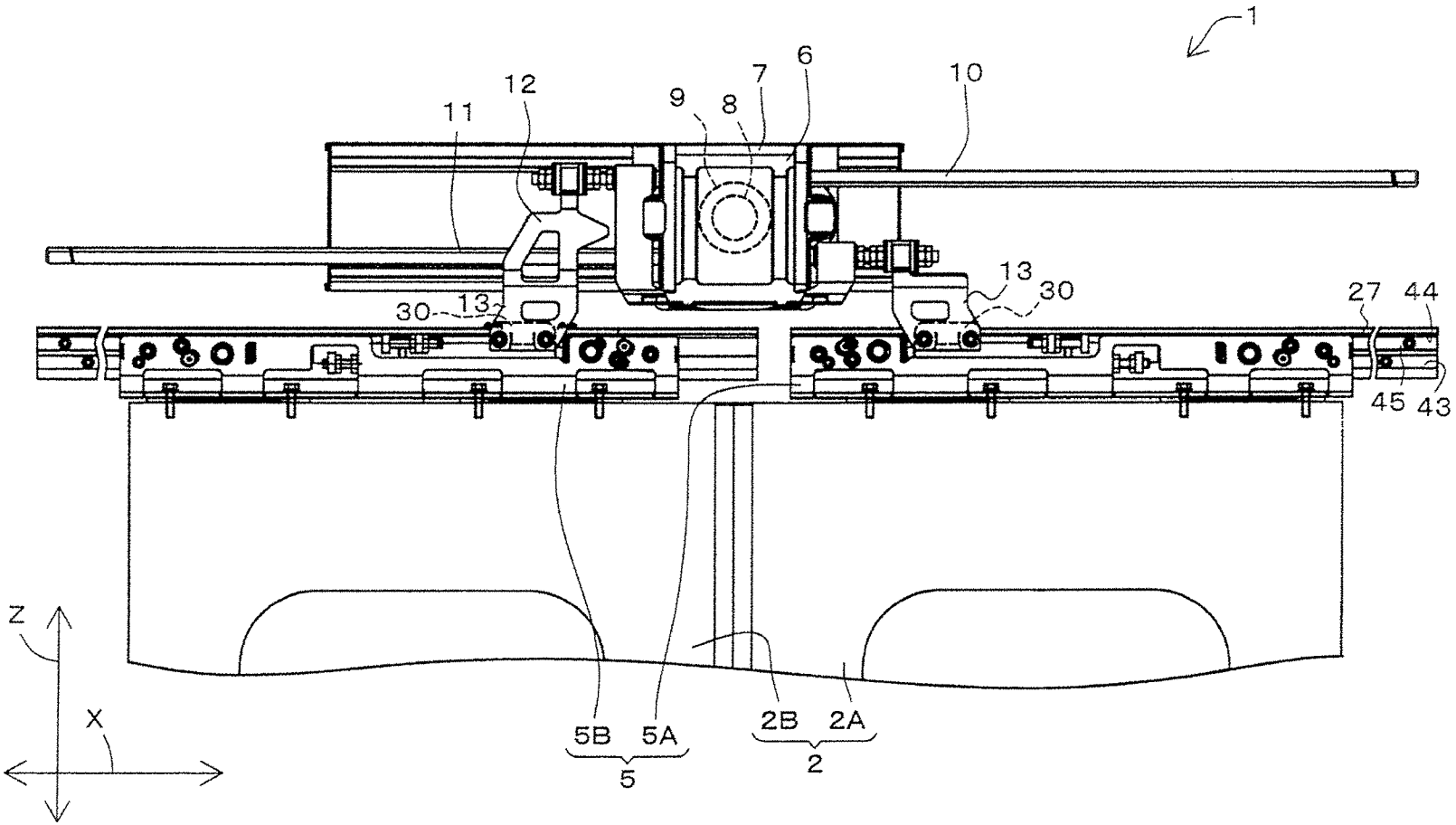
FIG. 1 is a front view of a door apparatus including a door suspension device according to an embodiment of the present invention.
Figure 2:
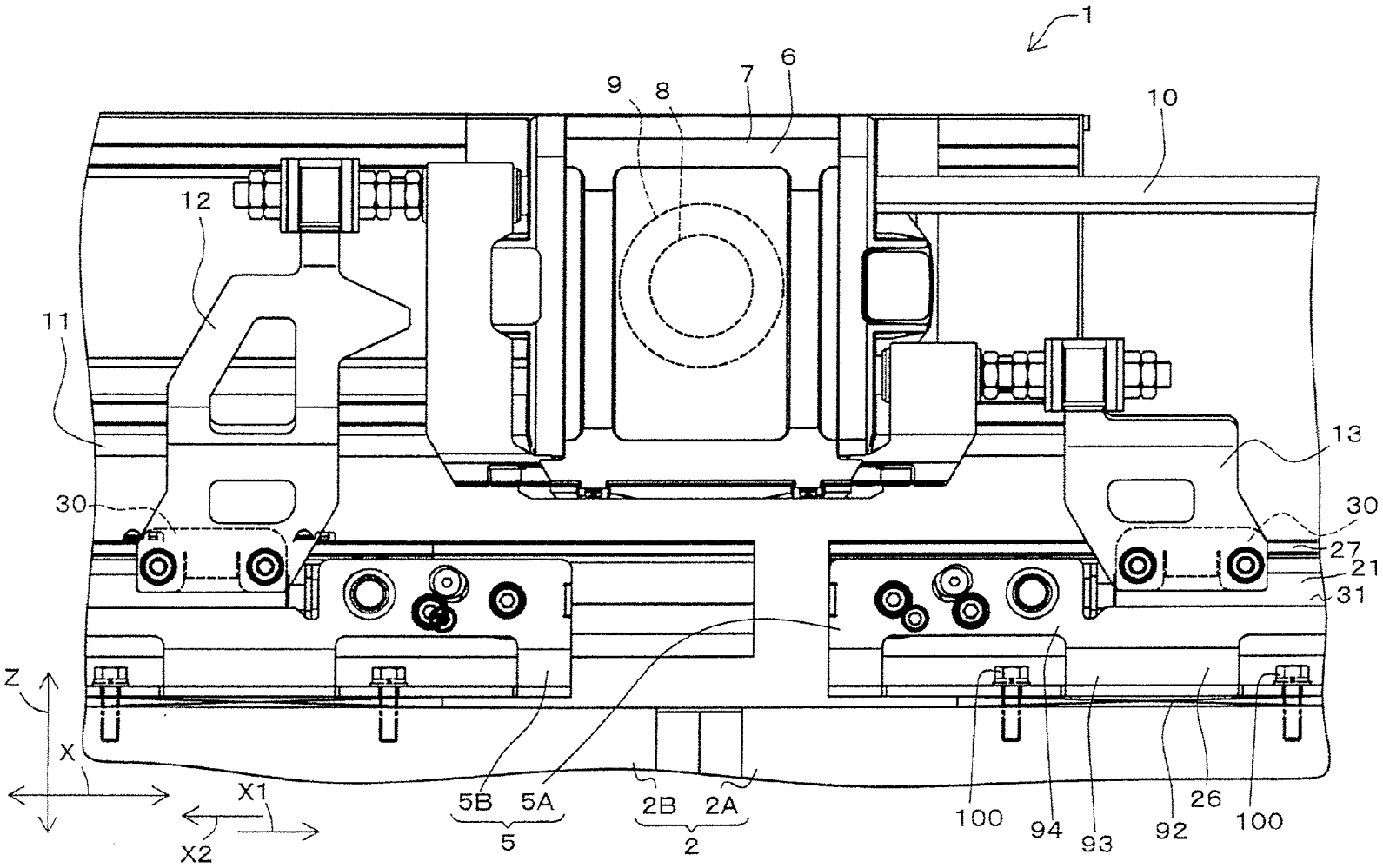
FIG. 2 is an enlarged view of a part of FIG. 1.

FIG. 1 is a front view of a door apparatus 1 including a door suspension device according to an embodiment of the present invention. FIG. 2 is an enlarged view of a part of FIG. 1. Moreover, in FIG. 1, a part of a door 2 has been omitted. With reference to FIGS. 1 and 2, the door apparatus 1 is, for example, a door apparatus for a railway vehicle. The door apparatus 1 is installed with a side wall of a vehicle body (not shown) of a railway vehicle as a structure. More specifically, the door apparatus 1 is installed in an opening formed on the vehicle body. The door apparatus 1 is provided in order to open and close the opening.

The door apparatus 1 includes doors 2 (2A and 2B), door suspension devices 5 (5A and 5B) for supporting the doors 2, and an opening/closing drive mechanism 6 for imparting a drive force to the doors 2 via the door suspension devices 5.

The doors 2 are sliding doors provided on a side wall of the vehicle body and constitute side doors provided so that passengers may get on and off the railway vehicle. Two doors 2 (2A and 2B) are provided and are supported (suspended) by the door suspension devices 5 so as to be slidable in an opening direction X1 and a closing direction X2 with respect to the vehicle body. Moreover, the doors 2A and 2B will also be respectively simply referred to as the door 2. The door 2 is displaced in an opening/closing direction X upon receiving a drive force from the opening/closing drive mechanism 6 via the door suspension device 5.

The opening/closing drive mechanism 6 includes a casing 7, a drive motor 8, a pinion 9, an upper rack 10, and a lower rack 11.

The casing 7 houses the drive motor 8 and the pinion 9. The pinion 9 is coupled to an output shaft of the drive motor 8 so as to be integrally rotatable. The upper rack 10 is arranged above the pinion 9 and the lower rack 11 is arranged below the pinion 9.

The upper rack 10 and the lower rack 11 are arranged so as to extend horizontally in a traveling direction of the railway vehicle and are parallel to each other. The upper rack 10 and the lower rack 11 mesh with the pinion 9. In addition, as the pinion 9 rotates, the upper rack 10 and the lower rack 11 slide in opposite directions to each other. An upper coupling stay 12 and a lower coupling stay 13 are respectively fixed to the upper rack 10 and the lower rack 11.

The upper coupling stay 12 and the lower coupling stay 13 can be displaced in the opening/closing direction X as a drive force is imparted from corresponding racks 10 and 11 of the opening/closing drive mechanism 6. The respective coupling stays 12 and 13 are metal plate members. An upper end of the upper coupling stay 12 is fixed using a screw member or the like to one end of the upper rack 10. In addition, a lower end of the upper coupling stay 12 is fixed to a seat 30 of a driving-side member 21 (to be described later) of the door suspension device 5B for supporting the door 2B. Accordingly, the upper coupling stay 12 transfers the drive force of the opening/closing drive mechanism 6 to the door suspension device 5B.

An upper end of the lower coupling stay 13 is fixed using a screw member or the like to one end of the lower rack 11. In addition, a lower end of the lower coupling stay 13 is fixed to a seat 30 of a driving-side member 21 (to be described later) of the door suspension device 5A for supporting the door 2A. Accordingly, the lower coupling stay 13 transfers the drive force of the opening/closing drive mechanism 6 to the door suspension device 5A.

According to the configuration described above, due to rotations of the pinion 9 caused by a forward rotation operation and a reverse rotation operation of the drive motor 8, the two doors 2A and 2B are displaced in conjunction with each other in the opening/closing direction X. This concludes the description of a schematic configuration of the opening/closing drive mechanism 6. Next, the door suspension device 5 will be described.

The door suspension device 5 includes the door suspension device 5A for supporting one door 2A and the door suspension device 5B for supporting the other door 2B.

Moreover, with the exception of the lower coupling stay 13 and the upper coupling stay 12 having shapes that are asymmetrical in the opening/closing direction X, the door suspension device 5A and the door suspension device 5B are symmetrically configured in the opening/closing direction X. Therefore, one door suspension device 5A among the door suspension devices 5A and 5B will be mainly described below and a detailed description of the door suspension device 5B will be omitted. In addition, in the following description, a side of a distal end in an advancing direction of the door 2 (2A) when the door 2 is displaced in the closing direction X2 will be referred to as a door head side and a side of a distal end in an advancing direction of the door 2 when the door 2 is displaced in the opening direction X1 will be referred to as a door tail side.

Figure 3:
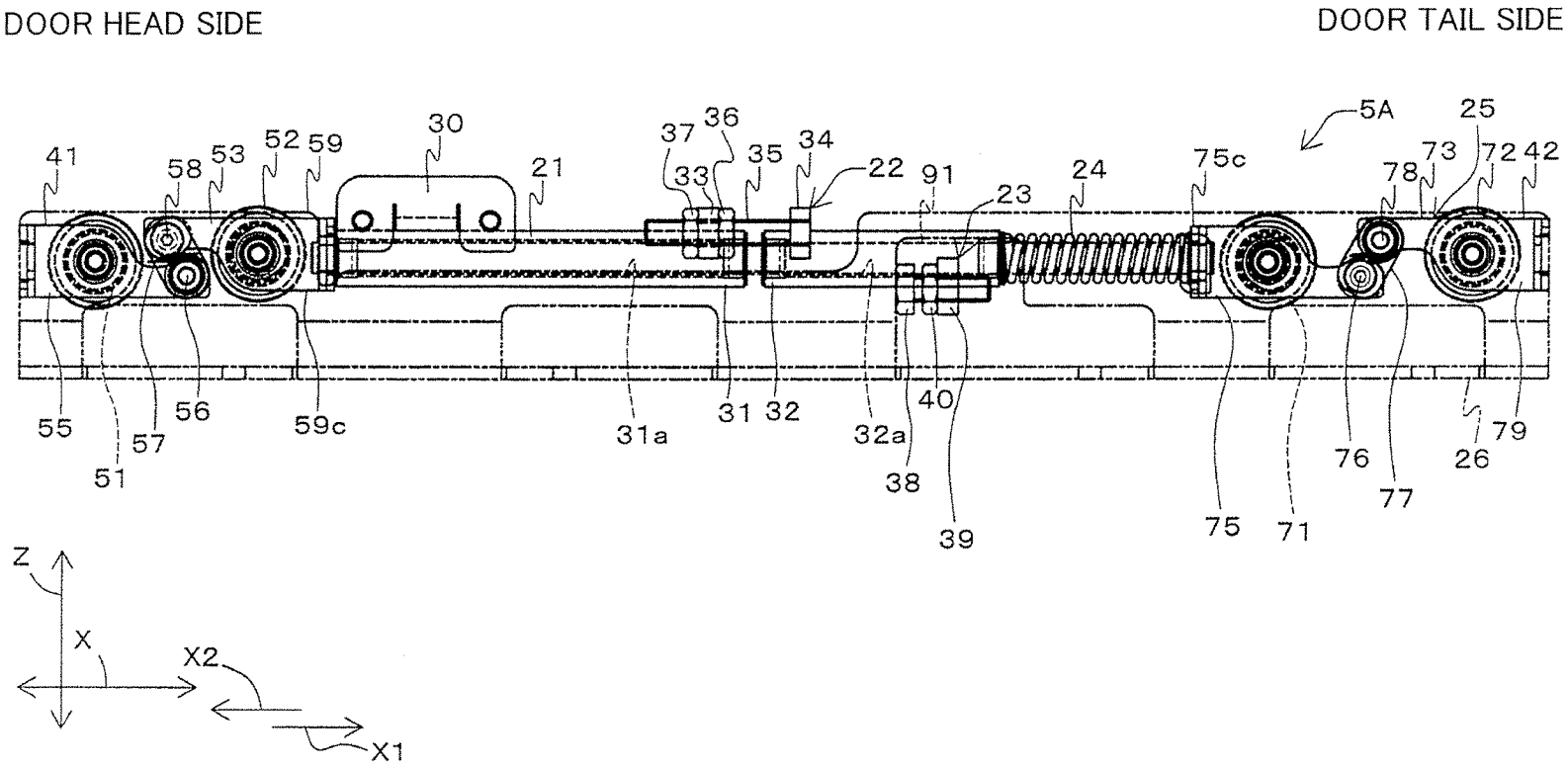
FIG. 3 is a front view of a door suspension device.
Figure 4:
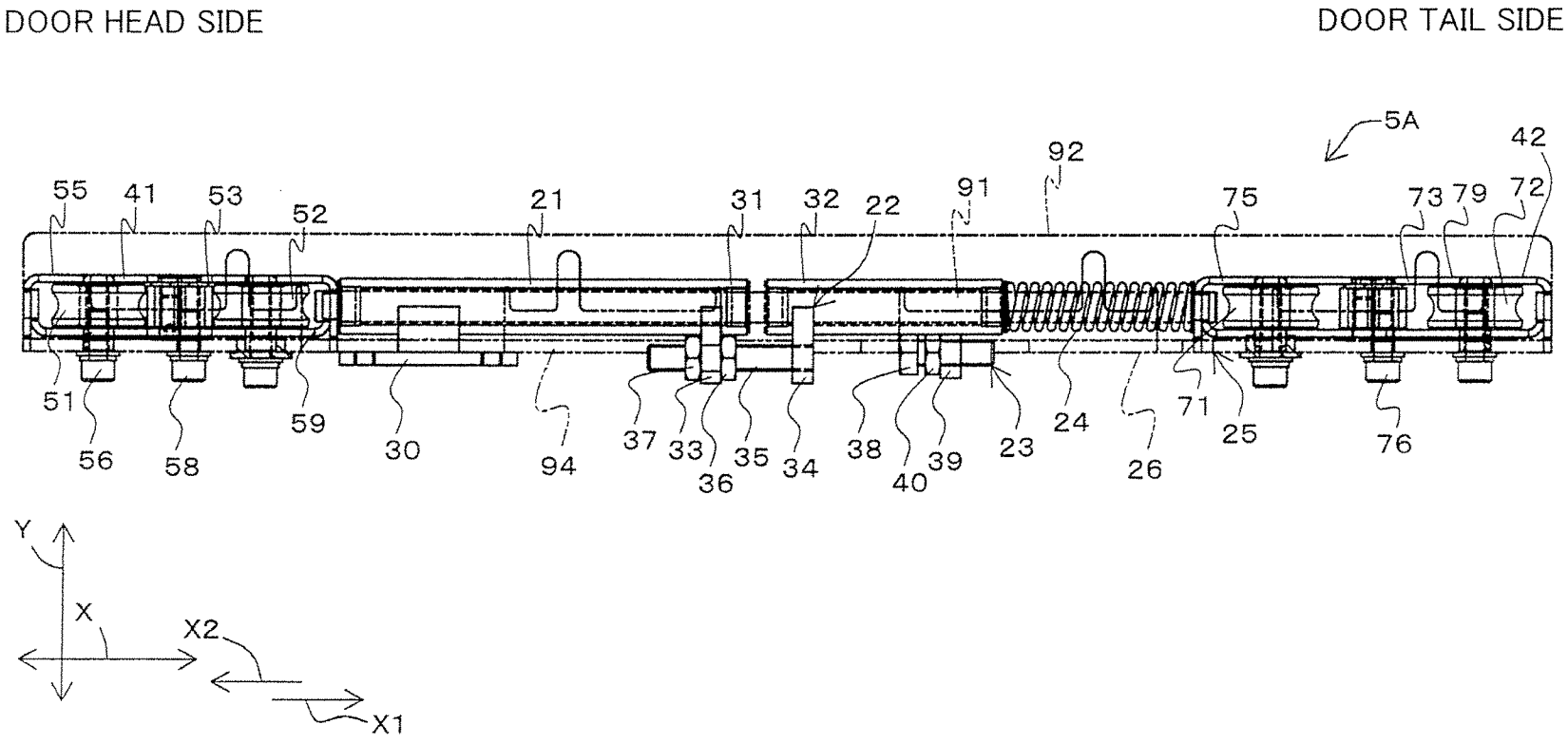
FIG. 4 is a plan view of a door suspension device.
Figure 5:
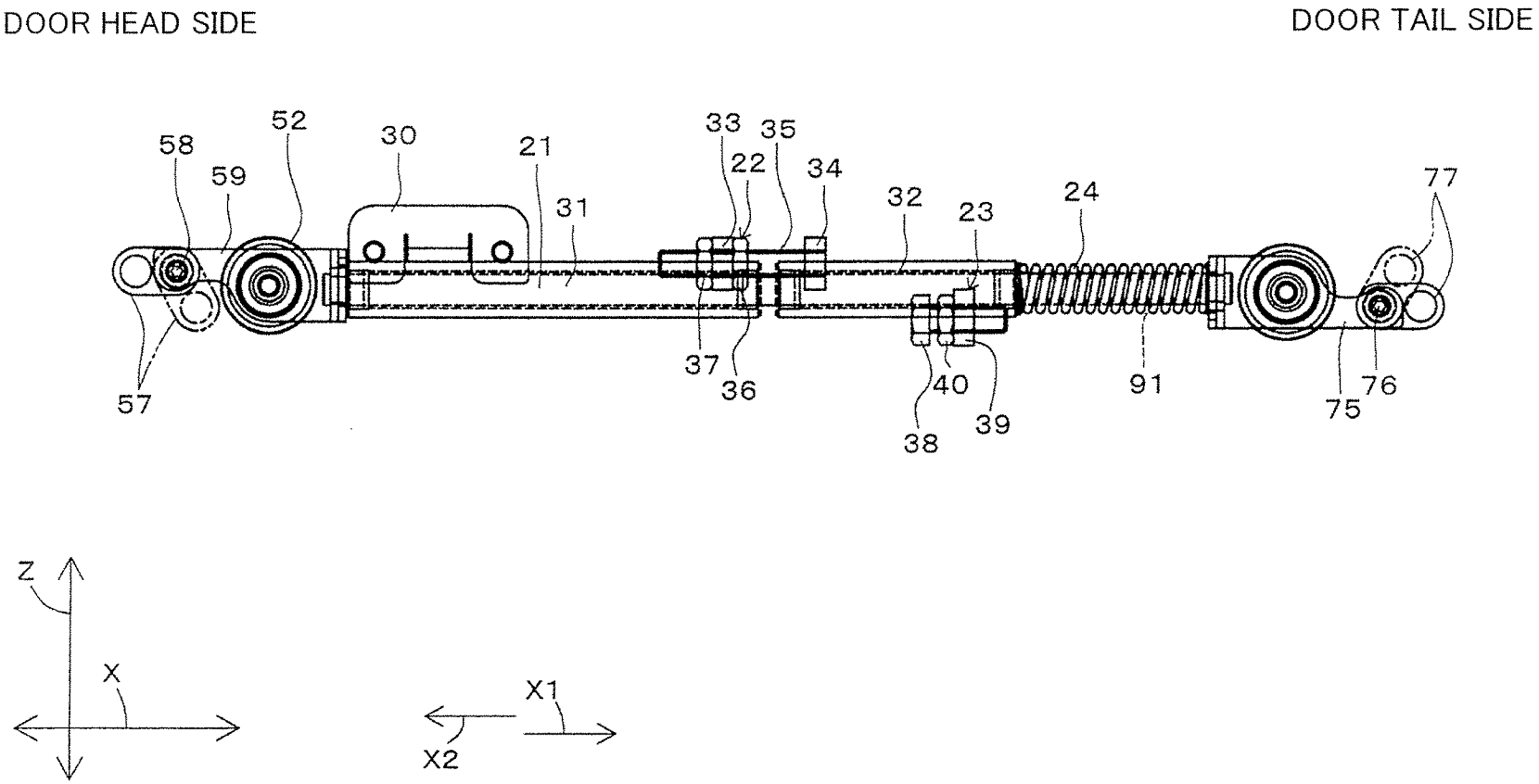
FIG. 5 is a front view showing a drive coupling section and the like of a door suspension device.
Figure 6:
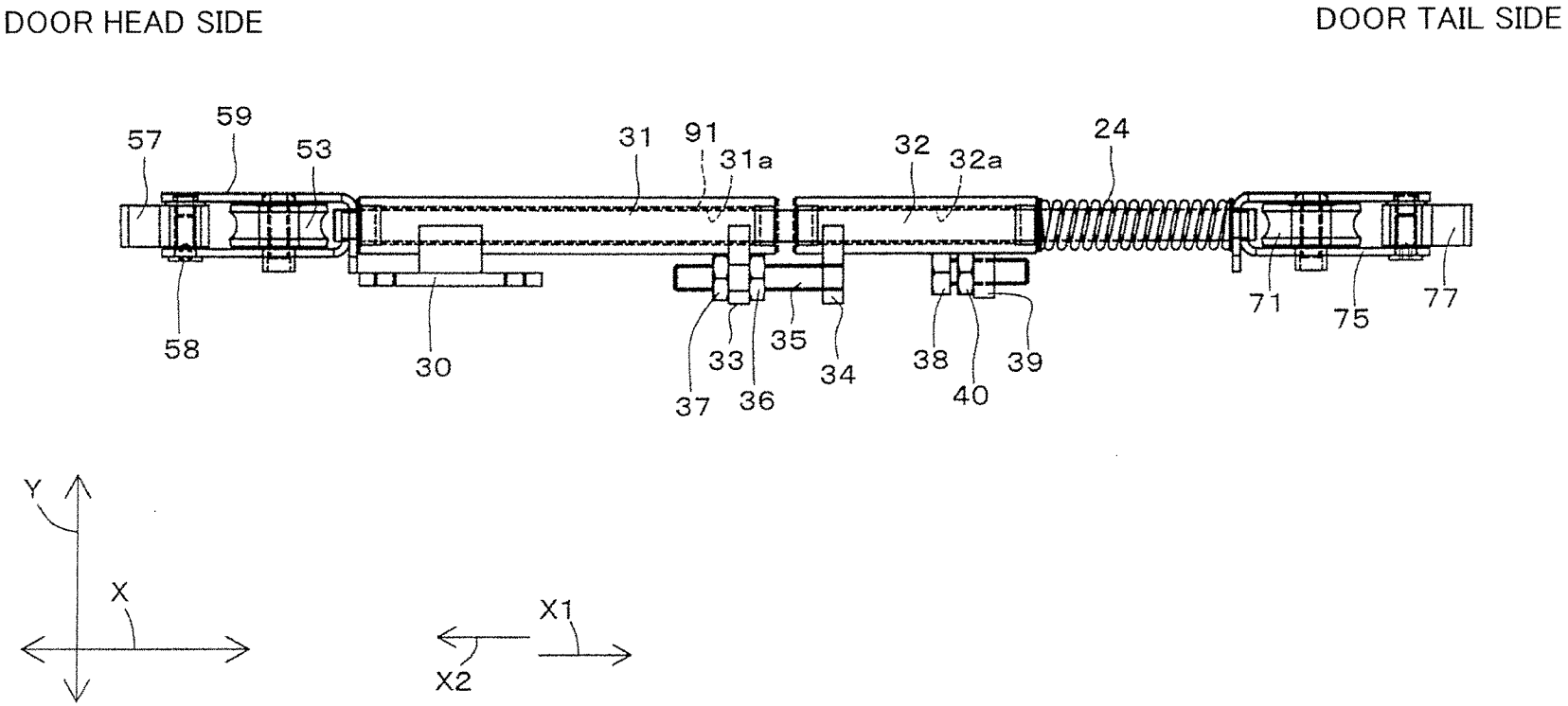
FIG. 6 is a plan view of FIG. 5 and shows a drive coupling section and the like of the door suspension device.

FIG. 3 is a front view of the door suspension device 5A. FIG. 4 is a plan view of the door suspension device 5A. FIG. 5 is a front view showing the driving-side member 21 and the like of the door suspension device 5A. FIG. 6 is a plan view of FIG. 5 and shows the driving-side member 21 and the like of the door suspension device 5A. Next, reference will be made to FIGS. 1 to 4.

The door suspension device 5A includes the driving-side member 21, a static adjustment mechanism 22, a dynamic adjustment mechanism 23, an elastic member 24, a door roller unit 25, a hanger 26 that supports the door 2 (the door 2A), and a rail member 27.

It should be noted that the hanger 26 is depicted in some drawings by a two-dot chain line that represents an imaginary line.

The driving-side member 21 is provided in order to transfer the drive force from the opening/closing drive mechanism 6 to the door 2 via the elastic member 24, the hanger 26, and the like. In addition, the driving-side member 21 is configured to be capable of adjusting relative positions of the lower coupling stay 13 of the opening/closing drive mechanism 6 and the door 2 (the hanger 26) in the opening/closing direction X. Furthermore, the driving-side member 21 is configured to be capable of adjusting an initial value of an elastic repulsive force (an initial set load) of the elastic member 24 which acts between the lower coupling stay 13 of the opening/closing drive mechanism 6 and the door 2 (the hanger 26).

Moreover, the initial set load refers to an elastic repulsive force of the elastic member 24 which acts between the lower coupling stay 13 and the door 2 (the hanger 26) when the door 2 is in a stationary state and an external force is not acting on the door 2. The driving-side member 21 is formed in a shape that is elongated in the opening/closing direction X and is configured so as to be integrally displaced with the lower coupling stay 13 in the opening/closing direction X.

Figure 7:
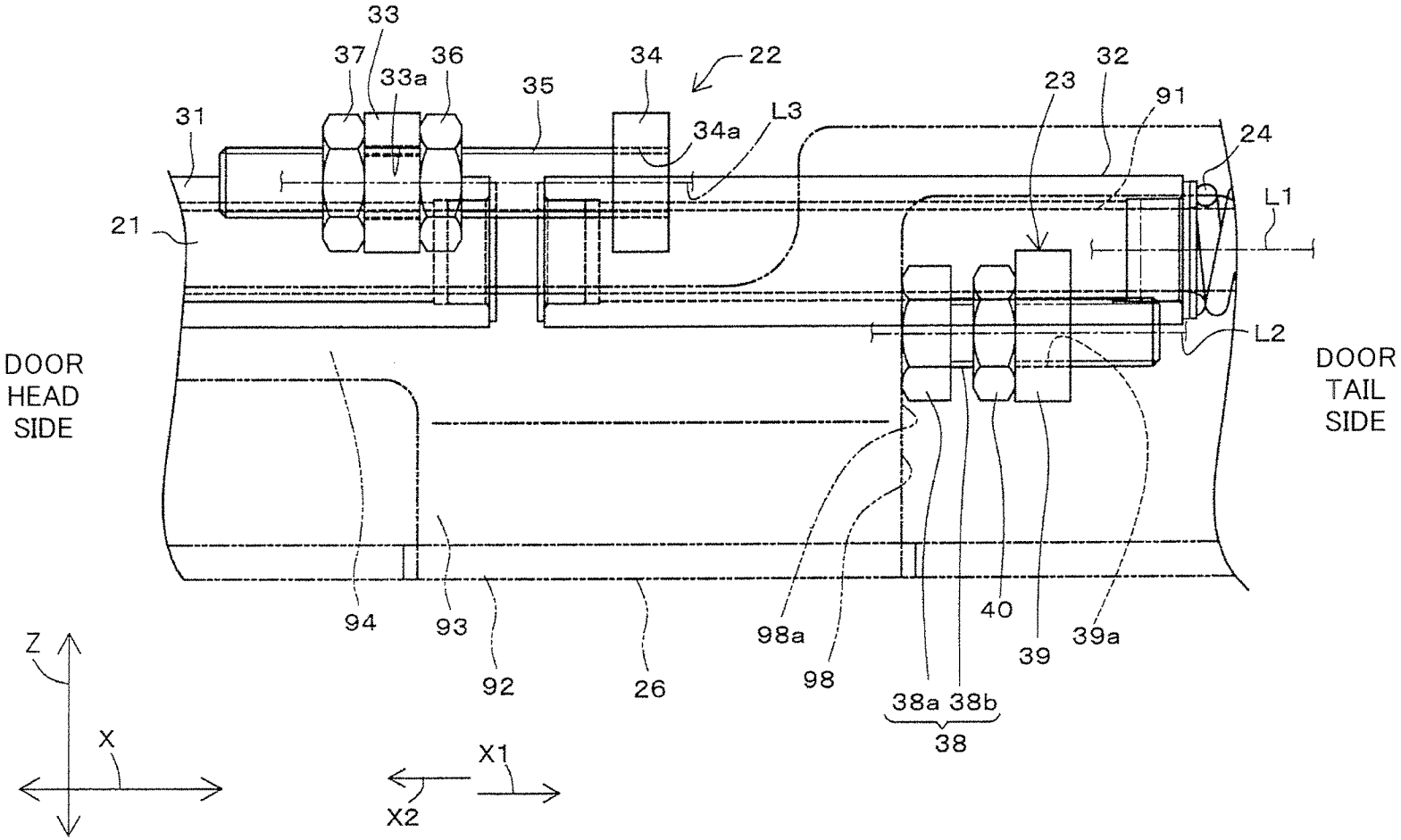
FIG. 7 is an enlarged front view of a periphery of a drive coupling section.
Figure 8:
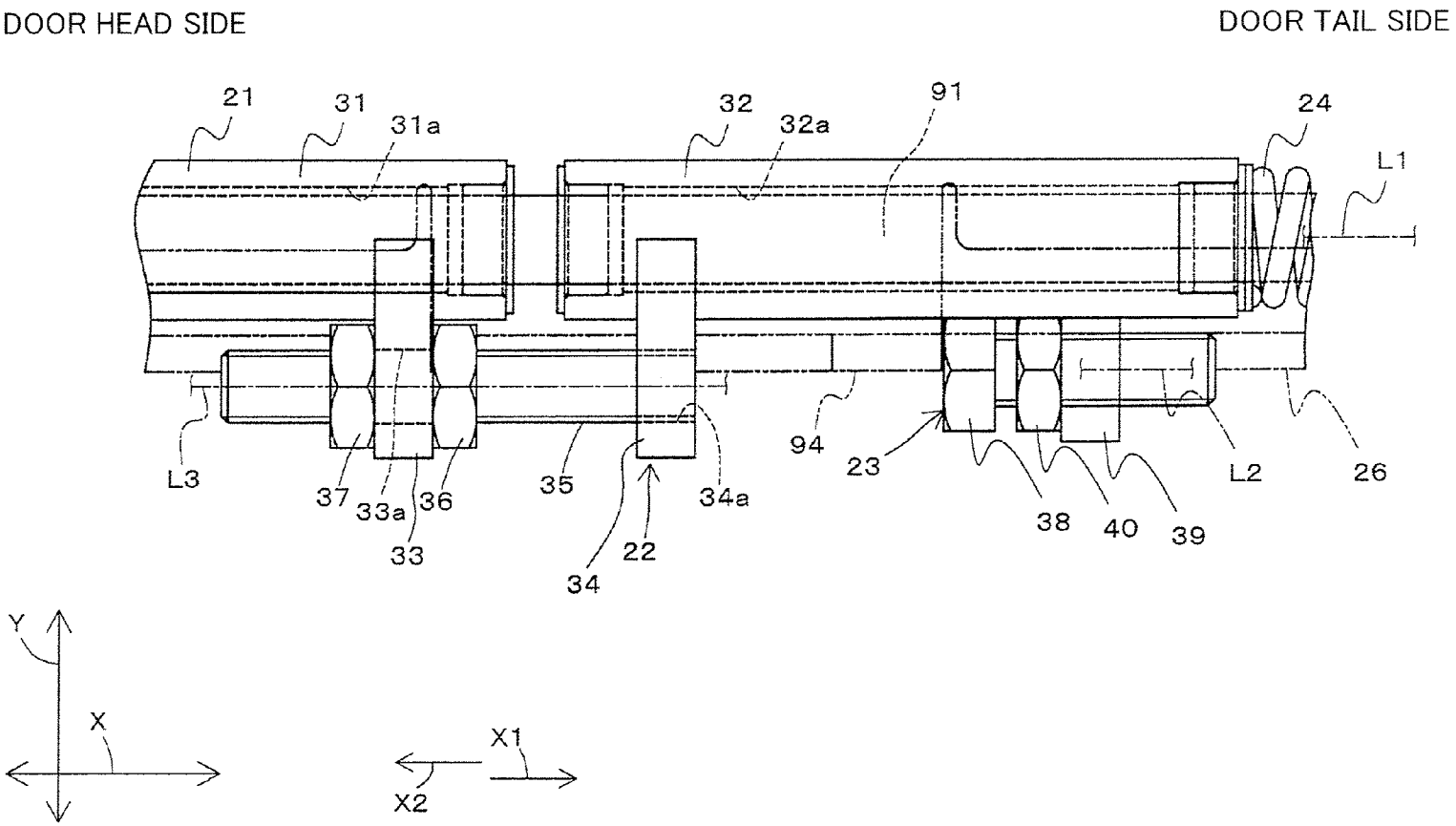
FIG. 8 is an enlarged plan view of a periphery of a drive coupling section.

FIG. 7 is an enlarged front view of a periphery of the driving-side member 21. FIG. 8 is an enlarged plan view of a periphery of the driving-side member 21. With reference to FIG. 2 and FIGS. 5 to 8, the driving-side member 21 is a member that is displaceable in the opening/closing direction X when a drive force is imparted from the opening/closing drive mechanism 6. The driving-side member 21 includes the seat 30, a first member 31, and a second member 32.

The seat 30 is a portion to which the lower coupling stay 13 is fixed using a fixing member such as a screw. Moreover, in the door suspension device 5B, the upper coupling stay 12 is fixed to the seat 30 instead of the lower coupling stay 13. The seat 30 is arranged on a door head-side end of the first member 31.

The first member 31 is formed as a hollow shaft that extends in the opening/closing direction X. The first member 31 receives a drive force from the lower coupling stay 13 of the opening/closing drive mechanism 6 via the seat 30. The second member 32 is arranged on a door tail side of the first member 31.

The second member 32 is formed using a separate member from the first member 31 and is coupled to the hanger 26 via the dynamic adjustment mechanism 23. The second member 32 is formed as a hollow shaft that extends in the opening/closing direction X and is aligned with the first member 31 in the opening/closing direction X. The second member 32 is fixed to the first member 31 via the static adjustment mechanism 22.

The static adjustment mechanism 22 is provided in order to adjust a position of the hanger 26 with respect to the opening/closing drive mechanism 6 in the opening/closing direction X. Specifically, the static adjustment mechanism 22 is configured so as to be capable of adjusting relative positions of the first member 31 and the second member 32 in the opening/closing direction X. For example, the static adjustment mechanism 22 is provided above the first member 31 and the second member 32. In the present embodiment, the static adjustment mechanism 22 is a screw-type adjustment mechanism.

The static adjustment mechanism 22 includes a first receiving section 33 formed on a door tail-side end of the first member 31, a second receiving section 34 formed on a door head-side end of the second member 32, a second adjustment bolt 35, and a pair of nuts 36 and 37.

The first receiving section 33 and the second receiving section 34 are small-piece members in which a through-hole section 33*a* and a female screw section 34*a* are respectively formed. The first receiving section 33 is fixed to the first member 31, the second receiving section 34 is fixed to the second member 32, and the first receiving section 33 and the second receiving section 34 are aligned in the opening/closing direction X. The second adjustment bolt 35 is, for example, a stud bolt and is joined to at least one of the first receiving section 33 and the second receiving section 34 using screw joining.

In the present embodiment, the second adjustment bolt 35 is inserted with a gap into the through-hole section 33*a* of the first receiving section 33. In addition, the second adjustment bolt 35 is joined to the female screw section 34*a* of the second receiving section 34 using screw joining and fixed to the second receiving section 34 by welding. The second adjustment bolt 35 extends from the second receiving section 34 toward the door head side. The nuts 36 and 37 are joined by screwing to the second adjustment bolt 35.

The nuts 36 and 37 are arranged so as to sandwich the first receiving section 33 in the opening/closing direction X and are fastened to the second adjustment bolt 35. By adjusting positions in the opening/closing direction X of the nuts 36 and 37 with respect to the second adjustment bolt 35 using a tool such as a spanner, relative positions of the first member 31 and the second member 32 in the opening/closing direction X can be adjusted. In other words, relative positions of the lower coupling stay 13 of the opening/closing drive mechanism 6 which is coupled to the first member 31 and the hanger 26 (the door 2) coupled to the second member 32 via the dynamic adjustment mechanism 23 can be adjusted.

In addition, the nuts 36 and 37 also function as lock nuts and fix the second adjustment bolt 35 to the first receiving section 33. Alternatively, the first receiving section 33 may be fixed to the second member 32 and the second receiving section 34 may be fixed to the first member 31.

The dynamic adjustment mechanism 23 is provided adjacent to the static adjustment mechanism 22.

The dynamic adjustment mechanism 23 is provided as a mechanism for adjusting an initial value of a load (a set load) which acts between the driving-side member 21 and the hanger 26. By being supported by the second member 32 and received by the hanger 26, the dynamic adjustment mechanism 23 sets a spring length of the elastic member 24 which receives loads from the second member 32 (the driving-side member 21) and the hanger 26. In the present embodiment, the dynamic adjustment mechanism 23 is a screw mechanism. The dynamic adjustment mechanism 23 is arranged on a door tail-side end of the second member 32 in the present embodiment.

The dynamic adjustment mechanism 23 includes a first adjustment bolt 38, a fixing nut 39, and a lock nut 40.

The first adjustment bolt 38 is provided as a bolt member for adjusting an initial value of a load (an initial set load) which acts between the driving-side member 21 and the hanger 26. The first adjustment bolt 38 extends in the opening/closing direction X. The first adjustment bolt 38 is arranged adjacent to a lower part of the second member 32 of the driving-side member 21 and is parallel to the second member 32. A position of the first adjustment bolt 38 and a position of the second adjustment bolt 35 are mutually offset in at least one (in the present embodiment, both) of a vertical direction Z of the door suspension device 5A and the opening/closing direction X. In the present embodiment, the position of the first adjustment bolt 38 in the vertical direction Z is lower than the position of the second adjustment bolt 35. In addition, the first adjustment bolt 38 is arranged at a position that is further toward the door tail side from the second adjustment bolt 35.

The first adjustment bolt 38 is a headed bolt and includes a head 38*a* and a male screw section 38*b*.

The head 38*a* is an example of "the received section" according to the present invention. The head 38*a* is, for example, a hexagonally-shaped head and is arranged at a door head-side end of the first adjustment bolt 38. An end surface of the head 38*a* is received by an edge 98*a* (to be described later) of the hanger 26 at an intermediate section of the hanger 26 in the opening/closing direction X. In other words, the head 38*a* is received by the hanger 26 so that a force directed toward the door head side from the first adjustment bolt 38 is received by the edge 98*a* (to be described later) of the hanger 26.

Accordingly, the head 38*a* is arranged so that an axial force acting on the first adjustment bolt 38 is received by the edge 98*a* of the hanger 26. In a plan view (FIG. 8), a part of the head 38*a* is arranged so as to be hidden by the second member 32 of the driving-side member 21. Accordingly, the door suspension device 5 has a short width in a thickness direction Y of the door 2.

The male screw section 38*b* extends from the head 38*a* toward the door tail side. In other words, the first adjustment bolt 38 is arranged so as to extend toward the door tail side. As described above, the direction in which the first adjustment bolt 38 extends from the hanger 26 and the direction in which the second adjustment bolt 35 extends from the driving-side member 21 are set to opposite directions.

The male screw section 38*b* extends in the opening/closing direction X. The female screw section 39*a* of the fixing nut 39 is joined by screwing to the male screw section 38*b*. The fixing nut 39 is a nut member provided on the second member 32 of the driving-side member 21 and constitutes a part of the driving-side member 21. The fixing nut 39 is arranged in a notched section 98 of the hanger 26. The lock nut 40 is fastened to the fixing nut 39. The lock nut 40 is provided in order to fix the first adjustment bolt 38 to the fixing nut 39 and is arranged in the present embodiment between the head 38*a* and the fixing nut 39.

With the dynamic adjustment mechanism 23, a position of the first adjustment bolt 38 with respect to the fixing nut 39 is adjusted using a tool such as a spanner and, subsequently, the first adjustment bolt 38 and the fixing nut 39 are fastened to each other by the lock nut 40. Accordingly, an amount of compression of the elastic member 24 or, in other words, the initial set load can be adjusted through the adjustment of the position of the hanger 26 with respect to the driving-side member 21. A first subunit 41 and a second subunit 42 of the door roller unit 25 are arranged so as to sandwich the dynamic adjustment mechanism 23 configured as described above in the opening/closing direction X.

Figure 9:
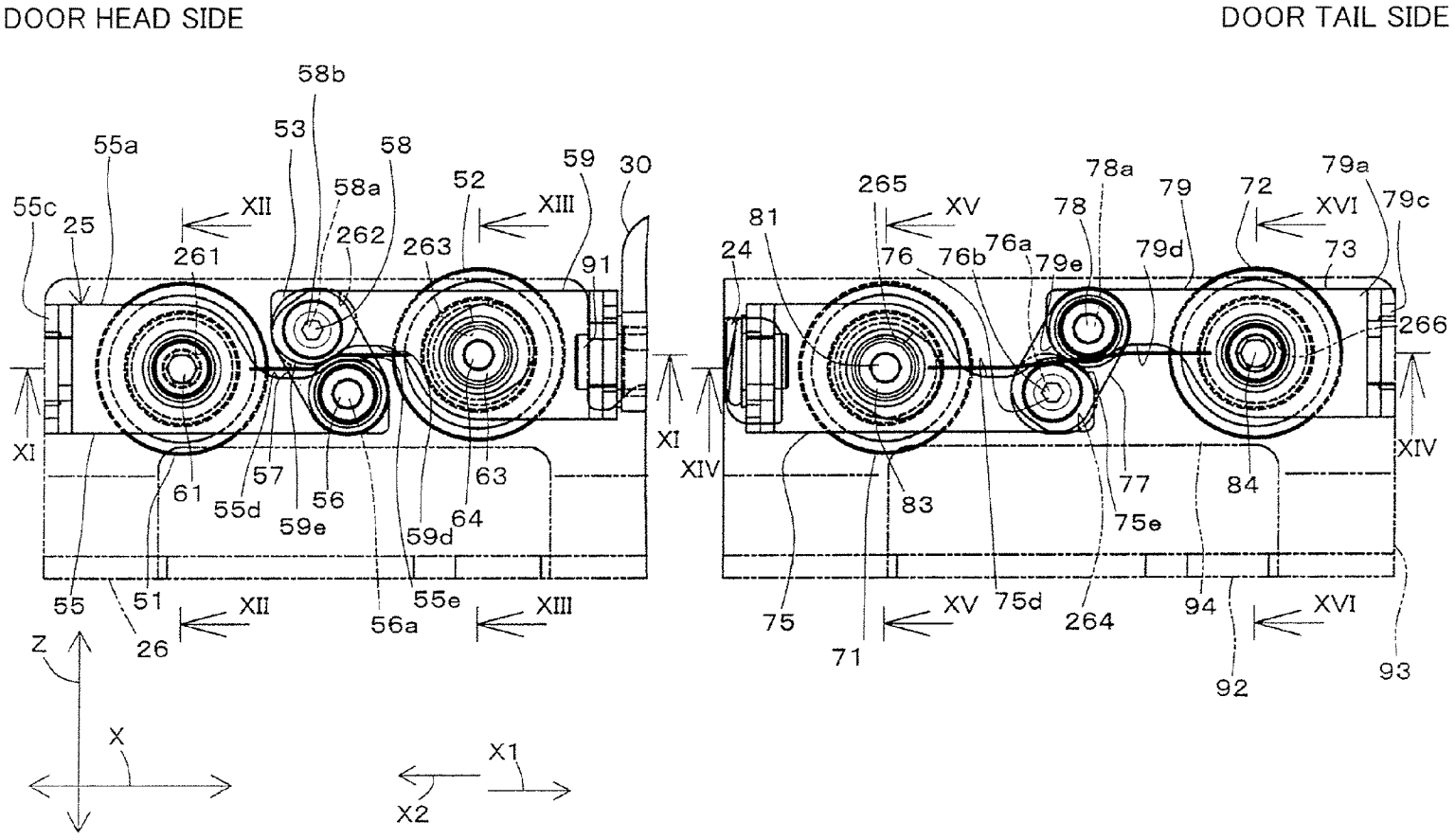
FIG. 9 is an enlarged view of a periphery of a door roller unit shown in FIG. 3.
Figure 10:
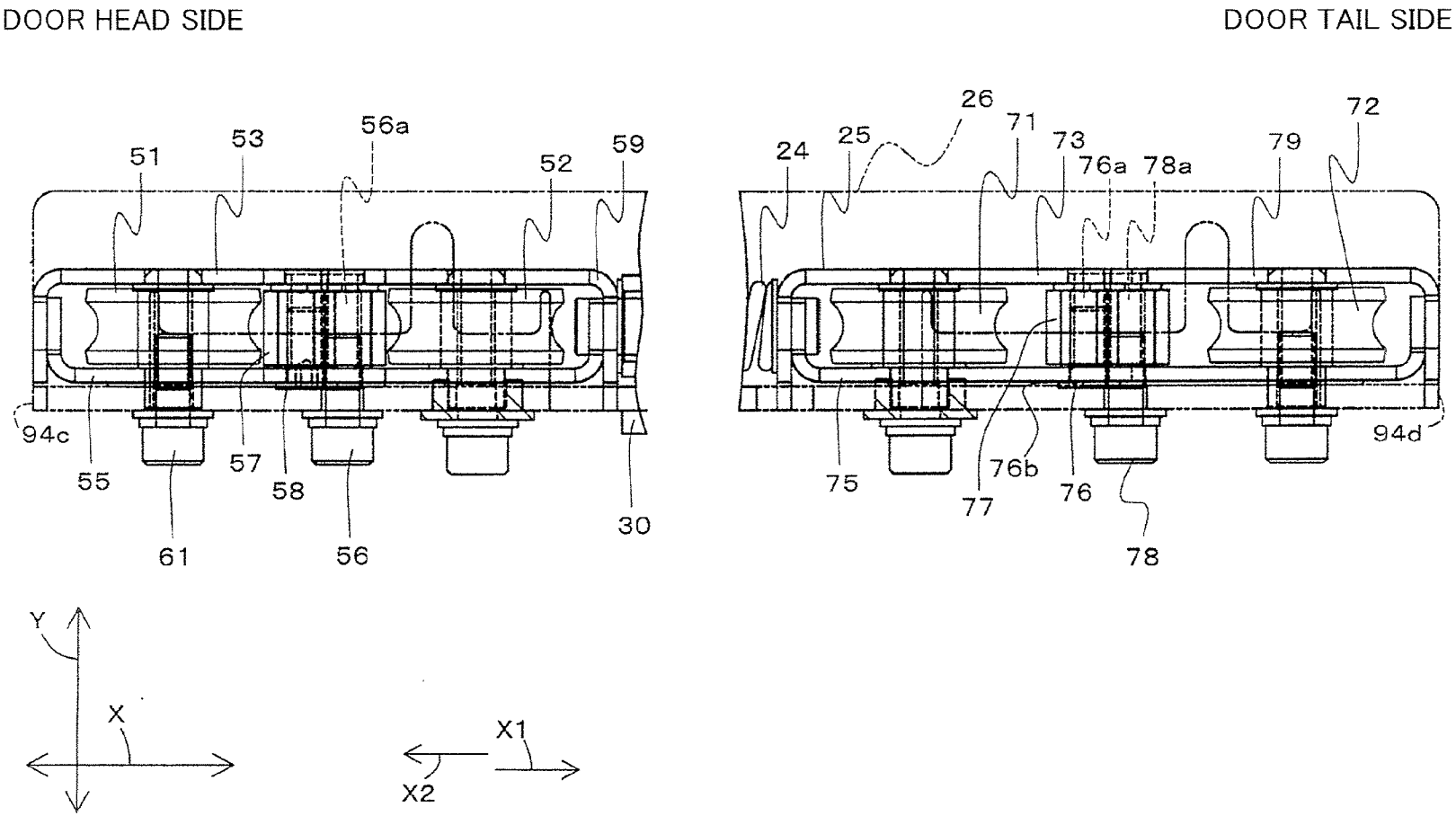
FIG. 10 is an enlarged view of a periphery of a door roller unit shown in FIG. 4.

FIG. 9 is an enlarged front view of a periphery of the door roller unit 25 shown in FIG. 3. FIG. 10 is an enlarged plan view of a periphery of the door roller unit 25 shown in FIG. 4. With reference to FIGS. 2, 3, and 9, the door roller unit 25 displaces the door 2 in the opening/closing direction X by transferring a drive force from the driving-side member 21 to the hanger 26.

In addition, the door roller unit 25 is configured so as to prevent the door from moving so as to wobble in the vertical direction Z (door bouncing) when the opening/closing drive mechanism 6 attempts to open the door 2 in a state such as when a passenger is leaning against the door 2. The driving-side member 21 is arranged between door roller units 25.

The door roller unit 25 includes the first subunit 41 and the second subunit 42.

The first subunit 41 is arranged on a door head side of the first member 31 of the driving-side member 21 (a door head side of the door 2) and supports respective door head-side ends of the hanger 26 and the door 2. The second subunit 42 is arranged on a door tail side of the second member 32 of the driving-side member 21 (a door tail side of the door 2) and supports respective door tail-side ends of the hanger 26 and the door 2. As will be described later, the first subunit 41 and the second subunit 42 are coupled to each other via a coupling member 91 that penetrates the driving-side member 21.

The first subunit 41 and the second subunit 42 are, respectively, examples of "the pressing mechanism which presses a door roller that guides a movement of a hanger in an opening/closing direction against a rail when a load that is equal to or greater than a prescribed threshold acts between the driving-side member and the hanger" according to the present invention. In addition, the first subunit 41 and the second subunit 42 are, respectively, examples of "the movement conversion mechanism which converts a movement in which the driving-side member and the hanger are relatively displaced in the opening/closing direction into a movement in which a pressed door roller is pressed against one of a pair of rails" according to the present invention.

Figure 11:
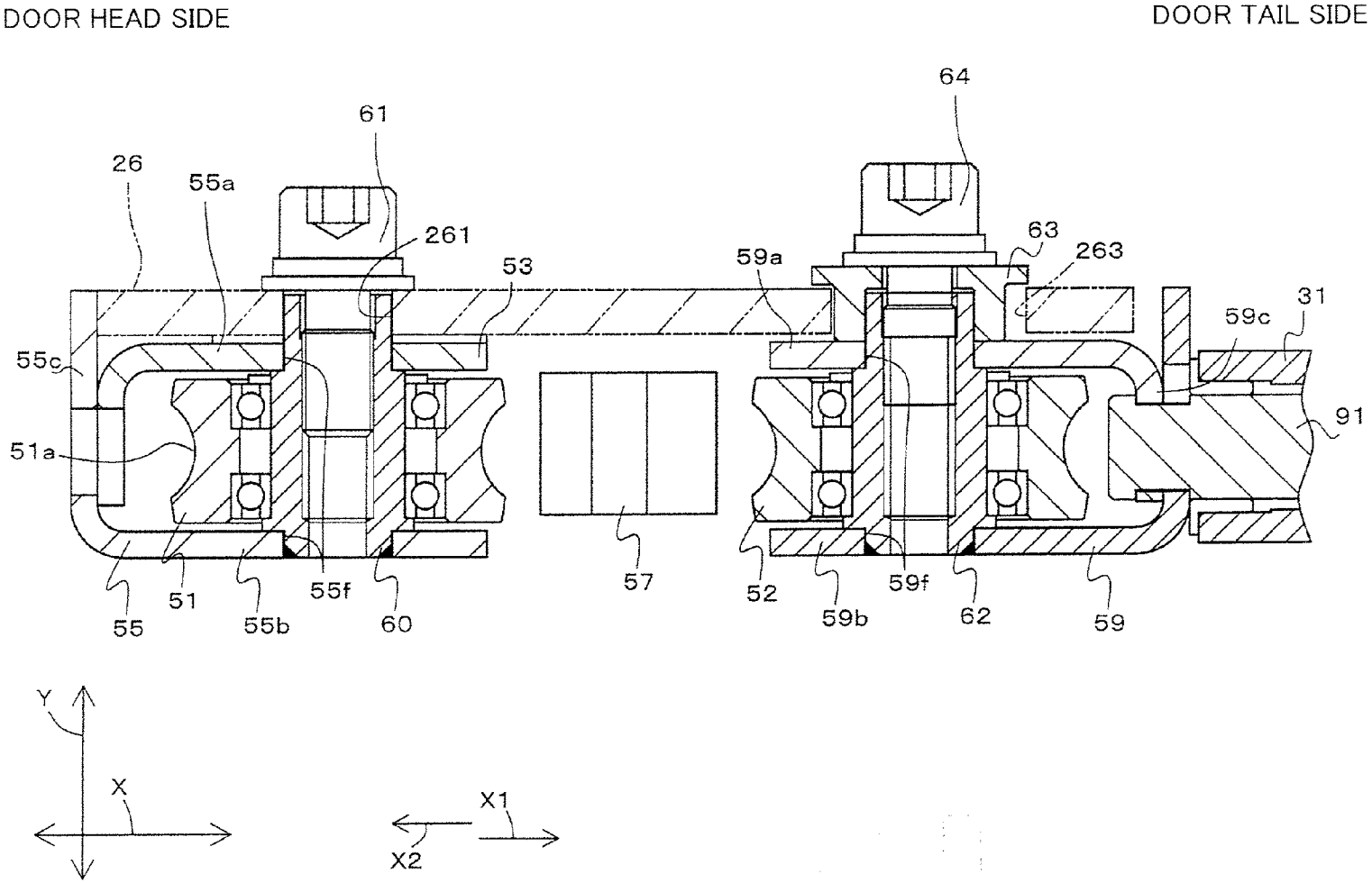
FIG. 11 is a sectional view taken along line XI-XI in FIG. 9.
Figure 12:
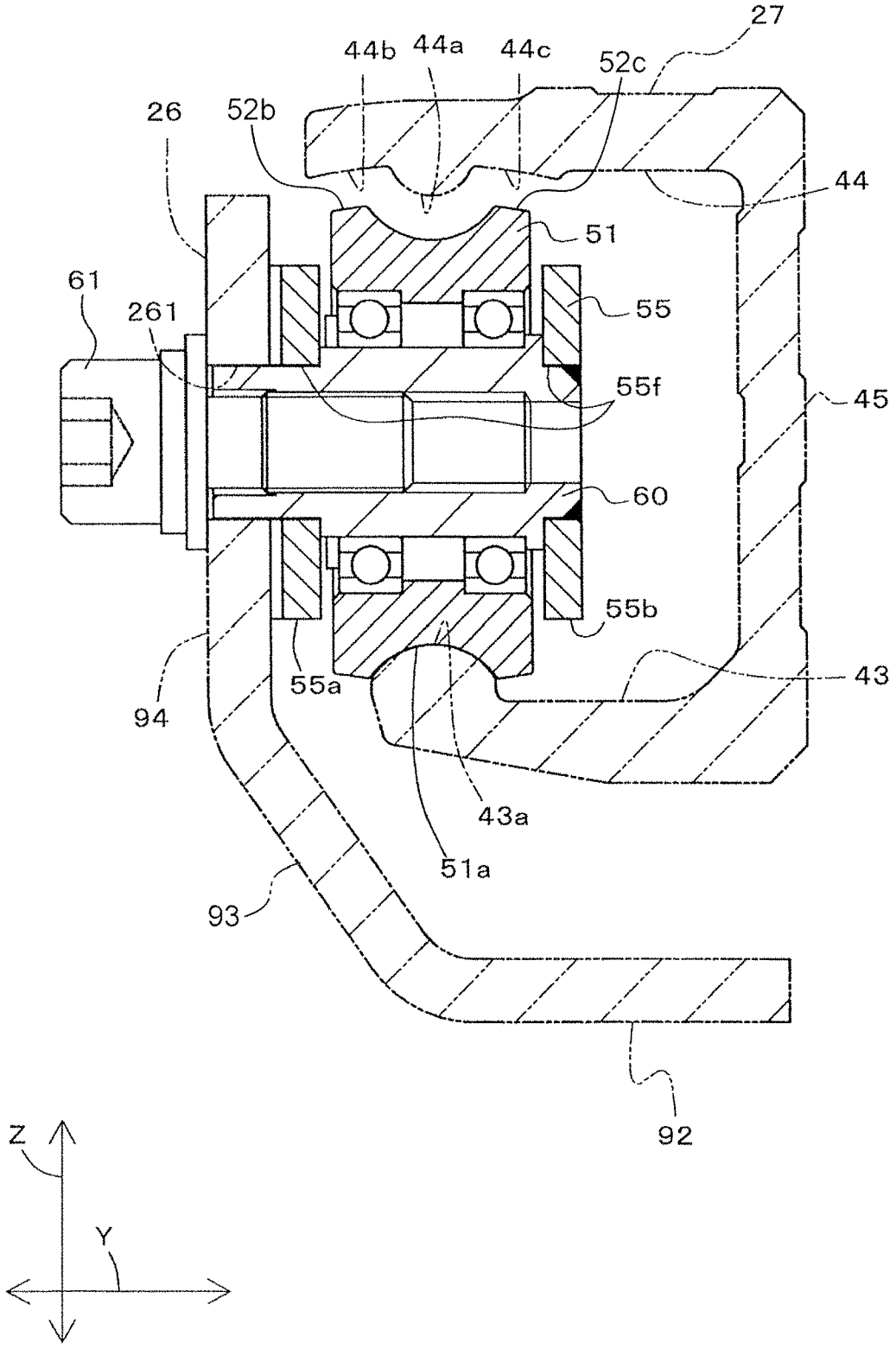
FIG. 12 is a sectional view taken along line XII-XII in FIG. 9.
Figure 13:
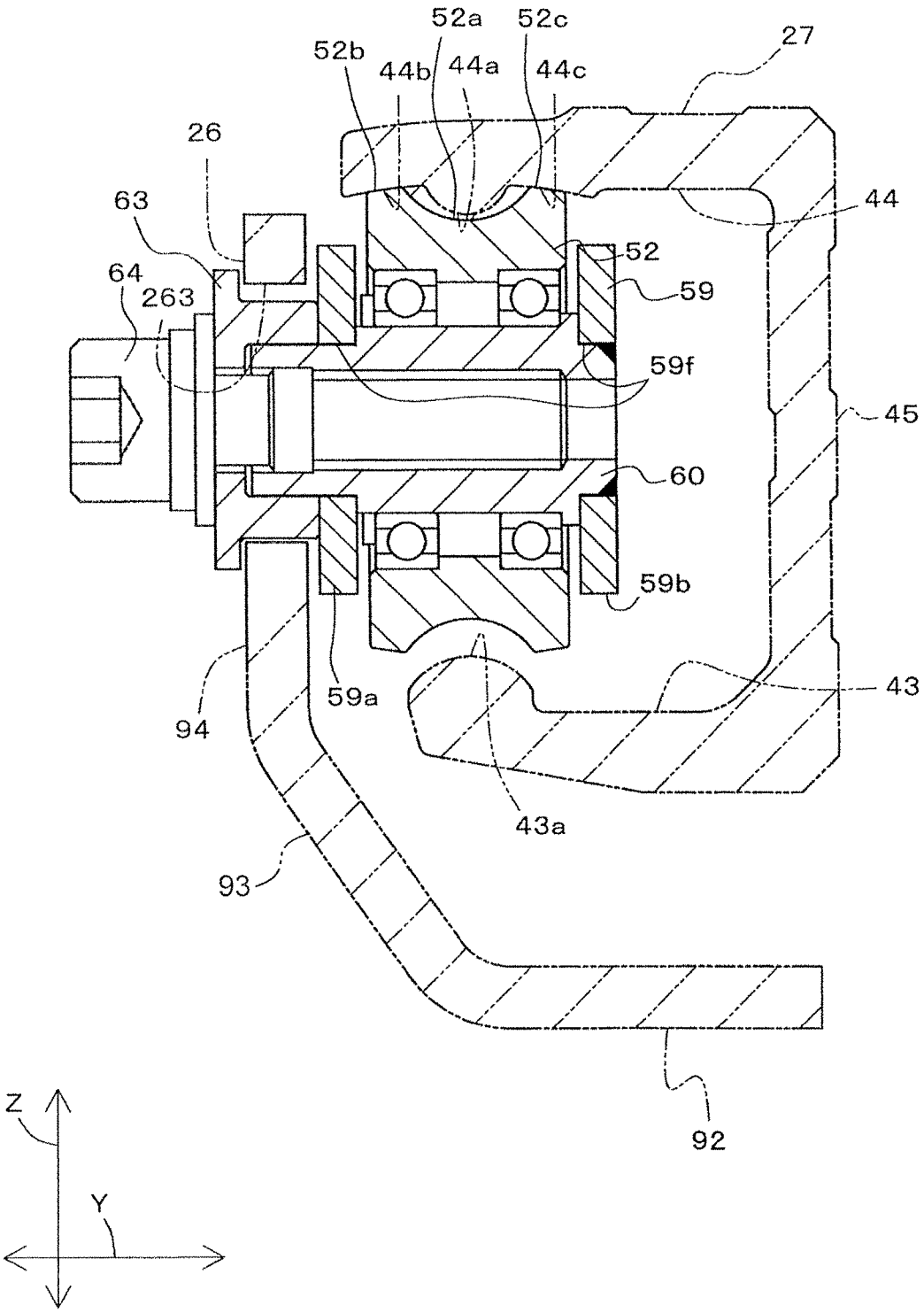
FIG. 13 is a sectional view taken along line XIII-XIII in FIG. 9.

FIG. 11 is a sectional view taken along line XI-XI in FIG. 9. FIG. 12 is a sectional view taken along line XII-XII in FIG. 9. FIG. 13 is a sectional view taken along line XIII-XIII in FIG. 9. Moreover, in the present embodiment, depiction of members that appear on a distal side of a cutting plane in the sectional views may sometimes be omitted.

With reference to FIGS. 1 and 3 and FIGS. 9 to 13, the rail member 27 will be described prior to describing the first subunit 41. The rail member 27 extends in the opening/closing direction X and is fixed to the vehicle body. The rail member 27 is provided in order to guide a movement of the hanger 26 in the opening/closing direction X. In the present embodiment, the rail member 27 is an integrally molded object formed using a metal member or the like. The rail member 27 is formed in an approximate U-shape in a cross section perpendicular to the opening/closing direction X.

The rail member 27 includes a lower rail 43 and an upper rail 44 as a pair of upper and lower rails and a coupling section 45 that couples the rails 43 and 44 to each other.

The lower rail 43 is provided as a portion which receives a first constant contact door roller 51 and a second constant contact door roller 71 (to be described later) and which comes into rolling contact with the constant contact door rollers 51 and 71. The lower rail 43 extends in the opening/closing direction X. The lower rail 43 includes a projecting strip section 43*a*. The projecting strip section 43*a* extends in the opening/closing direction X and has a shape that protrudes and curves upward.

The upper rail 44 is provided as a portion which receives a first pressed door roller 52 and a second pressed door roller 72 (to be described later) and which comes into rolling contact with the pressed door rollers 52 and 72. The upper rail 44 extends in the opening/closing direction X. The upper rail 44 includes a projecting strip section 44*a*. The projecting strip section 44*a* extends in the opening/closing direction X and has a shape that protrudes and curves downward. In the upper rail 44, a pair of inclined surfaces 44*b* and 44*c* are formed at both ends of the projecting strip section 44*a* in the thickness direction Y.

The pair of inclined surfaces 44*b* and 44*c* is formed in a smoothly-curved shape and is inclined so as to become lower the further away from the projecting strip section 44*a* in the thickness direction Y. The first subunit 41 and the second subunit 42 are supported by the rail member 27 configured as described above.

The first subunit 41 includes the first constant contact door roller 51, the first pressed door roller 52, and a first linking mechanism 53. The first constant contact door roller 51 and the first pressed door roller 52 are provided in order to guide a displacement of the hanger 26 in the opening/closing direction X and are arranged between the lower rail 43 and the upper rail 44.

The first constant contact door roller 51 is provided as a constant contact door roller that is constantly in contact with the lower rail 43 of the rail member 27. The first constant contact door roller 51 comes into contact with the lower rail 43 while receiving the own weight of the door suspension device 5A and rolls on the lower rail 43 with an opening/closing operation of the door 2. The first constant contact door roller 51 is arranged near the door head-side end of the first subunit 41. The first constant contact door roller 51 is formed in a cylindrical shape. An outer peripheral surface of the first constant contact door roller 51 is formed in a shape that fits with the projecting strip section 43*a* of the lower rail 43.

Specifically, the first constant contact door roller 51 includes a groove section 51*a* in an intermediate section of the outer peripheral surface of the first constant contact door roller 51 in the thickness direction Y. The groove section 51*a* is formed in a ring shape and comes into rolling contact with the lower rail 43 by fitting onto the projecting strip section 43*a* of the lower rail 43. The first pressed door roller 52 is arranged adjacent to the first constant contact door roller 51.

The first pressed door roller 52 is provided as a door roller that is temporarily pressed against the upper rail 44 of the rail member 27. The first pressed door roller 52 prevents wobbling of the door 2 in the vertical direction Z (door bouncing) by being pressed against the upper rail 44.

The first pressed door roller 52 is capable of rolling on the upper rail 44 with an opening/closing operation of the door 2. The first pressed door roller 52 is arranged near the door tail-side end of the first subunit 41. The first pressed door roller 52 has a same shape as the first constant contact door roller 51 and is formed in a cylindrical shape. An outer peripheral surface of the first pressed door roller 52 is formed in a shape that fits with the projecting strip section 44*a* of the upper rail 44.

Specifically, the first pressed door roller 52 includes a groove section 52*a* in an intermediate section of the outer peripheral surface of the first pressed door roller 52 in the thickness direction Y. The groove section 52*a* is formed in a ring shape and fits onto the projecting strip section 44*a* of the upper rail 44. In addition, on the outer peripheral surface of the first pressed door roller 52, a pair of inclined surfaces 52*b* and 52*c* are formed on both sides of the groove section 52*a* in the thickness direction Y. The inclined surfaces 52*b* and 52*c* oppose the inclined surfaces 44*b* and 44*c* of the upper rail 44 and are formed in shapes that correspond to the shapes of the inclined surfaces 44*b* and 44*c*.

When the respective inclined surfaces 44*b* and 52*b* and the inclined surfaces 44*c* and 52*c* come into contact with each other in a state where the projecting strip section 44*a* of the upper rail 44 is fitted into the groove section 52*a* of the first pressed door roller 52, the first pressed door roller 52 rolls along the upper rail 44. The first constant contact door roller 51 and the first pressed door roller 52 are coupled to the first linking mechanism 53.

The first linking mechanism 53 is provided as a movement conversion mechanism which converts a movement in which the driving-side member 21 and the hanger 26 are relatively displaced in the opening/closing direction X into a movement in which the first pressed door roller 52 is pressed against the upper rail 44.

The first linking mechanism 53 includes a first constant contact door roller supporting member 55, a first spindle 56*a*, a first linking member 57, a second spindle 58*a*, and a second linking member 59.

The first constant contact door roller supporting member 55 is provided as a portion which is fixed to the hanger 26, which supports the first constant contact door roller 51, and which is coupled to the second linking member 59 via the first linking member 57. In the present embodiment, the first constant contact door roller supporting member 55 is formed by combining two sheet-metal members. The first constant contact door roller supporting member 55 is formed in a U-shape in a bottom view (FIG. 11). In addition, the first constant contact door roller supporting member 55 is formed in a shape that is elongated in the opening/closing direction X in a front view.

The first constant contact door roller supporting member 55 includes a pair of side walls 55*a* and 55*b* and an end wall 55*c*.

The pair of side walls 55*a* and 55*b* is a pair of plate-like portions extending in a direction perpendicular to the thickness direction Y of the door 2. The respective side walls 55*a* and 55*b* are formed in a same shape. Bottom surfaces of the respective side walls 55*a* and 55*b* extend horizontally. Meanwhile, upper surfaces of the respective side walls 55*a* and 55*b* are formed in a shape having an undulation. Specifically, the upper surfaces of the respective side walls 55*a* and 55*b* extend horizontally from a door head-side end to an intermediate section of the upper surfaces in the opening/closing direction X.

In addition, the upper surfaces have a recessed surface 55*d* that is recessed downward at a midway section in the opening/closing direction X. Furthermore, a door tail-side end of the upper surfaces in the opening/closing direction X has a protruded surface 55*e* that protrudes upward. The recessed surface 55*d* and the protruded surface 55*e* are respectively formed in arc shapes in a front view and are mutually continuous. The door head-side ends of the pair of side walls 55*a* and 55*b* are made mutually continuous by the end wall 55*c*.

A through-hole 55*f* is formed in the door head-side portions of the respective side walls 55*a* and 55*b*. A cylindrical bush 60 is inserted into the through-hole 55*f*. An outer diameter of an intermediate section of the bush 60 is set larger than an outer diameter of both end sections of the bush 60. The intermediate section of the bush 60 is sandwiched by the side walls 55*a* and 55*b*. The bush 60 is fixed to one side wall 55*h* by welding or the like. The bush 60 supports the first constant contact door roller 51 via a bearing such as a ball bearing. Accordingly, the first constant contact door roller supporting member 55 supports the first constant contact door roller 51 via the bush 60 and the like so as to be rotatable and integrally displaceable.

In addition, the bush 60 penetrates a through-hole 261 formed on the hanger 26. A female screw section is formed on an inner peripheral surface of the bush 60 and the bush 60 is joined by screwing to a bolt 61. The first constant contact door roller supporting member 55 is fixed to the hanger 26 by the bolt 61 and the bush 60.

Furthermore, the first constant contact door roller supporting member 55 supports the first spindle 56*a*. The first spindle 56*a* is a shaft member that extends in the thickness direction Y and is provided as a shaft section of a bolt 56. The bolt 56 is a headed bolt. The bolt 56 penetrates a through-hole (not shown) formed on the respective side walls 55*a* and 55*b* and supports the first linking member 57 via the bush and the like so as to be rotatable around the first spindle 56*a*. Accordingly, the first constant contact door roller supporting member 55 supports the first spindle 56*a*. In addition, the bolt 56 fixes the hanger 26 and the side wall 55*a* of the constant contact door roller supporting member 55 to each other. Accordingly, the first spindle 56*a* is integrally displaced with the hanger 26.

The first linking member 57 is provided as a member that is swingable around the first spindle 56*a* due to relative movements of the driving-side member 21 and the hanger 26 in the opening/closing direction X. The first linking member 57 is a member formed in a block shape that extends in an elongated manner in a front view. As described earlier, the first spindle 56*a* is coupled to one end-side (a lower end-side) portion of the first linking member 57 and the first linking member 57 is supported by the first constant contact door roller supporting member 55 via the first spindle 56*a* and the like. The second spindle 58*a* is coupled to another end-side (an upper end-side) portion of the first linking member 57.

The second spindle 58*a* extends parallel to the first spindle 56*a*. The second spindle 58*a* is provided in order to couple the first linking member 57 and the second linking member 59 to each other so as to be relatively rotatable. The second spindle 58*a* is a shaft member that extends in the thickness direction Y and is provided as a shaft section of a bolt 58. The bolt 58 is a headed bolt. A head 58*b* of the bolt 58 is arranged inside a guide hole section 262 formed on the hanger 26. The bolt 58 (the second spindle 58*a*) penetrates a door head-side portion of the second linking member 59 and supports the second linking member 59 via a bush and the like so as to be rotatable around the second spindle 58*a*. Accordingly, the second linking member 59 is swingable around the second spindle 58*a* with respect to the first linking member 57.

The second linking member 59 is coupled to the first linking member 57, supports the first pressed door roller 52, and coupled to the driving-side member 21 via the coupling member 91 (to be described later) and the elastic member 24. The second linking member 59 is an example of "the door roller bracket" according to the present invention. In the present embodiment, the second linking member 59 is formed by combining two sheet-metal members. The second linking member 59 is formed in a U-shape in a bottom view (FIG. 11). In addition, the second linking member 59 is formed in a shape that is elongated in the opening/closing direction X in a front view.

The second linking member 59 includes a pair of side walls 59*a* and 59*b* and an end wall 59*c*.

The pair of side walls 59*a* and 59*b* is a pair of plate-like portions extending in a direction perpendicular to the thickness direction Y. The respective side walls 59*a* and 59*b* are formed in a same shape. Upper surfaces of the respective side walls 59*a* and 59*b* extend horizontally. Meanwhile, bottom surfaces of the respective side walls 59*a* and 59*b* are formed in a shape having an undulation. Specifically, the lower surfaces of the respective side walls 59*a* and 59*b* extend horizontally from a door tail-side end to an intermediate section of the lower surfaces in the opening/closing direction X.

In addition, the lower surfaces have a recessed surface 59*d* that is recessed upward at a midway section in the opening/closing direction X. Furthermore, a door head-side end of the lower surfaces in the opening/closing direction X has a protruded surface 59*e* that protrudes downward. The recessed surface 59*d* and the protruded surface 59*e* are respectively formed in arc shapes in a front view and are mutually continuous.

Moreover, while a lower surface of the second linking member 59 and an upper surface of the first constant contact door roller supporting member 55 are arranged in a contactless state in the present embodiment, this arrangement is not restrictive. For example, the lower surface and the upper surface may be in contact with each other. In this case, the recessed surface 59*d* and the protruded surface 59*e* of the lower surface form a cam mechanism by coming into contact with the recessed surface 55*d* and the protruded surface 55*e* of the upper surface. Specifically, the cam mechanism is configured so as to convert a movement in which the second linking member 59 is displaced toward a door tail side with respect to the first constant contact door roller supporting member 55 into a movement in which the second linking member 59 is displaced upward. In other words, as the second linking member 59 relatively moves in a direction that separates from the first constant contact door roller supporting member 55, the second linking member 59 is displaced upward.

The door tail-side ends of the pair of side walls 59*a* and 59*b* are made mutually continuous by the end wall 59*c*.

A through-hole 59*f* is formed in the door tail-side portions of the respective side walls 59*a* and 59*b*. A cylindrical bush 62 is inserted into the through-hole 59*f*. An outer diameter of an intermediate section of the bush 62 is set larger than an outer diameter of both end sections of the bush 62. The intermediate section of the bush 62 is sandwiched by the side walls 59*a* and 59*b*. The bush 62 is fixed to one side wall 59*b* by welding or the like. The bush 62 supports the first pressed door roller 52 via a bearing such as a ball bearing. Accordingly, the second linking member 59 supports the first pressed door roller 52 via the bush 62 and the like so as to be rotatable and integrally displaceable. In addition, an end of the bush 62 is arranged inside a guide hole section 263 formed on the hanger 26. Moreover, the bush 60 and the bush 62 are same members which exemplify improved versatility of parts.

A cylindrical collar 63 is fitted into an end of the bush 62. The collar 63 is fixed to the bush 62 using a bolt 64. As will be described later, the collar 63 is fitted into the guide hole section 263 formed on a side wall section 94 of the hanger 26.

The first subunit 41 configured as described above is coupled to the second subunit 42 via the coupling member 91.

Figure 14:
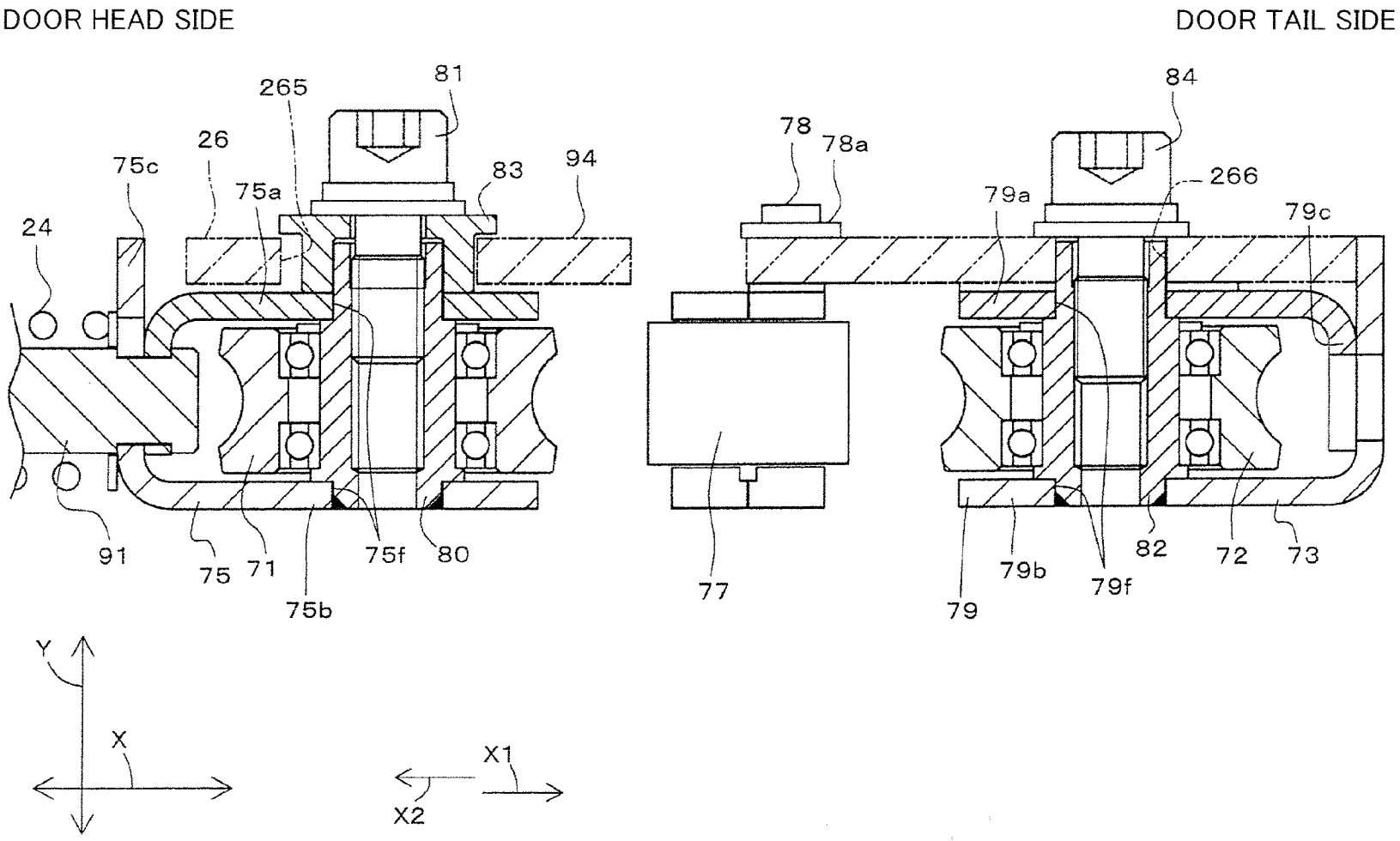
FIG. 14 is a sectional view taken along line XIV-XIV in FIG. 9.
Figure 15:
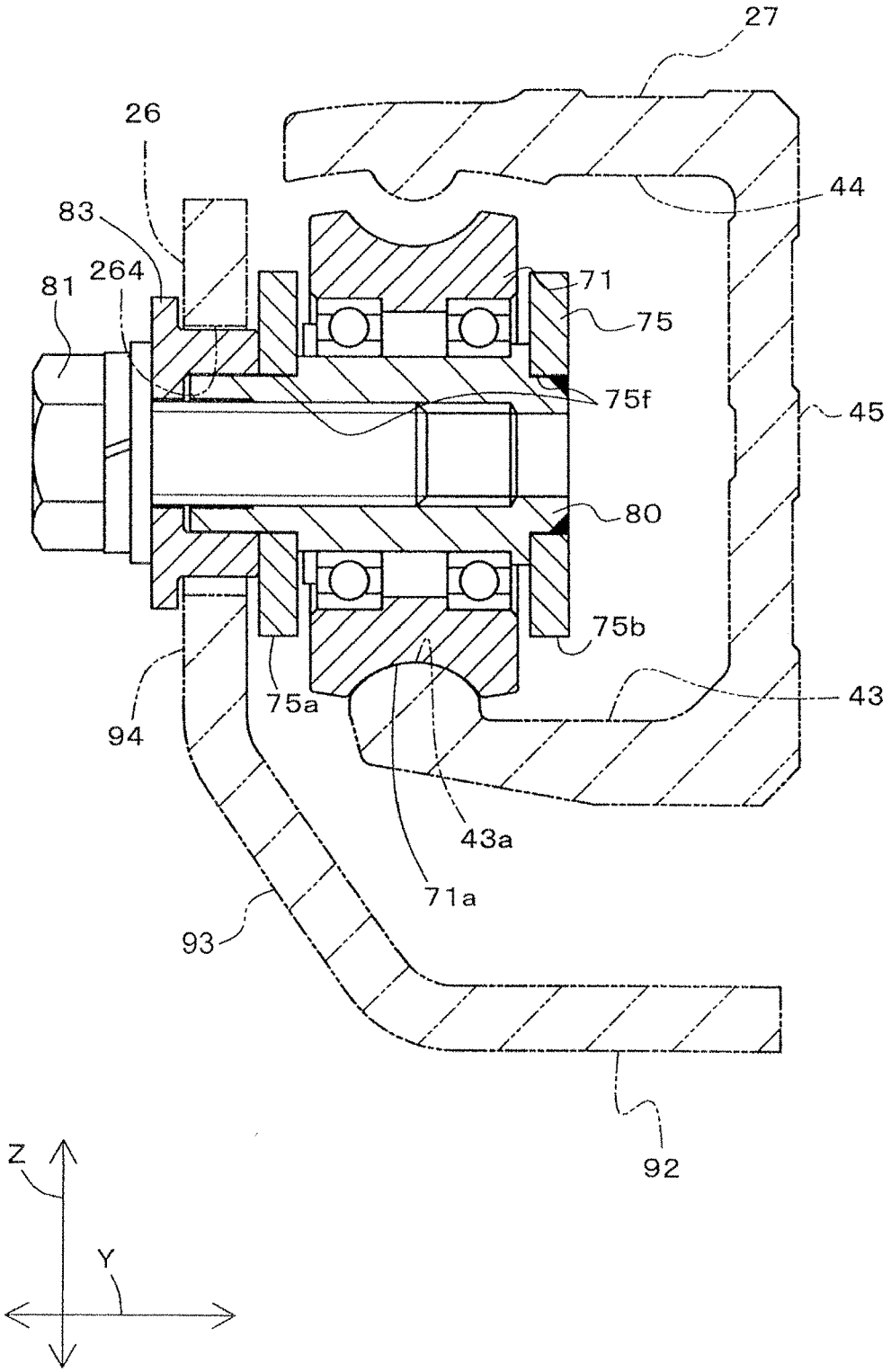
FIG. 15 is a sectional view taken along line XV-XV in FIG. 9.
Figure 16:
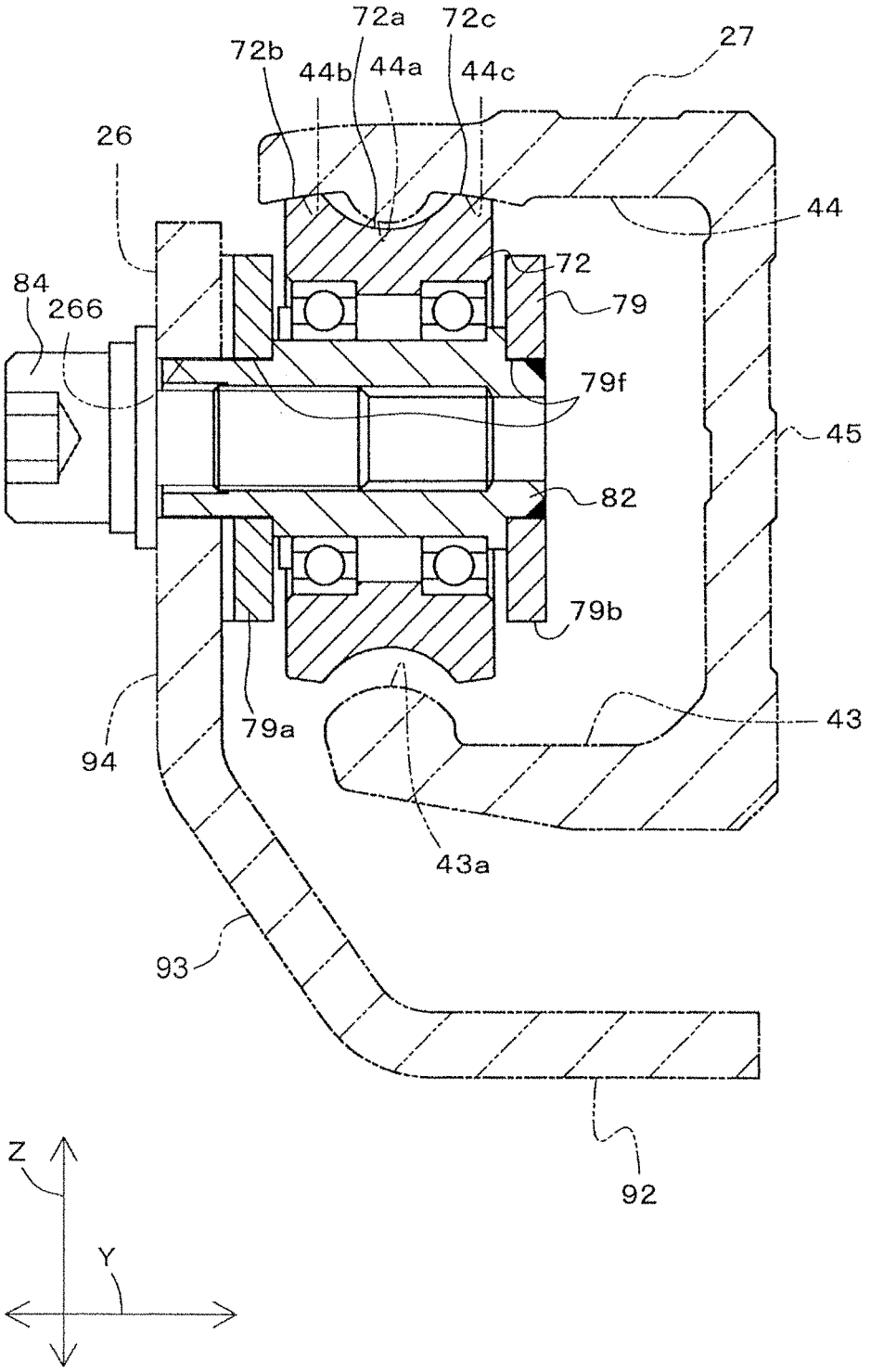
FIG. 16 is a sectional view taken along line XVI-XVI in FIG. 9.

FIG. 14 is a sectional view taken along line XIV-XIV in FIG. 9. FIG. 15 is a sectional view taken along line XV-XV in FIG. 9. FIG. 16 is a sectional view taken along line XVI-XVI in FIG. 9. Next, reference will be made to FIGS. 2, 3, and 9 and to FIGS. 14 to 16.

The second subunit 42 includes a second constant contact door roller 71, a second pressed door roller 72, and a second linking mechanism 73. The second constant contact door roller 71 and the second pressed door roller 72 are provided in order to guide a movement of the hanger 26 in the opening/closing direction X and are arranged between the lower rail 43 and the upper rail 44.

The second constant contact door roller 71 is provided as a constant contact door roller that is constantly in contact with the lower rail 43 of the rail member 27. The second constant contact door roller 71 comes into contact with the lower rail 43 while receiving the own weight of the door suspension device 5A and rolls on the lower rail 43 with an opening/closing operation of the door 2. The second constant contact door roller 71 is arranged near the door head-side end of the second subunit 42. The second constant contact door roller 71 is formed in a same shape as the first constant contact door roller 51. Specifically, the second constant contact door roller 71 is formed in a cylindrical shape. An outer peripheral surface of the second constant contact door roller 71 is formed in a shape that fits with the projecting strip section 43*a* of the lower rail 43.

More specifically, the second constant contact door roller 71 includes a groove section 71*a* in an intermediate section of the outer peripheral surface of the second constant contact door roller 71 in the thickness direction Y. The groove section 71*a* is formed in a ring shape and comes into rolling contact with the lower rail 43 by fitting onto the projecting strip section 43*a* of the lower rail 43. The second pressed door roller 72 is arranged adjacent to the second constant contact door roller 71.

The second pressed door roller 72 is provided as a door roller that is temporarily pressed against the upper rail 44 of the rail member 27. The second pressed door roller 72 prevents wobbling of the door 2 in the vertical direction Z (so-called door bouncing) by being pressed against the upper rail 44. The second pressed door roller 72 is capable of rolling on the upper rail 44 with an opening/closing operation of the door 2. The second pressed door roller 72 is arranged near the door tail-side end of the second subunit 42. The second pressed door roller 72 has a same shape as the second constant contact door roller 71 and is formed in a cylindrical shape. An outer peripheral surface of the second pressed door roller 72 is formed in a shape that fits with the projecting strip section 44*a* of the upper rail 44.

Specifically, the second pressed door roller 72 includes a groove section 72*a* in an intermediate section of the outer peripheral surface of the second pressed door roller 72 in the thickness direction Y. The groove section 72*a* is formed in a ring shape and fits onto the projecting strip section 44*a* of the upper rail 44. In addition, on the outer peripheral surface of the second pressed door roller 72, a pair of inclined surfaces 72*b* and 72*c* are formed on both sides of the groove section 72*a* in the thickness direction Y. The inclined surfaces 72*b* and 72*c* are formed in shapes that correspond to the shapes of the inclined surfaces 44*b* and 44*c* of the upper rail 44.

When the respective inclined surfaces 44*b* and 72*b* and the inclined surfaces 44*c* and 72*c* come into contact with each other in a state where the projecting strip section 44*a* of the upper rail 44 is fitted into the groove section 72*a* of the second pressed door roller 72, the second pressed door roller 72 comes into rolling contact with the upper rail 44. The second constant contact door roller 71 and the second pressed door roller 72 are coupled to the second linking mechanism 73.

The second linking mechanism 73 is provided as a movement conversion mechanism which converts a movement in which the driving-side member 21 and the hanger 26 are relatively displaced in the opening/closing direction X into a movement in which the second pressed door roller 72 is pressed against the upper rail 44.

The second linking mechanism 73 includes a second constant contact door roller supporting member 75, a first spindle 76*a*, a first linking member 77, a second spindle 78*a*, and a second linking member 79.

The second constant contact door roller supporting member 75 is configured so as to be relatively displaced with the hanger 26 as the elastic member 24 elastically deforms and is provided as a portion which supports the second constant contact door roller 71, which supports the first spindle 76*a*, and which is coupled to the second linking member 79 via the first linking member 77. The second constant contact door roller supporting member 75 is an example of "the door roller bracket" according to the present invention. In the present embodiment, the second constant contact door roller supporting member 75 is formed by combining two sheet-metal members. The second constant contact door roller supporting member 75 is formed in a U-shape in a bottom view (FIG. 14). In addition, the second constant contact door roller supporting member 75 is formed in a shape that is elongated in the opening/closing direction X in a front view. The second constant contact door roller supporting member 75 is formed in a same shape as the second linking member 59. Accordingly, versatility of the second constant contact door roller supporting member 75 and the second linking member 59 can be increased.

The second constant contact door roller supporting member 75 includes a pair of side walls 75*a* and 75*b* and an end wall 75*c*.

The pair of side walls 75*a* and 75*b* is a pair of plate-like portions extending in a direction perpendicular to the thickness direction Y. The respective side walls 75*a* and 75*b* are formed in a same shape. Bottom surfaces of the respective side walls 75*a* and 75*b* extend horizontally. Meanwhile, upper surfaces of the respective side walls 75*a* and 75*b* are formed in a shape having an undulation. Specifically, the upper surfaces of the respective side walls 75*a* and 75*b* extend horizontally from a door head-side end to an intermediate section of the upper surfaces in the opening/closing direction X.

In addition, the upper surfaces have a recessed surface 75*d* that is recessed downward at a midway section in the opening/closing direction X. Furthermore, a door tail-side end of the upper surfaces in the opening/closing direction X has a protruded surface 75*e* that protrudes upward. The recessed surface 75*d* and the protruded surface 75*e* are respectively formed in arc shapes in a front view and are mutually continuous. The door head-side ends of the pair of side walls 75*a* and 75*b* are made mutually continuous by the end wall 75*c*. The end wall 75*c* is formed by fixing ends of the two sheet-metal members to each other by welding or the like.

A through-hole 75*f* is formed in the door head-side portions of the respective side walls 75*a* and 75*b*. A cylindrical bush 80 is inserted into the through-hole 75*f*. An outer diameter of an intermediate section of the bush 80 is set larger than an outer diameter of both end sections of the bush 80. The intermediate section of the bush 80 is sandwiched by the side walls 75*a* and 75*b*. The bush 80 is fixed to one side wall 75*b* by welding or the like. The bush 80 supports the second constant contact door roller 71 via a bearing such as a ball bearing. Accordingly, the second constant contact door roller supporting member 75 supports the second constant contact door roller 71 via the bush 80 and the like so as to be rotatable and integrally displaceable.

In addition, an end of the bush 80 is arranged inside a guide hole section 264 formed on the hanger 26. A cylindrical collar 83 is fitted onto an end of the bush 80. The collar 83 is fixed to the bush 80 using a bolt 81. As will be described later, the collar 83 is fitted into the guide hole section 265 formed on the side wall section 94 of the hanger 26.

In addition, the second constant contact door roller supporting member 75 supports the first spindle 76*a*. The first spindle 76*a* is a shaft member that extends in the thickness direction Y and is provided as a shaft section of a bolt 76. The bolt 76 is a headed bolt. The bolt 76 penetrates through-holes (not shown) formed on the respective side walls 75*a* and 75*b* and supports the first linking member 77 via the bush and the like so as to be rotatable around the first spindle 76*a*. Accordingly, the second constant contact door roller supporting member 75 supports the first spindle 76*a*. A head 76*b* of the bolt 76 is arranged inside the guide hole section 264 formed on the hanger 26.

The first linking member 77 is provided as a member that is swingable around the first spindle 76*a* due to relative movements of the driving-side member 21 and the hanger 26 in the opening/closing direction X. The first linking member 57 and the first linking member 77 are members having the same shape which exemplify improved versatility of parts. More specifically, the first linking member 77 is a member formed in a block shape that extends in an elongated manner in a front view. As described earlier, the first spindle 76*a* is coupled to one end-side (a lower end-side) portion of the first linking member 77 and the first linking member 77 is supported by the second constant contact door roller supporting member 75 via the first spindle 76*a* and the like.

In the present embodiment, the first linking member 57 of the first linking mechanism 53 extends above the first spindle 56*a* of the first linking mechanism 53. In a similar manner, the first linking member 77 of the second linking mechanism 73 extends above the first spindle 76*a* of the second linking mechanism 73.

In addition, in a front view of the door suspension device 5A, the first linking members 57 and 77 of the respective linking mechanisms 53 and 73 extend inclined with respect to the vertical direction Z. Furthermore, the first linking member 57 of the first linking mechanism 53 and the first linking member 77 of the second linking mechanism 73 have inclines with opposite orientations with respect to the vertical direction Z. In the present embodiment, the first linking member 57 is arranged inclined so as to proceed toward the door tail side the further downward. On the other hand, the first linking member 77 is arranged inclined so as to proceed toward the door head side the further downward. The second spindle 78*a* is coupled to another end-side (an upper end-side) portion of the first linking member 77.

The second spindle 78*a* extends parallel to the first spindle 76*a* and is provided in order to couple the first linking member 77 and the second linking member 79 to each other so as to be relatively rotatable. The second spindle 78*a* is a shaft member that extends in the thickness direction Y and is provided as a shaft section of a bolt 78. The bolt 78 is a headed bolt. The bolt 78 (the second spindle 78*a*) penetrates a through-hole (not shown) formed on the second linking member 79 and supports the second linking member 79 via a bush and the like so as to be rotatable around the second spindle 78*a*. Accordingly, the second linking member 79 is swingable around the second spindle 78*a* with respect to the first linking member 77. In addition, the bolt 78 fixes the hanger 26 and a side wall 79*a* of the second linking member 79 to each other. Accordingly, the second spindle 78*a* and the second linking member 79 are integrally displaced with the hanger 26.

The second linking member 79 is coupled to the first linking member 77 and supports the second pressed door roller 72. In addition, the second linking member 79 is coupled to the driving-side member 21 via the first linking member 77, the second constant contact door roller supporting member 75, the coupling member 91, and the elastic member 24. In the present embodiment, the second linking member 79 is formed by combining two sheet-metal members. The second linking member 79 is formed in a U-shape in a bottom view (FIG. 14). In addition, the second linking member 79 is formed in a shape that is elongated in the opening/closing direction X in a front view. The second linking member 79 is formed in a same shape as the first constant contact door roller supporting member 55. Accordingly, versatility of the second linking member 79 and the first constant contact door roller supporting member 55 can be increased.

The second linking member 79 includes a pair of side walls 79*a* and 79*b* and an end wall 79*c*.

The pair of side walls 79*a* and 79*b* is a pair of plate-like portions extending in a direction perpendicular to the thickness direction Y. The respective side walls 79*a* and 79*b* are formed in a same shape. Upper surfaces of the respective side walls 79*a* and 79*b* extend horizontally. Meanwhile, bottom surfaces of the respective side walls 79*a* and 79*b* are formed in a shape having an undulation. Specifically, the lower surfaces of the respective side walls 79*a* and 79*b* extend horizontally from a door tail-side end to an intermediate section of the lower surfaces in the opening/closing direction X.

In addition, the lower surfaces have a recessed surface 79*d* that is recessed upward at a midway section in the opening/closing direction X. Furthermore, a door head-side end of the lower surfaces in the opening/closing direction X has a protruded surface 79*e* that protrudes downward. The recessed surface 79*d* and the protruded surface 79*e* are respectively formed in arc shapes in a front view and are mutually continuous.

Moreover, while a lower surface of the second linking member 79 and an upper surface of the second constant contact door roller supporting member 75 are arranged in a contactless state in the present embodiment, this arrangement is not restrictive. For example, the lower surface and the upper surface may be in contact with each other. In this case, the protruded surface 79*e* of the lower surface forms a cam mechanism by coming into contact with the protruded surface 75*e* of the upper surface. With the cam mechanism, a movement in which the second linking member 79 is displaced toward a door head side with respect to the second constant contact door roller supporting member 75 is to be converted into a movement in which the second linking member 79 is displaced upward.

The door tail-side ends of the pair of side walls 79*a* and 79*b* are made mutually continuous by the end wall 79*c*.

A through-hole 79*f* is formed in the door tail-side portions of the respective side walls 79*a* and 79*b*. A cylindrical bush 82 is inserted into the through-hole 79*f*. An outer diameter of an intermediate section of the bush 82 is set larger than an outer diameter of both end sections of the bush 82. The intermediate section of the bush 82 is sandwiched by the side walls 79*a* and 79*b*. The bush 82 is fixed to one side wall 79*b* by welding or the like. The bush 82 supports the second pressed door roller 72 via a bearing such as a ball bearing. Accordingly, the second linking member 79 supports the second pressed door roller 72 via the bush 82 and the like so as to be rotatable and integrally displaceable. In addition, the bush 82 penetrates a through-hole 266 formed on the hanger 26. A female screw section is formed on an inner peripheral surface of the bush 82 and the bush 82 is joined by screwing to a bolt 84. The second linking member 79 is fixed to the hanger 26 by the bolt 84 and the bush 82. Moreover, the bush 80 and the bush 82 are members with a same shape and exemplify improved versatility of parts.

Next, the coupling member 91 that couples the first subunit 41 and the second subunit 42 configured as described above to each other will be described more specifically.

With reference to FIGS. 3 and 4, the coupling member 91 couples the second linking member 59 of the first linking mechanism 53 and the second constant contact door roller supporting member 75 of the second linking mechanism 73 to each other so as to be integrally displaceable. In addition, the coupling member 91 is configured so as to be displaceable in the opening/closing direction X in conjunction with the hanger 26 and to be relatively displaceable in the opening/closing direction X with an elastic deformation of the elastic member 24.

The coupling member 91 is provided as a round shaft member that extends in the opening/closing direction X. One end of the coupling member 91 is fixed to the end wall 59*c* of the second linking member 59 of the first linking mechanism 53. Another end of the coupling member 91 is fixed to the end wall 75*c* of the second constant contact door roller supporting member 75 of the second linking mechanism 73.

In addition, the coupling member 91 couples the respective linking mechanisms 53 and 73 and the driving-side member 21 to each other. Specifically, a fitting hole section 31*a* extending in the opening/closing direction X is formed on the first member 31 of the driving-side member 21 and a fitting hole section 32*a* extending in the opening/closing direction X is formed on the second member 32 of the driving-side member 21. The coupling member 91 penetrates the fitting hole sections 31*a* and 32*a*.

A bush (not shown) is arranged at the fitting hole sections 31*a* and 32*a* and supports the coupling member 91. Accordingly, the coupling member 91 couples the first linking mechanisms 53 and 73 and the driving-side member 21 to each other so as to be relatively slidable in the opening/closing direction X and displaceable in conjunction with each other in a direction perpendicular to the opening/closing direction X. In addition, the elastic member 24 is fitted to the coupling member 91. The coupling member 91 is an example of "the spring guide member" according to the present invention and guides an extension/contraction operation of a coil spring as the elastic member 24.

The elastic member 24 is provided in order to allow relative displacements of the driving-side member 21 and the hanger 26 (the door 2A) in the opening/closing direction X by elastically deforming in accordance with a load in the opening/closing direction X which acts between the driving-side member 21 and the hanger 26. The elastic member 24 is a member that elastically deforms upon receiving a load in the opening/closing direction X and is a coil spring that extends in the opening/closing direction X in the present embodiment. The elastic member 24 is arranged near the door tail-side end of the coupling member 91.

The elastic member 24 is aligned in the opening/closing direction X with the driving-side member 21 and is also aligned in the opening/closing direction X with the respective linking mechanisms 53 and 73. A door head-side end of the elastic member 24 abuts on the second member 32 of the driving-side member 21. In addition, a door tail-side end of the elastic member 24 abuts on the end wall 75*c* of the second constant contact door roller supporting member 75 of the second linking mechanism 73. When the door 2 is stationary, the elastic member 24 is compressed between the driving-side member 21 and the second constant contact door roller supporting member 75 and imparts an elastic repulsive force (an initial set load) to the driving-side member 21 and the second constant contact door roller supporting member 75. Accordingly, the first member 31 of the driving-side member 21 is pressed against the end wall 59*c* of the second linking member 59 of the first linking mechanism 53.

According to the configuration described above, the driving-side member 21 is coupled to the coupling member 91 and the respective linking mechanisms 53 and 73 via the elastic member 24 so as to be integrally displaceable in the opening/closing direction X. In addition, the driving-side member 21 is configured so as to couple the driving-side member 21 and the second linking member 59 to each other so as to be relatively displaceable in the opening/closing direction X with an elastic deformation of the elastic member 24. In other words, the coupling member 91 cooperates with the elastic member 24 to displaceably couple the respective linking mechanisms 53 and 73 and the driving-side member 21 in conjunction with each other. Furthermore, the coupling member 91 couples the driving-side member 21 and the second linking member 59 to each other so as to be relatively displaceable in the opening/closing direction X with an elastic deformation of the elastic member 24.

With reference to FIGS. 7 and 8, in the present embodiment, a central axial line L1 of the elastic member 24 and a central axial line L2 of the first adjustment bolt 38 of the dynamic adjustment mechanism 23 are mutually offset. Specifically, the central axial line L1 is positioned above the central axial line L2 on one side (a distal side of a paper plane in FIG. 7) in the thickness direction Y. In addition, the central axial line L1 of the elastic member 24 and a central axial line L3 of the second adjustment bolt 35 of the static adjustment mechanism 22 are mutually offset. Specifically, the central axial line L1 is positioned below the central axial line L3 on one side in the thickness direction Y. The hanger 26 is arranged at a position adjacent to the elastic member 24.

Figure 17:
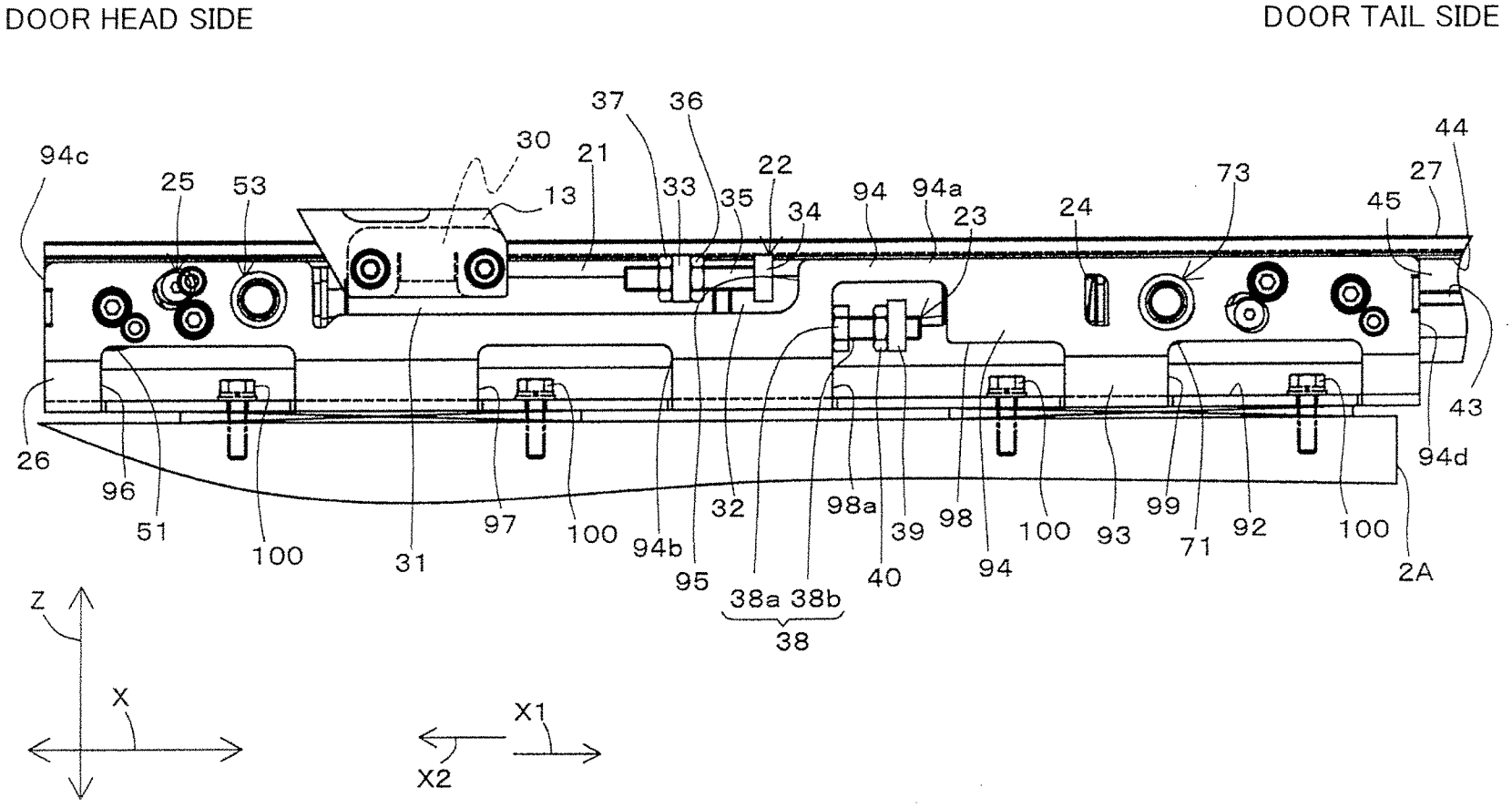
FIG. 17 is an enlarged view showing the configuration shown in FIG. 1 partially broken away.

FIG. 17 is an enlarged view showing the configuration shown in FIG. 1 partially broken away. With reference to FIGS. 3, 7, 8, 12, and 17, the hanger 26 is configured so as to be displaceable in the opening/closing direction X in conjunction with a displacement of the driving-side member 21 and is provided as a portion that supports the door 2. The hanger 26 is fixed to the door 2, fixed to the first constant contact door roller supporting member 55 of the first linking mechanism 53, and fixed to the second linking member 79 of the second linking mechanism 73. In addition, the hanger 26 is received by the first adjustment bolt 38 of the dynamic adjustment mechanism 23. Hereinafter, the configuration of the hanger 26 will be described more specifically.

The hanger 26 is formed in an approximate L-shape when viewed along the opening/closing direction X and includes a portion arranged adjacent to the respective linking mechanisms 53 and 73 and a portion arranged below the respective linking mechanisms 53 and 73 in the thickness direction Y. The hanger 26 is a sheet-metal member. In other words, the hanger 26 is formed using a metal plate which has been subjected to a cutting process and a bending process and which extends in the opening/closing direction X. In the opening/closing direction X, the hanger 26 extends to a door head-side end to a door tail-side end of the door suspension device 5A.

The hanger 26 includes a door fixing section 92, an inclined section 93, and a side wall section 94.

The door fixing section 92 is arranged so that a thickness direction of the door fixing section 92 coincides with the vertical direction Z and is a portion that is elongated in the opening/closing direction X. The door fixing section 92 is arranged below the lower rail 43. The door 2 is fixed to the door fixing section 92 using a fixing member 100 that is a screw member or the like. Accordingly, the hanger 26 is integrally displaced with the door 2. The door fixing section 92 is continuous to the side wall section 94 via the inclined section 93. The inclined section 93 extends diagonally upward from below the projecting strip section 43*a* of the lower rail 43 and is connected to a lower end of the side wall section 94.

The side wall section 94 is arranged adjacent to the respective linking mechanisms 53 and 73 in the thickness direction Y. The side wall section 94 is a vertically-arranged flat plate-like portion which is arranged approximately parallel to the coupling member 91. An upper end 94*a* of the side wall section 94 is arranged so that a height position thereof in the vertical direction Z is approximately the same as that of the seat 30 of the driving-side member 21. A lower end 94*b* of the side wall section 94 is arranged so that a height position thereof in the vertical direction Z is approximately the same as those of the lower ends of the respective constant contact door rollers 51 and 71. A door head-side end 94*c* of the side wall section 94 is adjacent to the door head-side end of the first constant contact door roller supporting member 55 of the first linking mechanism 53. In addition, a door tail-side end 94*d* of the side wall section 94 is adjacent to the door head-side end of the second linking member 79 of the second linking mechanism 73.

A plurality of notched sections 95 to 99 are formed on the hanger 26.

The notched section 95 is formed at an intermediate section in the opening/closing direction X in an upper end-side portion of the side wall section 94 of the hanger 26. The notched section 95 is formed so as to extend downward from the upper end 94*a* of the side wall section 94 and forms a rectangular space. In a front view, the seat 30 of the driving-side member 21 and the static adjustment mechanism 22 are exposed through the notched section 95. Accordingly, through the notched section 95, a worker can reach the respective nuts 36 and 37 of the driving-side member 21 and the static adjustment mechanism 22 with a tool and perform an operation for fixing the lower coupling stay 13 and the seat 30 to each other, an adjustment operation by the static adjustment mechanism 22, and the like.

The notched section 96 is formed from the lower end 94*b* of the side wall section 94 to the inclined section 93 in a vicinity of the door head-side end of the hanger 26. The notched section 96 is positioned below the first linking mechanism 53. The notched section 96 extends upward from the lower end of the hanger 26. In a front view, the fixing member 100 that fixes the hanger 26 and the door 2A to each other is exposed through the notched section 96. Accordingly, through the notched section 96, a worker can reach the fixing member 100 with a tool and perform an operation for fixing the door 2 to the hanger 26. The notched section 97 is formed at a location adjacent to the notched section 96 on the door tail side.

The notched section 97 is formed from the lower end 94*b* of the side wall section 94 to the inclined section 93. The notched section 97 is positioned below the seat 30 and the second adjustment bolt 35. The notched section 97 extends upward from the lower end of the hanger 26. In a front view, the fixing member 100 that fixes the hanger 26 and the door 2A to each other is exposed through the notched section 97. Accordingly, through the notched section 97, a worker can reach the fixing member 100 with a tool and perform an operation for fixing the door 2 to the hanger 26. The notched section 98 is formed at a location adjacent to the notched section 97 on the door tail side.

The notched section 98 is formed from the lower end 94*b* of the side wall section 94 to the inclined section 93. The notched section 98 is formed at a position overlapping with the dynamic adjustment mechanism 23 in the thickness direction Y. The notched section 98 extends upward from the lower end of the hanger 26. In the present embodiment, the notched section 98 is formed in an L-shape in a front view. In a front view, the dynamic adjustment mechanism 23 as well as the fixing member 100 that fixes the hanger 26 and the door 2 to each other are exposed through the notched section 98.

More specifically, positions in the thickness direction Y of the first adjustment bolt 38, the fixing nut 39, and the lock nut 40 of the dynamic adjustment mechanism 23 and the side wall section 94 are aligned. The edge 98*a* of a door head-side end of the notched section 98 extends in the vertical direction Z, opposes the head 38*a* of the first adjustment bolt 38 in the opening/closing direction X, and receives the head 38*a*.

The edge 98*a* is an example of "the prescribed section of the hanger" according to the present invention. In addition, the head 38*a* of the first adjustment bolt 38 is an example of "the received section" according to the present invention. Furthermore, "the head 38*a* arranged so that an axial force acting on the first adjustment bolt 38 is receivable by the edge 98*a* of the hanger 26" according to the present embodiment is an example of "the received section arranged so that an axial force acting on the adjustment bolt is receivable by the prescribed section of the hanger" according to the present invention.

Due to the configuration described above, through the notched section 98, a worker can reach the first adjustment bolt 38 and the lock nut 40 with a tool and perform a position adjustment operation of the first adjustment bolt 38 (an adjustment operation of the initial set load). In addition, through the notched section 98, a worker can reach the fixing member 100 with a tool and perform an operation for fixing the door 2 to the hanger 26. The notched section 99 is formed at a location adjacent to the notched section 97 on the door tail side.

The notched section 99 is formed from the lower end 94*b* of the side wall section 94 to the inclined section 93 in a vicinity of the door tail-side end of the hanger 26. The notched section 99 is positioned below the second linking mechanism 73. The notched section 99 extends upward from the lower end of the hanger 26. In a front view, the fixing member 100 that fixes the hanger 26 and the door 2A to each other is exposed through the notched section 99. Accordingly, through the notched section 99, a worker can reach the fixing member 100 with a tool and perform an operation for fixing the door 2 to the hanger 26.

In addition, the hanger 26 (the door 2) is coupled to the first constant contact door roller supporting member 55 of the first linking mechanism 53, the first constant contact door roller 51, the second linking member 79 of the second linking mechanism 73, and the second pressed door roller 72 so as to be integrally displaceable. Meanwhile, as shown in FIGS. 3 and 5, the hanger 26 (the door 2) is configured so as to be relatively displaceable with the second linking member 59 of the first linking mechanism 53, the first pressed door roller 52, the second constant contact door roller supporting member 75 of the second linking mechanism 73, and the second constant contact door roller 71 due to an elastic deformation of the elastic member 24. This configuration will now be described more specifically.

With reference to FIGS. 5, 9, 11, and 14, as described earlier, regarding the first constant contact door roller 51 of the first linking mechanism 53, the bolt 61 and the bush 60 penetrate the through-hole 261 of the side wall section 94 and the hanger 26 is fixed to the first constant contact door roller supporting member 55 by the bolt 61 and the bush 60. In addition, the bolt 56 including the first spindle 56*a* that supports the first linking member 57 fixes the hanger 26 and the first constant contact door roller supporting member 55 to each other.

Furthermore, regarding the second pressed door roller 72 of the second linking mechanism 73, the bolt 84 and the bush 82 penetrate the through-hole 266 of the side wall section 94 of the hanger 26 and the hanger 26 is fixed to the second linking member 59 by the bolt 84 and the bush 82. In addition, the bolt 78 including the second spindle 78*a* fixes the hanger 26 and the second linking member 79 to each other.

Meanwhile, in relation to the second linking member 59 of the first linking mechanism 53, two guide hole sections 262 and 263 are formed on the side wall section 94. The guide hole section 262 is provided in order to guide a swinging displacement of the second spindle 58*a* (the second linking member 59) around the first spindle 56*a*. The guide hole section 262 is arranged so as to oppose the second spindle 58*a* in the thickness direction Y. The guide hole section 262 is formed in a long hole-shape that extends around the first spindle 56*a* in a front view. The head 58*b* of the bolt 58 is arranged in the guide hole section 262. The head 58*b* and the second linking member 59 are displaceable in a direction in which the guide hole section 262 extends (around the first spindle 56*a*) with respect to the side wall section 94 (the door 2).

The guide hole section 263 is arranged so as to oppose, in the thickness direction Y, the bolt 64 that supports the first pressed door roller 52. The guide hole section 263 is a hole section that extends approximately parallel to the guide hole section 262 in a front view. The collar 63 fitted to the bolt 64 is inserted into the guide hole section 263. The collar 63 and the second linking member 59 are displaceable in a direction in which the guide hole section 263 extends with respect to the side wall section 94 of the hanger 26 (the door 2).

In addition, in relation to the second linking member 79 of the second linking mechanism 73, two guide hole sections 264 and 265 are formed on the side wall section 94. The guide hole section 264 is provided in order to guide a swinging displacement of the first spindle 76*a* (the second constant contact door roller supporting member 75) around the second spindle 78*a*. The guide hole section 264 is arranged so as to oppose the first spindle 76*a* in the thickness direction Y. The guide hole section 264 is formed in a long hole-shape that extends around the second spindle 78*a* in a front view. The head 76*b* of the bolt 76 is inserted into the guide hole section 264. The head 76*b* and the second constant contact door roller supporting member 75 are displaceable in a direction in which the guide hole section 264 extends (around the second spindle 78*a*) with respect to the side wall section 94 of the hanger 26 (the door 2).

The guide hole section 265 is arranged so as to oppose, in the thickness direction Y, the bolt 81 that supports the second pressed door roller 72. The guide hole section 265 is a hole section that extends approximately parallel to the guide hole section 264 in a front view. The collar 83 fitted to the bolt 81 is inserted into the guide hole section 265. The collar 83 and the second constant contact door roller supporting member 75 are displaceable in a direction in which the guide hole section 265 extends with respect to the side wall section 94 of the hanger 26 (the door 2A).

This concludes the description of a schematic configuration of the door suspension device 5.

Next, operations by the door suspension device 5A will be described. Specifically, (1) an adjustment operation of the initial set load, (2) a position adjustment operation of the door 2A with respect to the opening/closing drive mechanism 6, (3) an operation when the door 2A closes, (4) an operation when the door 2A opens smoothly, and (5) an operation when a large resistance acts on the door 2A when the door 2A opens (a door bouncing prevention operation) will be described.

Next, the adjustment operation of the initial set load denoted by (1) above will be described. With reference to FIGS. 3 and 17, in this adjustment operation, a worker adjusts a position of the first adjustment bolt 38 with respect to the fixing nut 39 that is fixed to the second member 32 of the driving-side member 21 by turning the first adjustment bolt 38. Accordingly, the hanger 26 that is pressed against the head 38*a* of the first adjustment bolt 38 toward the door head side by an elastic repulsive force of the elastic member 24 is integrally displaced in the opening/closing direction X with the first adjustment bolt 38. In addition, the elastic member 24 is sandwiched between the second member 32 of the driving-side member 21 and the end wall 75*c* of the second constant contact door roller supporting member 75 of the second linking mechanism 73. Therefore, with an extension/contraction of the elastic member 24, a distance between the second member 32 of the driving-side member 21 and the second constant contact door roller supporting member 75 of the second linking mechanism 73 changes. An amount of compression of the elastic member 24 or, in other words, the initial set load is determined in accordance with this distance.

In the position adjustment operation of the door 2A with respect to the opening/closing drive mechanism 6 denoted by (2) above, a worker displaces a position of the second member 32 of the driving-side member 21 with respect to the first member 31 by adjusting positions of the two nuts 36 and 37 with respect to the second adjustment bolt 35. Accordingly, the second member 32, the dynamic adjustment mechanism 23, and the hanger 26 (the door 2A) and the door roller unit 25 which receive the first adjustment bolt 38 of the dynamic adjustment mechanism 23 are displaced in the opening/closing direction X with respect to the first member 31 (the opening/closing drive mechanism 6).

Figure 18:
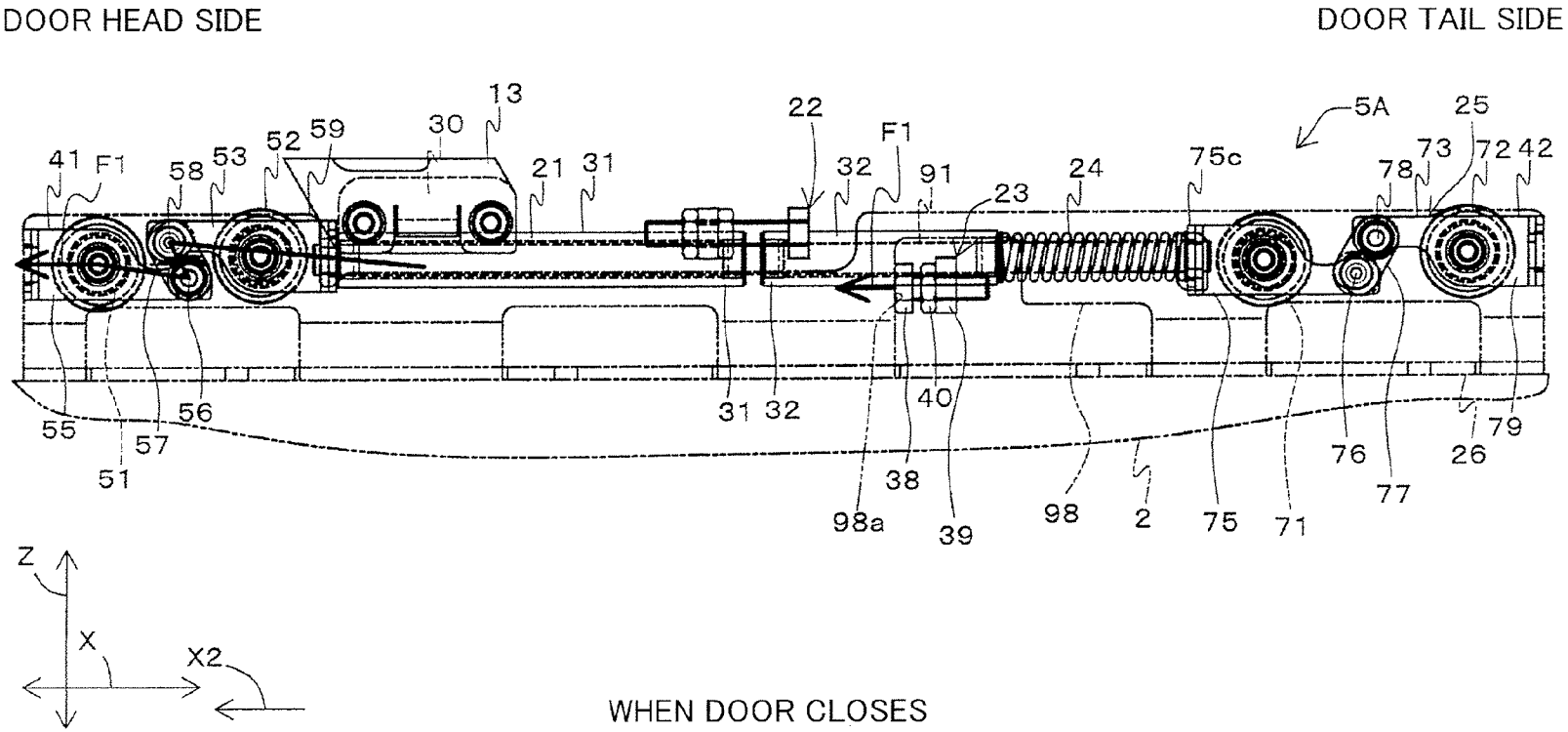
FIG. 18 is a diagram for explaining an operation of a door suspension device.

Next, (3) an operation when the door 2A closes will be described. As shown in FIG. 18, when the door 2A is displaced in the closing direction X2 due to an operation of the opening/closing drive mechanism 6, a drive force F1 from the lower coupling stay 13 of the opening/closing drive mechanism 6 is input to the driving-side member 21. The drive force F1 received by the driving-side member 21 is transferred to the hanger 26 and the door 2 via the second linking member 59, the first linking member 57, the first constant contact door roller supporting member 55, and the like of the first linking mechanism 53. In addition, the drive force F1 is transferred from the second member 32 of the driving-side member 21 to the edge 98*a* of the hanger 26 (the door 2) via the fixing nut 39 and the first adjustment bolt 38 of the dynamic adjustment mechanism 23. Accordingly, the door 2 is integrally displaced in the closing direction X2 with the driving-side member 21.

Figure 19:
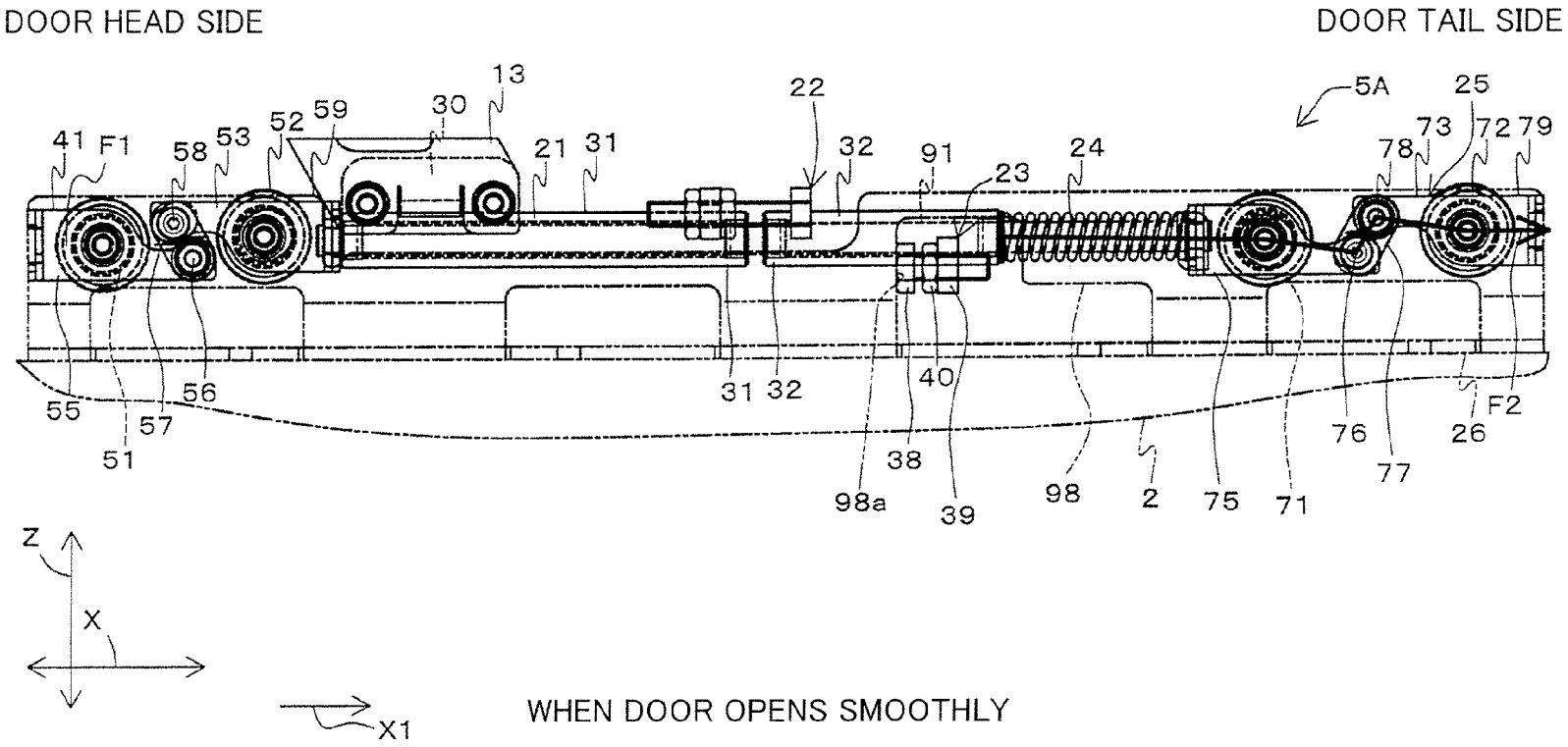
FIG. 19 is a diagram for explaining an operation of a door suspension device.

Next, (4) an operation when the door 2 opens smoothly will be described. As shown in FIG. 19, when the door 2 is displaced in the opening direction X1 due to an operation of the opening/closing drive mechanism 6, a drive force F2 from the lower coupling stay 13 of the opening/closing drive mechanism 6 is input to the driving-side member 21. The drive force F2 input to the driving-side member 21 is transferred to the hanger 26 and the door 2 via the elastic member 24 as well as the second constant contact door roller supporting member 75, the first linking member 77, the second linking member 79, and the like of the second linking mechanism 73. Accordingly, the door 2 is integrally displaced in the closing direction X2 with the driving-side member 21.

Figure 20:
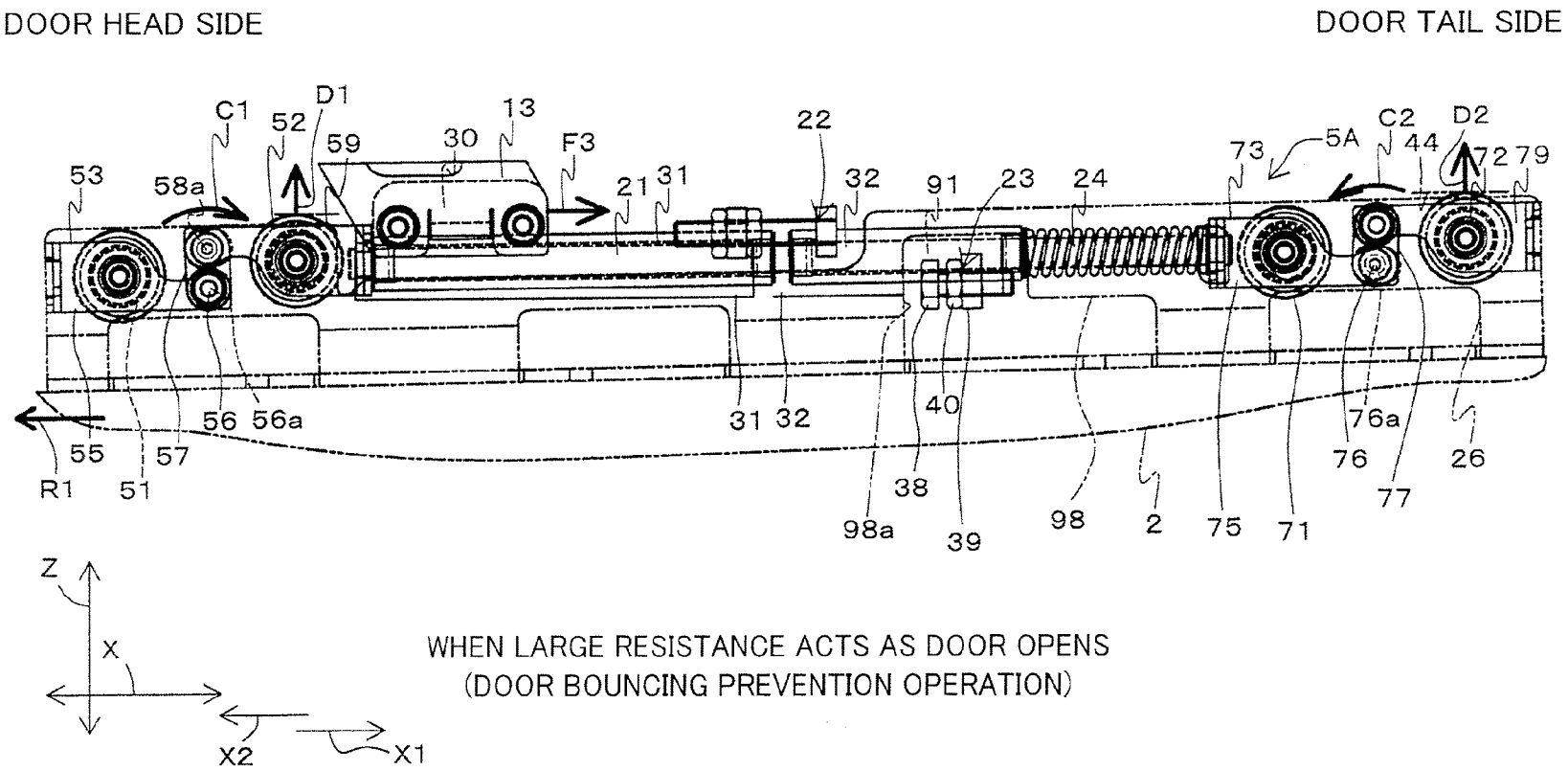
FIG. 20 is a diagram for explaining an operation of a door suspension device.

On the other hand, (5) when a large resistance acts on the door 2 when the door 2 opens such as when a passenger is leaning against the door with a strong force, the door suspension device 5A operates as shown in FIG. 20. Specifically, when a resistive force R1 large enough to stop the door 2 is acting on the door 2, by a drive force F3 from the lower coupling stay 13 of the opening/closing drive mechanism 6, the elastic member 24 is compressed between the driving-side member 21 and the second constant contact door roller supporting member 75 and the driving-side member 21 is displaced toward the door tail side with respect to the hanger 26. Accordingly, movable units or, in other words, an upper part of the first linking member 57, the second spindle 58*a*, the second linking member 59, the second pressed door roller 72, the coupling member 91, the second constant contact door roller supporting member 75 of the second linking mechanism 73, the second constant contact door roller 71, the first spindle 76*a*, and a lower part of the first linking member 77 are displaced in the closing direction X2 with respect to the first constant contact door roller supporting member 55 and the second linking member 79.

As a result, at the first linking mechanism 53, the first linking member 57 swings around the first spindle 56*a* as indicated by an arrow C1 and the second linking member 59 and the first pressed door roller 52 are displaced toward the side of the upper rail 44. Accordingly, the first pressed door roller 52 is pressed against the upper rail 44. In addition, at the second linking mechanism 73, in accordance with a displacement of the second constant contact door roller supporting member 75 toward the side of the opening direction X1, the first linking member 77 swings around the first spindle 76*a* as indicated by an arrow C2 and the second linking member 79 and the second pressed door roller 72 are displaced toward the side of the upper rail 44. Accordingly, the second pressed door roller 72 is pressed against the upper rail 44.

As described above, due to the respective pressed door rollers 52 and 72 being pressed against the upper rail 44 as indicated by arrows D1 and D2, door bouncing (a wobbling movement of the door 2 in the vertical direction Z) is suppressed. Moreover, the operation in which the respective pressed door rollers 52 and 72 are pressed against the upper rail 44 as indicated by arrows D1 and D2 is only performed for an instant. After the resistance acting on the door 2 is released, the respective pressed door rollers 52 and 72 are restored to their original positions (downward) by an opposite operation to that described above.

As described above, with the door suspension device 5 according to the present embodiment, since the first adjustment bolt 38 of the dynamic adjustment mechanism 23 is received by the edge 98*a* of the hanger 26, a position adjustment operation of the hanger 26 is not required. Therefore, a configuration of the door suspension device 5 can be simplified. In addition, since a rotation prevention measure need not be applied to the hanger 26 even when the lock nut 40 is provided on the first adjustment bolt 38, the number of nuts can be reduced. Therefore, a configuration of the door suspension device 5 can be simplified.

In addition, according to the door suspension device 5, the first adjustment bolt 38 is brought into contact with the hanger 26. Therefore, when setting a load (a threshold) at which the linking mechanisms 53 and 73 start an operation of pressing the respective pressed door rollers 52 and 72 against the upper rail 44, an operation of adjusting a position of the first adjustment bolt 38 with respect to the hanger 26 is not required. As a result, the threshold can be readily set.

Furthermore, according to the door suspension device 5, since the first adjustment bolt 38 can be directly joined by screwing (screwed) to the fixing nut 39 that is integrally provided with the driving-side member 21, the configuration of the door suspension device 5 can be simplified.

In addition, according to the door suspension device 5, the central axial line L1 of the elastic member 24 and the central axial line L2 of the first adjustment bolt 38 are mutually offset. According to this configuration, since the first adjustment bolt 38 is not configured so as to penetrate the elastic member 24, the first adjustment bolt 38 can be shortened. Since the first adjustment bolt 38 can be shortened, a bending force acting on the first adjustment bolt 38 can be reduced and a load on the first adjustment bolt 38 can be reduced. In addition, the first adjustment bolt 38 and the elastic member 24 need not be coaxially arranged. Therefore, degrees of freedom of respective layouts of the first adjustment bolt 38 and the elastic member 24 can be increased.

Furthermore, according to the door suspension device 5, the driving-side member 21 and the elastic member 24 are arranged to be aligned in the opening/closing direction X. According to this configuration, a load from the driving-side member 21 can be more directly transferred to the elastic member 24. Accordingly, a configuration for transferring the load of the driving-side member 21 to the elastic member 24 can be simplified.

In addition, according to the door suspension device 5, the coupling member 91 for guiding an extension/contraction operation of the elastic member 24 is provided separately from the first adjustment bolt 38. As a result, the first adjustment bolt 38 need not be used as a spring guiding member. Therefore, buckling of the elastic member 24 (a coil spring) can be prevented without making the first adjustment bolt 38 longer. Moreover, in the configuration described in the publication of WO2012/157492, the coil spring rubs against the male screw section of the coupling shaft member and becomes scratched. However, according to the door suspension device 5, a male screw groove need not be formed on an outer peripheral section of the coupling member 91. Accordingly, scratching of the elastic member 24 (the coil spring) can be suppressed.

Furthermore, according to the door suspension device 5, the coupling member 91 as a spring guiding member is configured so as to be displaceable in the opening/closing direction X in conjunction with the hanger 26. Accordingly, during relative displacements of the hanger 26 and the driving-side member 21, the coupling member 91 can guide the elastic member 24 so that the elastic member 24 reliably elastically deforms. As a result, the hanger 26 and the driving-side member 21 can be relatively displaced as intended by a designer.

In addition, according to the door suspension device 5, the second linking member 59 and the second constant contact door roller supporting member 75 are provided as door roller brackets that support the door rollers 52 and 71 capable of coming into contact with the rails 43 and 44, and the coupling member 91 as a spring guiding member is fixed to the second linking member 59 and the second constant contact door roller supporting member 75. According to this configuration, a spring guiding member capable of guiding a direction of elastic deformation of the elastic member 24 can be realized by the coupling member 91 with a simple configuration of fixing the coupling member 91 to the second linking member 59 and the second constant contact door roller supporting member 75.

Furthermore, according to the door suspension device 5, the coupling member 91 couples the second linking member 79 and the second constant contact door roller supporting member 75 to each other. According to this configuration, the coupling member 91 can also be used as a coupling member that couples a pair of door roller brackets to each other. As a result, a configuration of the door suspension device 5 can be simplified.

In addition, according to the door suspension device 5, the head 38*a* of the first adjustment bolt 38 is received by the edge 98*a* of the notched section 98 of the hanger 26. According to this configuration, a configuration for receiving the head 38*a* of the first adjustment bolt 38 can be realized with a simple configuration of forming the notched section 98 on the hanger 26. In addition, since the first adjustment bolt 38 can be arranged in the notched section 98, the door suspension device 5 can be made more compact.

Furthermore, according to the door suspension device 5, the hanger 26 is formed using a metal plate which has been subjected to a cutting process and a bending process and which extends in the opening/closing direction X, and the edge 98*a* of the notched section 98 and the first adjustment bolt 38 oppose each other in the opening/closing direction X. According to this configuration, the first adjustment bolt 38 and the hanger 26 can be joined to each other with a simple configuration of arranging the edge 98*a* of the notched section 98 and the first adjustment bolt 38 so as to oppose each other in the opening/closing direction X.

In addition, according to the door suspension device 5, the head 38*a* of the first adjustment bolt 38 as the received section is received by the edge 98*a* of the notched section 98 of the hanger 26. According to this configuration, a shape of a portion that is received by the hanger 26 of the first adjustment bolt 38 can be enlarged. As a result, the hanger 26 can receive the first adjustment bolt 38 in a more stable posture. In particular, when a large force oriented in the closing direction X2 acts between the driving-side member 21 and the hanger 26, the hanger 26 can receive the first adjustment bolt 38 in a more stable posture.

Furthermore, according to the door suspension device 5, the static adjustment mechanism 22 is provided for adjusting a position of the hanger 26 with respect to the opening/closing drive mechanism 6 in the opening/closing direction X. According to this configuration, a configuration for adjusting an initial value of a load that acts between the driving-side member 21 and the hanger 26 (the dynamic adjustment mechanism 23 including the first adjustment bolt 38) and a position adjustment mechanism (the static adjustment mechanism 22) for adjusting a position of the hanger 26 with respect to the opening/closing drive mechanism 6 are separately provided. Accordingly, for example, a position of the door 2 can be finely adjusted even when a position adjustment of the door 2 cannot be performed by a locking mechanism (not shown) which locks the door 2 when the door 2 is fully closed. In addition, a position of the hanger 26 (the door 2) with respect to the opening/closing drive mechanism 6 can be finely adjusted without being influenced by an amount of elastic deformation of the elastic member 24.

In addition, according to the door suspension device 5, the static adjustment mechanism 22 is capable of adjusting relative positions of the first member 31 and the second member 32 in the opening/closing direction X. According to this configuration, a position of the hanger 26 with respect to the opening/closing drive mechanism 6 can be adjusted with a simple configuration in which the first member 31 and the second member 32 of the driving-side member 21 are relatively displaced in the opening/closing direction.

Furthermore, according to the door suspension device 5, the second adjustment bolt 35 of the static adjustment mechanism 22 is joined to at least one of the first receiving section 33 and the second receiving section 34 using screw joining. According to this configuration, a position of the hanger 26 with respect to the opening/closing drive mechanism 6 can be adjusted by rotating the second adjustment bolt 35 with respect to the driving-side member 21.

In addition, according to the door suspension device 5, the second adjustment bolt 35 is fixed to the second receiving section 34 as one of the first receiving section 33 and the second receiving section 34 and inserted into the through-hole section 33*a* formed on the first receiving section 33 as the other of the first receiving section 33 and the second receiving section 34, and the pair of nuts 36 and 37 which is arranged so as to sandwich the through-hole section 33*a* and which is joined by screwing to the second adjustment bolt 35 is further provided. According to this configuration, a position of the hanger 26 with respect to the opening/closing drive mechanism 6 can be adjusted by adjusting a position of the pair of nuts 36 and 37 with respect to the second adjustment bolt 35. The number of nuts necessary for position adjustment of the hanger 26 with respect to the opening/closing drive mechanism 6 may be two.

Furthermore, according to the door suspension device 5, a position of the first adjustment bolt 38 and a position of the second adjustment bolt 35 are offset from each other in at least one (in the present embodiment, both) of the vertical direction Z and the opening/closing direction X. According to this configuration, when performing a position adjustment operation using one of the adjustment bolts, the other adjustment bolt is prevented from becoming an obstacle. Therefore, an adjustment operation using the adjustment bolts 35 and 38 may be performed more easily.

In addition, according to the door suspension device 5, the position of the second adjustment bolt 35 is set higher than the position of the first adjustment bolt 38 in the vertical direction Z. According to this configuration, as a result of arranging the second adjustment bolt 35 further upward, a space for handling a tool for manipulating the second adjustment bolt 35 need not be provided below the hanger 26. As a result, since the notched section 95 of the hanger 26 can be made smaller, the strength of the hanger 26 can be increased.

Furthermore, according to the door suspension device 5, a direction in which the first adjustment bolt 38 extends from the edge 98*a* of the hanger 26 and a direction in which the second adjustment bolt 35 extends from the driving-side member 21 are set to opposite directions. According to this configuration, the first adjustment bolt 38 and the second adjustment bolt 35 are to extend in mutually opposite directions. Accordingly, when performing a position adjustment operation using one of the adjustment bolts, the other adjustment bolt is prevented from becoming an obstacle. Therefore, an adjustment operation using the adjustment bolts 35 and 38 may be performed more easily.

In addition, according to the door suspension device 5, when the driving-side member 21 and the hanger 26 are relatively displaced in the opening/closing direction X against an elastic repulsive force of the elastic member 24, the respective linking mechanisms 53 and 73 displace the pressed door rollers 52 and 72 so as to press the pressed door rollers against the upper rail. Therefore, in a state where the driving-side member 21 and the hanger 26 are kept at constant relative positions by the elastic member 24, the respective pressed door rollers 52 and 72 may be substantially arranged so as not to be pressed against any of the rails 43 and 44. Accordingly, when a worker inserts the respective pressed door rollers 52 and 72 between the pair of rails 43 and 44, the respective pressed door rollers 52 and 72 are inserted between the pair of rails 43 and 44 without being pressed by the worker. As a result, an operation of inserting the respective pressed door rollers 52 and 72 between the pair of rails 43 and 44 can be performed more readily. In other words, with the door suspension device 5 configured to be capable of displacing the respective pressed door rollers 52 and 72 so as to move closer and move away from the upper rail 44, the door suspension device 5 can be assembled to the rails more readily.

Furthermore, according to the door suspension device 5, the first linking mechanism 53 for operating the first pressed door roller 52 and the second linking mechanism 73 for operating the second pressed door roller 72 are provided as movement conversion mechanisms. In addition, the linking mechanisms 53 and 73 include the first spindles 56*a* and 76*a*, the first linking members 57 and 77 which are swingable around the corresponding first spindles 56*a* and 76*a* with relative movements of the driving-side member 21 and the hanger 26 in the opening/closing direction X, and the second linking members 59 and 79 which are coupled to the first linking members 57 and 77 and which support the corresponding first pressed door roller 52 and the corresponding second pressed door roller 72. According to this configuration, the linking mechanisms 53 and 73 are provided as mechanisms for displacing the pressed door rollers 52 and 72. When a cam mechanism is used as a mechanism for displacing the pressed door rollers 52 and 72, the pressed door rollers 52 and 72 may possibly perform unintended operations due to slippage of a cam member of the cam mechanism or the like. In contrast, with a configuration using the respective linking mechanisms 53 and 73, trajectories of movements of the respective pressed door rollers 52 and 72 can be reliably defined. As a result, the respective pressed door rollers 52 and 72 can be more reliably controlled to perform intended operations at each point between a start of operation to an end of operation of the respective linking mechanisms 53 and 73. More specifically, with the swinging of the respective first linking members 57 and 77 around the corresponding first spindles 56*a* and 76*a*, the pressed door rollers 52 and 72 which are coupled to the corresponding second linking members 59 and 79 can be more reliably controlled to perform intended operations.

In addition, according to the door suspension device 5, the respective linking mechanisms 53 and 73 include the second spindles 58*a* and 78*a* which extend parallel to the first spindles 56*a* and 76*a* and which couple the first linking members 57 and 77 and the second linking members to each other so as to be relatively rotatable. According to this configuration, the respective linking mechanisms 53 and 73 include the second spindles 58*a* and 78*a*. In addition, according to this configuration, the respective second linking members 59 and 79 are swingable around the corresponding second spindles 58*a* and 78*a*. Therefore, the respective second linking members 59 and 79 are swingable around the corresponding first spindles 56*a* and 76*a* and the corresponding second spindles 58*a* and 78*a* in a state where excessive swinging around the corresponding first spindles 56*a* and 76*a* is suppressed. Accordingly, a force applied when the respective pressed door rollers 52 and 72 are pressed against the upper rail 44 can be set to an appropriate value.

Furthermore, according to the door suspension device 5, the hanger 26 includes the guide hole section 262 which guides a swinging displacement of the second spindle 58*a* around the first spindle 56*a* in the first linking mechanism 53 and the guide hole section 264 which guides a swinging displacement of the first spindle 56*a* around the second spindle 58*a* in the second linking mechanism 73. According to this configuration, since the guide hole sections 262 and 264 are provided in correspondence to the respective linking mechanisms 53 and 73, the respective second linking members 59 and 79 can be more reliably controlled to perform movements intended by a designer.

In addition, according to the door suspension device 5, the respective guide hole sections 262 and 264 are formed in the hanger 26 and extend around corresponding spindles 76*a* and 78*a*. Due to the respective guide hole sections 262 and 264, displacements of the respective second linking members 59 and 79 around the corresponding first spindles 56*a* and 76*a* can be guided.

Furthermore, according to the door suspension device 5, the coupling member 91 for coupling the first linking mechanism 53, the second linking mechanism 73, and the driving-side member 21 to each other is configured so as to couple the respective linking mechanisms 53 and 73 and the driving-side member 21 to each other so as to be integrally displaceable and to swing the respective second linking members 59 and 79 around the corresponding first spindles 56*a* and 76*a* with an elastic deformation of the elastic member 24. According to this configuration, due to the coupling member 91, relative displacements of the driving-side member 21 and the hanger 26 can be more reliably transferred to the respective second linking members 59 and 79. Therefore, the respective linking mechanisms 53 and 73 can more reliably perform operations for pressing the respective pressed door rollers 52 and 72 against the upper rail 44. In addition, the respective linking mechanisms 53 and 73 are coupled to each other by the coupling member 91. Accordingly, the respective linking mechanisms 53 and 73 can perform cooperative operations. Furthermore, accordingly, the first pressed door roller 52 and the second pressed door roller 72 can be brought into contact with the upper rail 44 at more synchronized timings. As a result, the door suspension device 5 can support the door 2 in a more stable posture.

In addition, according to the door suspension device 5, the coupling member 91 is inserted into the fitting hole sections 31*a* and 32*a* formed on the driving-side member 21 and is slidable in the opening/closing direction X with respect to the fitting hole sections 31*a* and 32*a*. Moreover, the second linking member 59 of the first linking mechanism 53 is connected to one end of the coupling member 91 and the second constant contact door roller supporting member 75 of the second linking mechanism 73 is connected to another end of the coupling member 91. According to this configuration, during an elastic deformation of the elastic member 24, the coupling member 91 and the driving-side member 21 can be relatively displaced in the opening/closing direction X in a smooth manner.

Furthermore, according to the door suspension device 5, the first constant contact door roller supporting member 55 which supports the first constant contact door roller 51 that is in constant contact with the lower rail 43 and which supports the first spindle 56*a* of the first linking mechanism 53 and the second constant contact door roller supporting member 75 which supports the second constant contact door roller 71 that is in constant contact with the lower rail 43 and which supports the first spindle of the second linking mechanism 73 are provided. According to this configuration, movements of the hanger 26, the door 2, and the like in the opening/closing direction X are guided by the respective constant contact door rollers 51 and 71. Accordingly, opening/closing operations of the door 2 are performed smoothly. Moreover, in the configuration, when inserting the respective constant contact door rollers 51 and 71 and the respective pressed door rollers 52 and 72 between the pair of rails 43 and 44, the respective pressed door rollers 52 and 72 do not move abruptly toward one of the rails with respect to the respective constant contact door rollers 51 and 71. Therefore, a worker can readily perform an operation of inserting both the respective pressed door rollers 52 and 72 and the respective constant contact door rollers 51 and 71 between the pair of rails 43 and 44.

In addition, according to the door suspension device 5, the respective pressed door rollers 52 and 72 are configured to be capable of being pressed against the upper rail 44 and the respective constant contact door rollers 51 and 71 are arranged so as to roll on the lower rail 43. According to this configuration, when a large force acts between the door 2 and the opening/closing drive mechanism 6, the respective pressed door rollers 52 and 72 may be pressed against the upper rail 44. Accordingly, the respective pressed door rollers 52 and 72 and the respective constant contact door rollers 51 and 71 operate so as to cooperatively prop each other up between the pair of rails 43 and 44. Therefore, the door 2 can be prevented from moving so as to wobble (door bouncing) in the vertical direction Z.

Furthermore, according to the door suspension device 5, the first pressed door roller 52 and the second pressed door roller 72 are arranged separated from each other in the opening/closing direction X. According to this configuration, when a large force acts between the opening/closing drive mechanism 6 and the hanger 26 and the opening/closing drive mechanism 6 and the hanger 26 are relatively displaced in the opening/closing direction X, the first pressed door roller 52 and the second pressed door roller 72 may be pressed against the upper rail 44 at positions separated from each other in the opening/closing direction X. Accordingly, the hanger 26 can be supported at multiple points at a plurality of locations separated from each other in the opening/closing direction X. As a result, the door suspension device 5 can support the door 2 in a more stable posture.

In addition, according to the door suspension device 5, the first linking members 57 and 77 of the respective linking mechanisms 53 and 73 extend above the corresponding first spindles 56*a* and 76*a*. According to this configuration, when the driving-side member 21 and the hanger 26 are relatively displaced in the opening/closing direction X while causing the elastic member 24 to elastically deform, the pressed door rollers 52 and 72 of the respective linking mechanisms 53 and 73 are pressed against the upper rail 44. Accordingly, the plurality of pressed door rollers 52 and 72 are cooperatively supported by the upper rail 44 at positions separated from each other in the opening/closing direction X. As a result, when the driving-side member 21 and the hanger 26 are relatively displaced in the opening/closing direction X while causing the elastic member 24 to elastically deform, the door 2 can be supported in a more stable posture.

Furthermore, according to the door suspension device 5, in a front view of the door suspension device 5, the first linking members 57 and 77 of the respective linking mechanisms 53 and 73 extend inclined with respect to the vertical direction Z, and the first linking member 57 of the first linking mechanism 53 and the first linking member 77 of the second linking mechanism 73 have inclines with opposite orientations with respect to the vertical direction Z. According to this configuration, a configuration for realizing an operation in which the second pressed door roller 72 is reliably pressed against the upper rail 44 when the first pressed door roller 52 is operated to so as to press against the upper rail 44 can be realized.

In addition, according to the door suspension device 5, the first linking mechanism 53 is arranged on the door head side of the door 2 and the second linking mechanism 73 is arranged on the door tail side of the door 2. According to this configuration, in a case where a large movement resistance is acting on the door 2 when the door 2 is opened such as when a passenger is leaning against the door 2 with a large force, the door 2 can be prevented from moving so as to wobble in the vertical direction Z (door bouncing). Specifically, when a passenger is leaning against the door 2 with a large force, displacements of the door 2 and the hanger 26 in the opening direction X1 are restricted. In this case, when the opening/closing drive mechanism 6 operates, the driving-side member 21 is slightly displaced in the opening direction X1 while causing the elastic member 24 to elastically deform between the driving-side member 21 and the hanger 26. Accordingly, the first linking members 57 and 77 of the respective linking mechanisms 53 and 73 swing around the corresponding first spindles 56*a* and 76*a*. At this point, the respective pressed door rollers 52 and 72 are displaced toward the side of the upper rail 44 and are pressed against the upper rail 44. As a result, the first pressed door roller 52 and the second pressed door roller 72 are cooperatively supported by the upper rail 44 and prevent door bouncing.

An embodiment of the present invention has been described above. However, the present invention is not limited to the embodiment described above and can be modified in various ways without departing from its spirit and scope as set forth in the accompanying claims. For example, the following modifications can be adopted.

Figure 21:
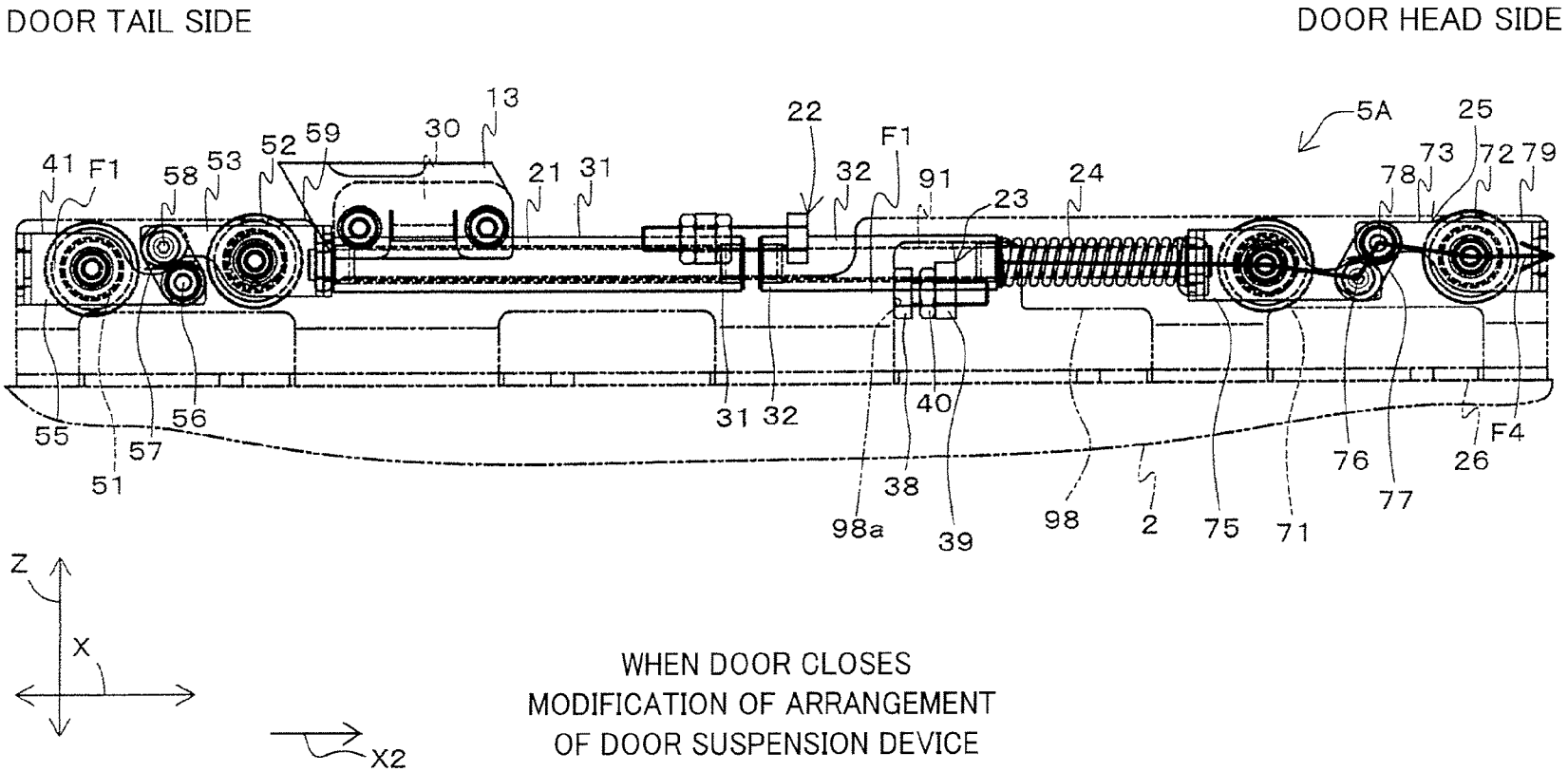
FIG. 21 is a diagram showing a modification of a door suspension device and presents an operation when the door suspension device smoothly closes a door.

(1) In the embodiment described above, an example has been described in which the first linking mechanism 53 is arranged on the door head side of the door 2 and the second linking mechanism 73 is arranged on the door tail side of the door 2. However, these arrangements are not restrictive. For example, as shown in FIG. 21, the first linking mechanism 53 may be arranged on the door tail side of the door 2 and the second linking mechanism 73 may be arranged on the door head side of the door 2.

In this case, when the door 2 opens, a drive force from the lower coupling stay 13 of the opening/closing drive mechanism 6 is transferred to the edge 98*a* of the hanger 26 (the door 2) via the first adjustment bolt 38 and the like. Accordingly, the door 2 is integrally displaced in the closing direction X2 with the driving-side member 21.

In addition, when the door 2A closes smoothly, a drive force F4 from the opening/closing drive mechanism 6 is transferred to the hanger 26 and the door 2A via the driving-side member 21 and the elastic member 24 as well as the second constant contact door roller supporting member 75, the first linking member 77, the second linking member 79, and the like of the second linking mechanism 73. Accordingly, the door 2A is integrally displaced in the closing direction X2 with the driving-side member 21.

Figure 22:
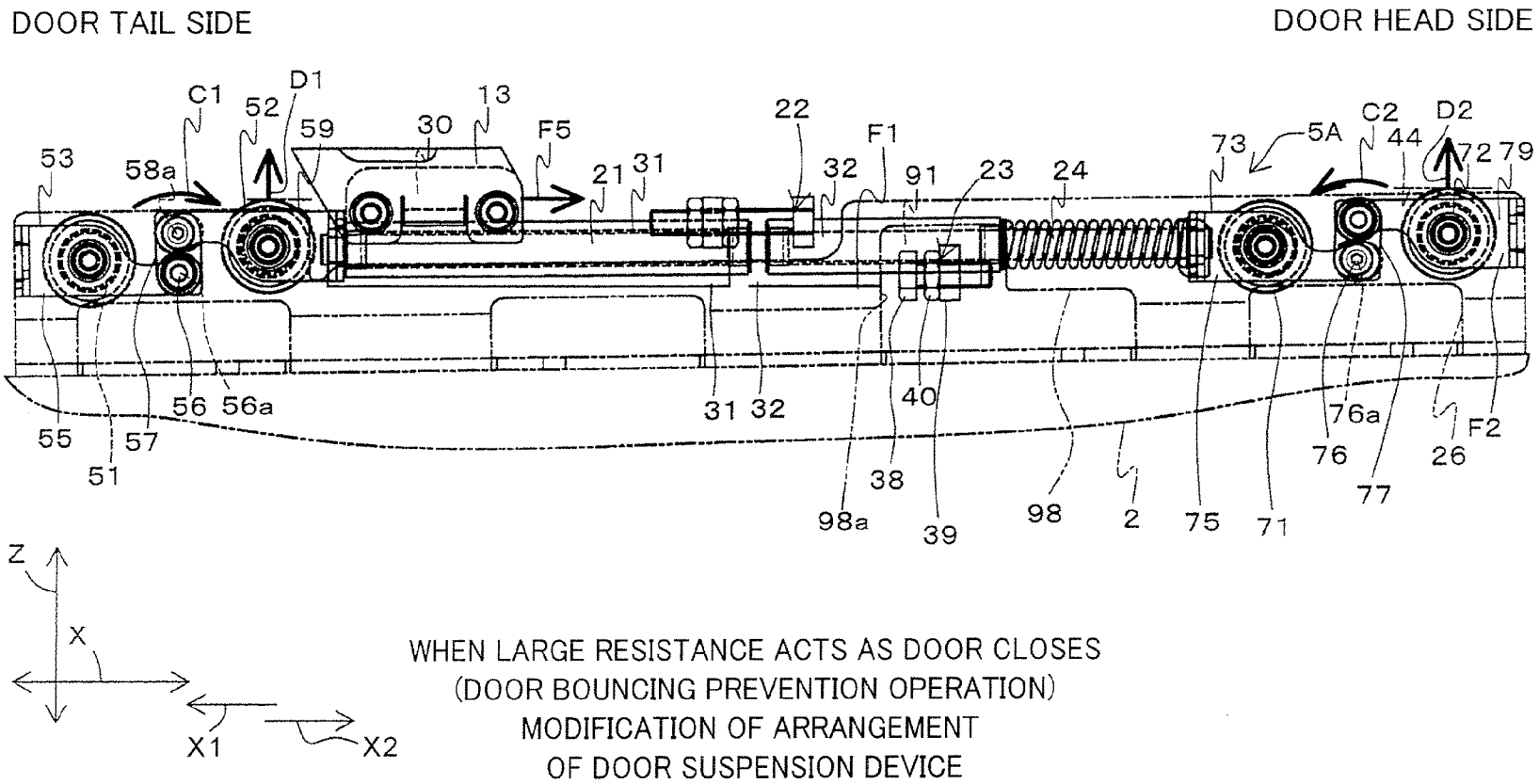
FIG. 22 shows a state where the door suspension device presses a pressed door roller against an upper rail during a closing operation of the door in the modification of the door suspension device shown in FIG. 21.

On the other hand, when a large resistance acts on the door 2 when the door 2 closes such as when a passenger and baggage are sandwiched between the two doors 2, the door suspension device 5A operates as shown in FIG. 22. Specifically, when a force large enough to stop the door 2 is acting on the door 2, in a similar manner as described with respect to the operation (5) in the embodiment described earlier, by a drive force F5 from the driving-side member 21, the elastic member 24 is compressed between the driving-side member 21 and the second constant contact door roller supporting member 75 and the driving-side member 21 is displaced toward the door head side with respect to the hanger 26. Accordingly, movable units or, in other words, an upper part of the first linking member 57, the second spindle 58*a*, the second linking member 59, the first pressed door roller 52, the coupling member 91, the second constant contact door roller supporting member 75 of the second linking mechanism 73, the second constant contact door roller 71, the first spindle 76*a*, and a lower part of the first linking member 77 are displaced in the opening direction X1 with respect to the first constant contact door roller supporting member 55 and the second linking member 79.

As a result, at the first linking mechanism 53, the first linking member 57 swings around the first spindle 56*a* as indicated by an arrow C1 and the second linking member 59 and the first pressed door roller 52 are displaced toward the side of the upper rail 44 as indicated by an arrow D1. Accordingly, the first pressed door roller 52 is pressed against the upper rail 44. In addition, at the second linking mechanism 73, in accordance with a displacement of the second constant contact door roller supporting member 75 toward the side of the closing direction X2, the first linking member 77 swings around the first spindle 76*a* and the second linking member 79 and the second pressed door roller 72 are displaced toward the side of the upper rail 44. Accordingly, the second pressed door roller 72 is pressed against the upper rail 44 as indicated by an arrow D2.

As described above, due to the respective pressed door rollers 52 and 72 being pressed against the upper rail 44, door bouncing (a wobbling movement of the door 2 in the vertical direction Z) is suppressed.

According to this configuration, as described above, the first linking mechanism 53 is arranged on the door tail side of the door 2 and the second linking mechanism 73 is arranged on the door head side of the door 2. As a result, in a case where a large movement resistance acts on the door 2 when the door 2 is being closed such as when a passenger and baggage are sandwiched between the doors 2 (when door catching occurs), an occurrence of door bouncing can be prevented. Specifically, when a passenger or the like is caught by the door 2 while the door 2 is being closed, displacements of the door 2 and the hanger 26 in the closing direction X2 are restricted. In this case, the driving-side member 21 receiving a drive force of the opening/closing drive mechanism 6 is slightly displaced in the closing direction X2 while causing the elastic member 24 to elastically deform between the driving-side member 21 and the hanger 26. Accordingly, the first linking members 57 and 77 of the respective linking mechanisms 53 and 73 swing around the corresponding first spindles 56*a* and 76*a*. At this point, the respective pressed door rollers 52 and 72 of the linking mechanisms 53 and 73 are displaced toward the side of the upper rail 44 and are pressed against the upper rail 44. As a result, the first pressed door roller 52 and the second pressed door roller 72 are cooperatively supported by the upper rail and prevent door bouncing.

Figure 23:
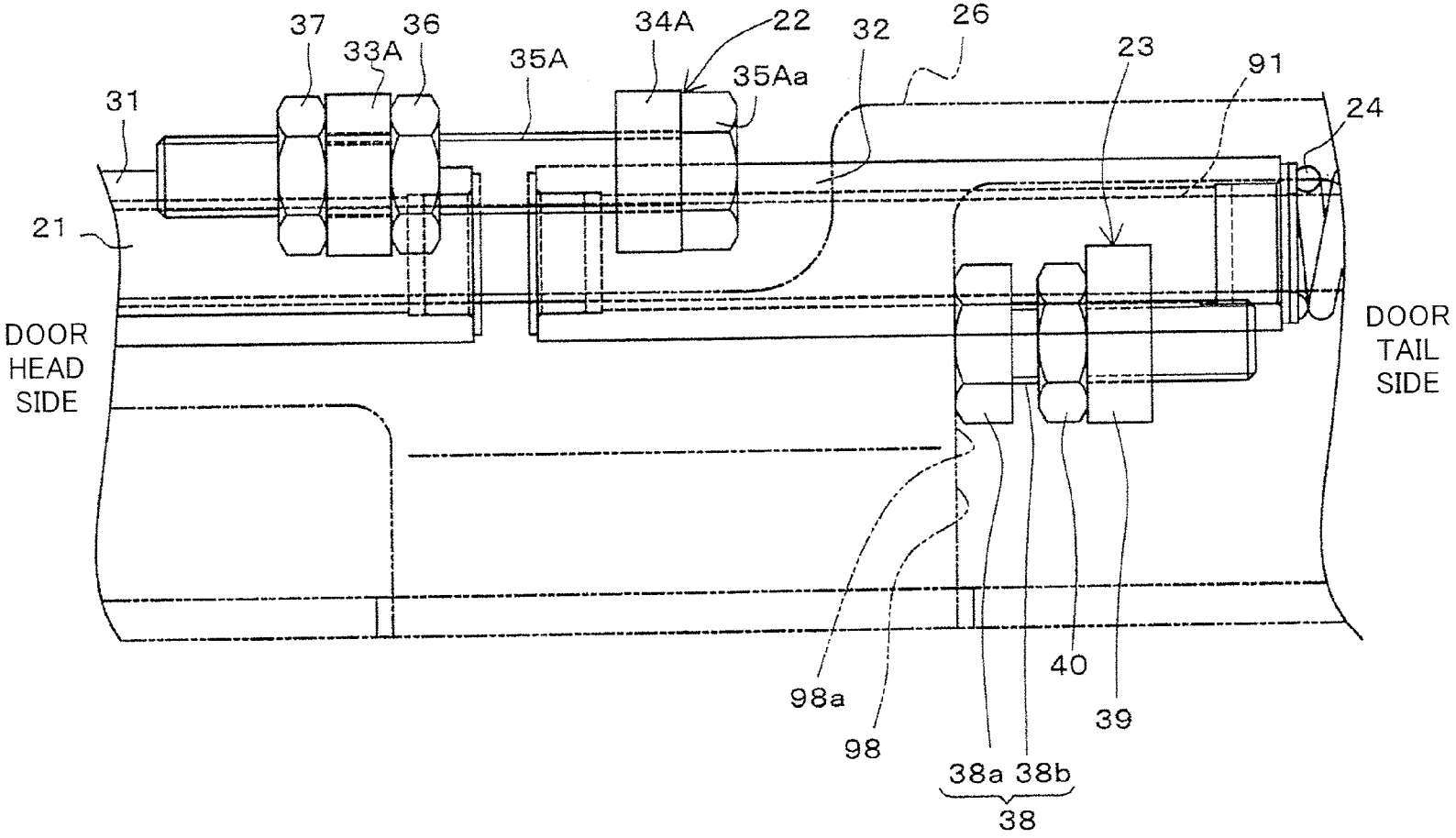
FIG. 23 is a diagram showing a modification of a static adjustment mechanism.

(2) In addition, in the embodiment described above, an example of a mode in which the second adjustment bolt 35 as the static adjustment mechanism 22 is a stud bolt has been described. However, this mode is not restrictive. The static adjustment mechanism need only be configured so as to be capable of adjusting relative positions in the opening/closing direction X of the first member 31 and the second member 32 of the driving-side member and capable of fixing the first member 31 and the second member 32 to each other, and a specific configuration of the static adjustment mechanism is not limited. For example, as shown in FIG. 23, a second adjustment bolt 35A may be a headed bolt. In this case, a first receiving section 33A and a second receiving section 34A have through-holes into which a shaft section of the second adjustment bolt 35A is inserted. A head 35A*a* of the second adjustment bolt 35A is received by the first receiving section 33A or the second receiving section 34A (in FIG. 23, the second receiving section 34A). In addition, the pair of nuts 36 and 37 is joined by screwing to the second adjustment bolt 35A so as to sandwich the first receiving section 33A.

(3) In addition, in the embodiment described above, an example of a mode in which the number of nuts attached to the first adjustment bolt 38 of the dynamic adjustment mechanism 23 is one has been described. However, this mode is not restrictive. For example, two nuts arranged so as to sandwich the fixing nut 39 may be joined by screwing to the first adjustment bolt 38.

Figure 24:
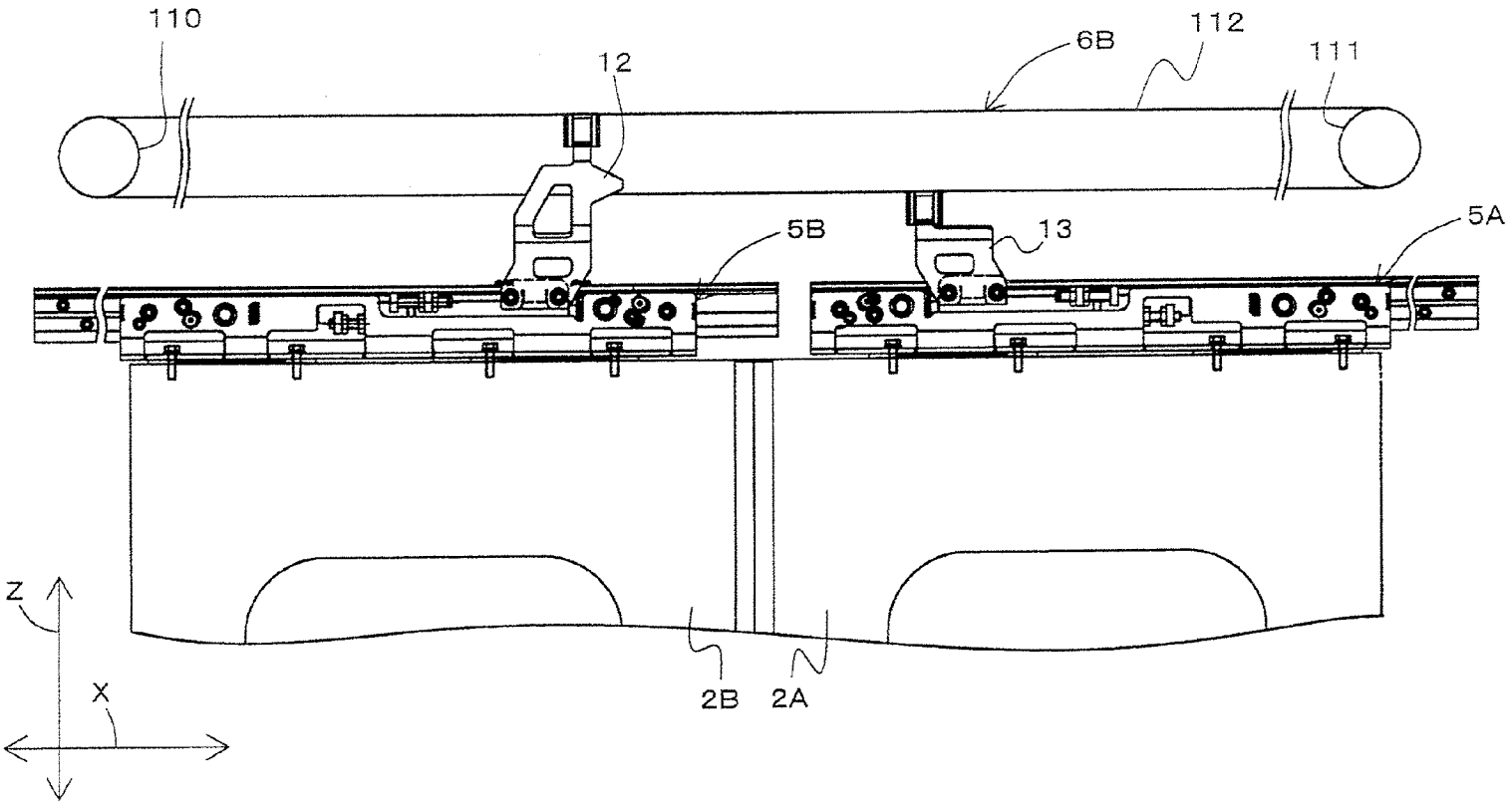
FIG. 24 is a diagram showing a modification of an opening/closing drive mechanism.

(4) In addition, in the embodiment described above, an example of a mode which adopts a rack and pinion configuration as the opening/closing drive mechanism has been described. However, this mode is not restrictive. For example, as shown in FIG. 24, a pulley-type opening/closing drive mechanism 6B may be used. The opening/closing drive mechanism 6B includes a drive motor (not shown), a drive pulley 110, a driven pulley 111, and a belt 112.

The belt 112 is an endless belt that is wound around the drive pulley 110 and the driven pulley 111. In addition, as the drive pulley 110 coupled to the drive motor rotates, the belt 112 wound around the drive pulley 110 circles, and the driven pulley 111 also rotates together with the belt 112.

The upper coupling stay 12 is fixed to upper portions of the two pulleys 110 and 111 of the belt 112. In addition, the lower coupling stay 13 is fixed to lower portions of the two pulleys 110 and 111 of the belt 112. Accordingly, due to an operation of the belt caused by rotations of the respective pulleys 110 and 111, the respective coupling stays 12 and 13

(the doors 2A and 2B) are displaced in mutually opposite directions in the opening/closing direction X.

Figure 25:
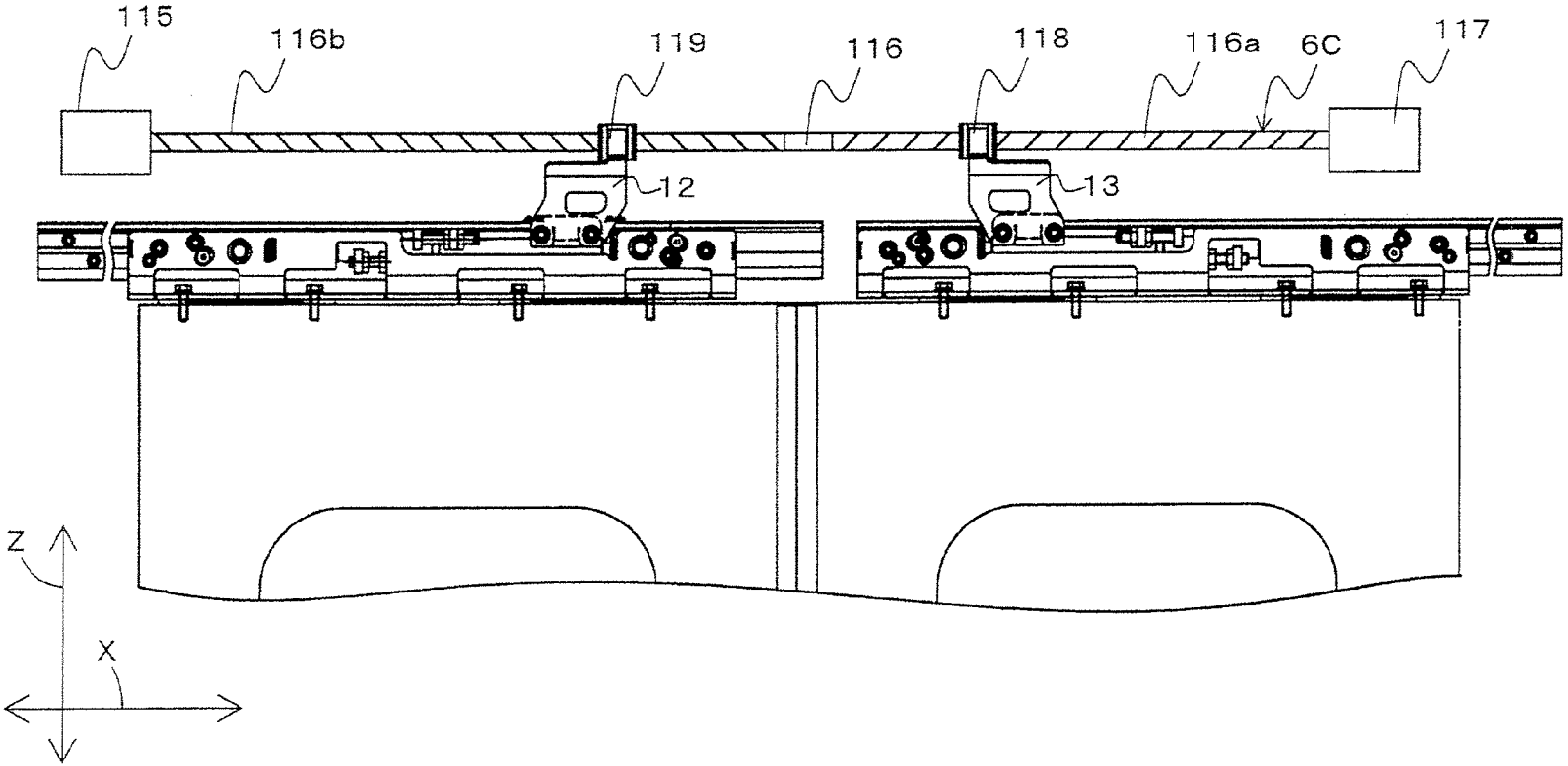
FIG. 25 is a diagram showing a modification of an opening/closing drive mechanism.

(5) Moreover, a screw-type opening/closing drive mechanism 6C shown in FIG. 25 may be used as the opening/closing drive mechanism. The opening/closing drive mechanism 6C includes a drive motor 115, a screw shaft 116, a bearing section 117, and nut members 118 and 119. One end of the screw shaft 116 is coupled to the drive motor 115 and another end of the screw shaft 116 is rotatably supported by the bearing section 117.

Accordingly, the screw shaft 116 is rotationally driven with a rotation of the drive motor 115. In addition, on the screw shaft 116, a male screw section 116*a* formed from a central portion to one end side and a male screw section 116*b* formed from the central portion to the other end side are formed as screw sections with reverse directions. The nut members 118 and 119 are respectively provided as members which are joined by screwing to the male screw sections 116*a* and 116*b* of the screw shaft 116 and which are fixed to the corresponding coupling stays 12 and 13. Accordingly, due to rotations of the screw shaft 116 caused by a forward rotation operation and a reverse rotation operation of the drive motor 8, the two doors 2 are driven so as to move in the opening/closing direction X.

(6) In addition, in the present embodiment, an example of a mode has been described in which the constant contact door rollers 51 and 71 are formed so as to be capable of rolling on the lower rail 43 and the pressed door rollers 52 and 72 are formed so as to be capable of being pressed against the upper rail 44. However, this mode is not restrictive. For example, a mode may be adopted in which the constant contact door rollers are formed so as to be capable of rolling on an upper surface of the upper rail and the pressed door rollers are formed so as to be capable of being pressed against a lower surface of the lower rail.

(7) In addition, the first adjustment bolt may be a headless stud bolt or the like.

Outline of Embodiment

The embodiment described above may be summarized as follows.

(1) The door suspension device according to the embodiment described above is a door suspension device for supporting a door that is displaced in a prescribed opening/closing direction by a drive force from an opening/closing drive mechanism, the door suspension device comprising: a driving-side member which is displaceable in the opening/closing direction when the drive force is imparted from the opening/closing drive mechanism; a hanger which is configured so as to be displaceable in the opening/closing direction in conjunction with a displacement of the driving-side member and which supports the door; an elastic member which allows relative displacements of the driving-side member and the hanger in the opening/closing direction by elastically deforming in accordance with a load in the opening/closing direction that acts between the driving-side member and the hanger; a pressed door roller which is arranged between a pair of upper and lower rails; and a movement conversion mechanism which converts an operation in which the driving-side member and the hanger are relatively displaced in the opening/closing direction, into an operation in which the pressed door roller is pressed against one of the pair of rails.

According to this configuration, when the driving-side member and the hanger are relatively displaced in the opening/closing direction against an elastic repulsive force of the elastic member, the movement conversion mechanism displaces the pressed door roller so as to press the pressed door roller against a rail. On the other hand, in a state where the driving-side member and the hanger are kept at constant relative positions by the elastic member, the pressed door roller may be substantially arranged so as not to be pressed against any of the rails. Accordingly, when a worker inserts the pressed door roller between the pair of rails, the pressed door roller is inserted between the pair of rails without being pressed by the worker. As a result, an operation of inserting the pressed door roller between the pair of rails can be performed more readily. In other words, with the door suspension device configured to be capable of displacing the pressed door roller so as to move closer and move away from a rail, the door suspension device can be assembled to the rail more readily.

(2) Favorably, the movement conversion mechanism includes a linking mechanism, and the linking mechanism includes a first spindle, a first linking member which is capable of swinging around the first spindle in accordance with relative movements of the driving-side member and the hanger in the opening/closing direction, and a second linking member which is coupled to the first linking member and which supports the pressed door roller.

When a cam mechanism is used as the movement conversion mechanism, the door roller may possibly perform an unintended operation due to slippage of a cam member of the cam mechanism or the like. In contrast, if the movement conversion mechanism is a linking mechanism, a trajectory of a movement of the pressed door roller can be reliably defined. As a result, the pressed door roller can be more reliably controlled to perform an intended operation at each point between a start of operation to an end of operation of the movement conversion mechanism. More specifically, in accordance with the swinging of the first linking member around the first spindle, the pressed door roller which is coupled to the second linking member can be more reliably controlled to perform an intended operation.

(3) More favorably, the linking mechanism includes a second spindle which extends parallel to the first spindle and which couples the first linking member and the second linking member to each other so as to be relatively rotatable.

According to this configuration, the second linking member is swingable around the second spindle. Therefore, the second linking member is swingable around the first spindle and the second spindle in a state where excessive swinging around the first spindle is suppressed. Accordingly, a force applied when the pressed door roller is pressed against the rail can be set to an appropriate value.

(4) More favorably, the hanger includes a guide section which guides a swinging displacement around one of the first spindle and the second spindle by the other spindle.

According to this configuration, since the guide section is provided, the second linking member can be more reliably controlled to perform an operation intended by a designer.

More favorably, the guide section includes a guide hole section which is formed on the hanger and which extends around the one spindle.

According to this configuration, a displacement of the second linking member around the first spindle can be guided by the guide hole section which extends around one of the spindles.

(5) Favorably, a coupling member for coupling the linking mechanism and the driving-side member to each other is further provided, and the coupling member is configured so as to be displaceable in conjunction with the driving-side member and configured so as to relatively displace the driving-side member and the second linking member in the opening/closing direction in accordance with an elastic deformation of the elastic member.

According to this configuration, relative displacements of the driving-side member and the hanger can be more reliably transferred to the second linking member. Therefore, the movement conversion mechanism can more reliably perform an operation of pressing the pressed door roller against the rail.

(6) More favorably, the coupling member is inserted into a fitting hole section formed on the driving-side member and is slidable in the opening/closing direction with respect to the fitting hole section.

According to this configuration, during an elastic deformation of the elastic member, the coupling member and the driving-side member can be relatively displaced in the opening/closing direction in a smooth manner.

(7) Favorably, the door suspension device includes a constant contact door roller which is constantly in rolling contact with the other of the pair of rails.

According to this configuration, movements of the hanger, the door, and the like in the opening/closing direction are guided by the constant contact door roller. Accordingly, opening/closing operations of the door are performed smoothly. In addition, in the configuration, when inserting the constant contact door roller and the pressed door roller between the pair of rails, the pressed door roller does not move abruptly toward a side of one of the rails with respect to the constant contact door roller. Therefore, a worker can readily perform an operation of inserting both the pressed door roller and the constant contact door roller between the pair of rails.

(8) More favorably, the pressed door roller is arranged so as to be capable of being pressed against one of the pair of rails, and the constant contact door roller is arranged so as to roll on the other of the pair of rails.

According to this configuration, when a large force acts between the door and the opening/closing drive mechanism, the pressed door roller may be pressed against the rail. Accordingly, the pressed door roller and the constant contact door roller operate so as to cooperatively prop each other up between the pair of rails. Therefore, the door can be prevented from moving so as to wobble in the vertical direction (door bouncing).

(9) Favorably, as the pressed door roller, a first pressed door roller and a second pressed door roller which are arranged separated from each other in the opening/closing direction are provided.

According to this configuration, when a large force acts between the opening/closing drive mechanism and the hanger and relative displacements of the opening/closing drive mechanism and the hanger in the opening/closing direction occur, the first pressed door roller and the second pressed door roller are pressed against the rail at positions separated from each other in the opening/closing direction. Accordingly, the hanger can be supported at multiple points at a plurality of locations separated from each other in the opening/closing direction. As a result, the door suspension device can support the door in a more stable posture.

More favorably, the movement conversion mechanism includes a first linking mechanism for operating the first pressed door roller and a second linking mechanism for operating the second pressed door roller, and each of the linking mechanisms includes a first spindle, a first linking member which is capable of swinging around the corresponding first spindle in accordance with relative movements of the driving-side member and the hanger in the opening/closing direction, and a second linking member which is coupled to the first linking member and which supports the corresponding first pressed door roller and the corresponding second pressed door roller.

When a cam mechanism is used as the movement conversion mechanism, the door roller may possibly perform an unintended operation due to slippage of a cam member of the cam mechanism or the like. In contrast, if each movement conversion mechanism is a linking mechanism, a trajectory of a movement of each pressed door roller can be reliably defined. As a result, each pressed door roller can be more reliably controlled to perform an intended operation at each point between a start of operation to an end of operation of each movement conversion mechanism. More specifically, in accordance with the swinging of the corresponding first linking member around each first spindle, the pressed door roller that is coupled to the corresponding second linking member can be more reliably controlled to perform an intended operation.

More favorably, each of the linking mechanisms includes a second spindle which extends parallel to the first spindle and which couples the first linking member and the second linking member to each other so as to be relatively rotatable.

According to this configuration, each second linking member is swingable around the corresponding second spindle. Therefore, each second linking member is swingable around the corresponding first spindle and the corresponding second spindle in a state where excessive swinging around the corresponding first spindle is suppressed. Accordingly, a force applied when each pressed door roller is pressed against the rail can be set to an appropriate value.

More favorably, the hanger includes a guide section which guides a swinging displacement of the second spindle around the first spindle in the first linking mechanism and a guide section which guides a swinging displacement of the first spindle around the second spindle in the second linking mechanism.

According to this configuration, since the guide section is provided in correspondence to each linking mechanism, each second linking member can be more reliably controlled to perform movements intended by a designer.

More favorably, each guide section includes a guide hole section which is formed on the hanger and which extends around a corresponding spindle.

According to this configuration, a displacement of each second linking member around the corresponding first spindle can be guided by the guide hole section which extends around one of the spindles.

Favorably, a coupling member for coupling the first linking mechanism, the second linking mechanism, and the driving-side member to each other is further provided, and the coupling member is configured so as to couple the respective linking mechanisms and the driving-side member to each other so as to be integrally displaceable and to swing each second linking member around the corresponding first spindle in accordance with an elastic deformation of the elastic member.

According to this configuration, relative displacements of the driving-side member and the hanger can be more reliably transferred to the second linking member. Therefore, the movement conversion mechanism can more reliably perform an operation for pressing the pressed door roller against the rail. In addition, the respective linking mechanisms are coupled to each other by the coupling member. Accordingly, the respective linking mechanisms can perform cooperative operations. Furthermore, accordingly, the first pressed door roller and the second pressed door roller can be brought into contact with the rail at more synchronized timings. As a result, the door suspension device can support the door in a more stable posture.

More favorably, the coupling member is inserted into a fitting hole section formed on the driving-side member and is slidable in the opening/closing direction with respect to the fitting hole section, and the first linking mechanism is connected to one end of the coupling member and the second linking mechanism is connected to another end of the coupling member.

According to this configuration, during an elastic deformation of the elastic member, the coupling member and the driving-side member can be relatively displaced in the opening/closing direction in a smooth manner.

(10) Favorably, the movement conversion mechanism includes a first linking mechanism for operating the first pressed door roller and a second linking mechanism for operating the second pressed door roller, and the first linking member of each of the linking mechanisms extends above the corresponding first spindle.

According to this configuration, when the driving-side member and the hanger are relatively displaced in the opening/closing direction while causing the elastic member to elastically deform, the pressed door roller of each linking mechanism is pressed against the upper rail. Accordingly, the plurality of pressed door rollers are cooperatively supported by the upper rail at positions separated from each other in the opening/closing direction. As a result, when the driving-side member and the hanger are relatively displaced in the opening/closing direction while causing the elastic member to elastically deform, the door can be supported in a more stable posture.

(11) More favorably, in a front view of the door suspension device, the first linking member of each of the linking mechanisms extends inclined with respect to a vertical direction, and the first linking member of the first linking mechanism and the first linking member of the second linking mechanism have inclines with opposite orientations with respect to the vertical direction.

According to this configuration, a configuration for realizing an operation in which the second pressed door roller is reliably pressed against the upper rail when the first pressed door roller is operated to so as to press against the upper rail can be realized.

(12) Favorably, the first linking mechanism is arranged on one of a door head side and a door tail side of the door, and the second linking mechanism is arranged on the other of the door head side and the door tail side of the door.

According to this configuration, in a case where the first linking mechanism is arranged on the door head side of the door and the second linking mechanism is arranged on the door tail side of the door and a large movement resistance is acting on the door when the door is opened such as when a passenger is leaning against the door with a large force, the door can be prevented from moving so as to wobble in the vertical direction (door bouncing). Specifically, when a passenger is leaning against the door with a large force, displacements of the door and the hanger in the opening direction are restricted. In this case, when the opening/closing drive mechanism operates, the driving-side member is slightly displaced in the opening direction while causing the elastic member to elastically deform between the driving-side member and the hanger. Accordingly, the first linking member of each linking mechanism swings around the corresponding first spindle. At this point, each pressed door roller is displaced toward the side of the upper rail and is pressed against the upper rail. As a result, the first pressed door roller and the second pressed door roller are cooperatively supported by the upper rail and prevent door bouncing.

The first linking mechanism may be arranged on the door tail side of the door, and the second linking mechanism may be arranged on the door head side of the door.

According to this configuration, in a case where a large movement resistance acts on the door when the door is being closed such as when a passenger and baggage are caught by the door (when door catching occurs), an occurrence of door bouncing can be prevented. Specifically, when a passenger or the like is caught by the door while the door is being closed, displacements of the door and the hanger in the closing direction are restricted. In this case, the driving-side member receiving a drive force of the opening/closing drive mechanism is slightly displaced in the closing direction while causing the elastic member to elastically deform between the driving-side member and the hanger. Accordingly, the first linking member of each linking mechanism swings around the corresponding first spindle. At this point, each pressed door roller is displaced toward the side of the upper rail and is pressed against the upper rail. As a result, the first pressed door roller and the second pressed door roller are cooperatively supported by the upper rail and prevent door bouncing.

Favorably, the door suspension device further includes a first constant contact door roller supporting member which supports a first constant contact door roller that is constantly in contact with the other of the pair of rails and which supports the first spindle of the first linking mechanism and a second constant contact door roller supporting member which supports a second constant contact door roller that is constantly in contact with the other of the pair of rails and which supports the first spindle of the second linking mechanism.

According to this configuration, movements of the hanger, the door, and the like in the opening/closing direction are guided by the respective constant contact door rollers. Accordingly, opening/closing operations of the door are performed smoothly. In addition, in the configuration, when inserting each constant contact door roller and each pressed door roller between the pair of rails, each pressed door roller does not move abruptly toward a side of one of the rails with respect to each constant contact door roller. Therefore, a worker can readily perform an operation of inserting both each of the pressed door rollers and each of the constant contact door rollers between the pair of rails.

More favorably, the first pressed door roller and the second pressed door roller are configured so as to be capable of being pressed against one of the pair of rails, and the first constant contact door roller and the second constant contact door roller are arranged so as to roll on the other of the pair of rails.

According to this configuration, when a large force acts between the door and the opening/closing drive mechanism, each pressed door roller may be pressed against the rail. Accordingly, each pressed door roller and each constant contact door roller operate so as to cooperatively prop each other up between the pair of rails. Therefore, the door can be prevented from moving so as to wobble in the vertical direction (door bouncing).

According to the embodiment described above, with a door suspension device configured to be capable of displacing a door roller so as to move closer and move away from a rail, the door suspension device can be assembled to the rail more readily.

The present invention can be applied to door suspension devices.

This application is based on Japanese Patent application No. 2015-024534 filed in Japan Patent Office on Feb. 10, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A door suspension device for supporting a door that is displaceable in an opening direction or a closing direction by receiving a drive force from an opening or closing drive mechanism, the door suspension device comprising:

a driving-side member which is configured to receive the drive force from the opening or closing drive mechanism;

a hanger which is configured so as to be displaceable in the opening direction or the closing direction in conjunction with a displacement of the driving-side member and which supports the door;

pressable door rollers which are between an upper rail and a lower rail;

a constant contact door roller configured to roll on the lower rail;

a constant contact door roller supporting member configured to support the constant contact door roller;

an elastic member sandwiched by the driving-side member and the constant contact door roller supporting member so as to elastically deform in accordance with a relative displacement of the driving-side member and the constant contact door roller supporting member; and a movement conversion mechanism which is configured to convert a movement in which the driving-side member and the hanger are relatively displaced in the opening direction or the closing direction, into a movement of the pressable door rollers so that the pressable door rollers move to press against the upper rail from a position where the pressable door rollers do not press against the upper rail and the lower rail, wherein the movement conversion mechanism includes a first linking member and a second linking member, the first linking member being supported by the constant contact door roller supporting member in a swingable manner, the first linking member being capable of swinging in accordance with relative movements of the driving-side member and the hanger in the opening direction or the closing direction, and the second linking member being coupled to the first linking member and configured to support at least one of the pressable door rollers.

2. The door suspension device according to claim 1, wherein the movement conversion mechanism includes a first spindle and a second spindle which extends parallel to the first spindle and which couples the first linking member and the second linking member to each other so as to be relatively rotatable.

3. The door suspension device according to claim 1, further comprising a coupling member for coupling the movement conversion mechanism and the driving-side member to each other, wherein the coupling member is configured so as to be displaceable in conjunction with the driving-side member and configured so as to relatively displace the driving-side member and the second linking member in the opening direction or the closing direction in accordance with an elastic deformation of the elastic member.

4. The door suspension device according to claim 3, wherein the coupling member is in a fitting hole section on the driving-side member and is slidable in the opening direction or the closing direction with respect to the fitting hole section.

5. The door suspension device according to claim 1, wherein the pressable door rollers include a first pressable door roller and a second pressable door roller which are separate from each other in the opening direction or the closing direction.

6. The door suspension device according to claim 5, wherein:

the movement conversion mechanism includes a first linking mechanism for operating the first pressable door roller and a second linking mechanism for operating the second pressable door roller, the first linking mechanism includes a first spindle and the first linking member, wherein the first linking member of the first linking mechanism is rotatable around the first spindle of the first linking mechanism and extends above the first spindle of the first linking mechanism, and the second linking mechanism includes a first spindle and a first linking member, wherein the first linking member of the second linking mechanism is rotatable around the first spindle of the second linking mechanism and extends above the first spindle of the second linking mechanism.

7. The door suspension device according to claim 6, wherein in a front view of the door suspension device, each of the first linking member of the first linking mechanism and the first linking member of the second linking mechanism extends inclined with respect to a vertical direction, and the first linking member of the first linking mechanism and the first linking member of the second linking mechanism have inclines with opposite orientations with respect to the vertical direction.

8. The door suspension device according to claim 6, wherein the first linking mechanism is on a door head side of the door, and the second linking mechanism is on a door tail side of the door.

9. The door suspension device according to claim 6, wherein:

the first linking mechanism is on a door tail side of the door, and the second linking mechanism is on a door head side of the door.

10. A door suspension device for supporting a door that is displaceable in an opening direction or a closing direction by receiving a drive force from an opening or closing drive mechanism, the door suspension device comprising:

a driving-side member which is configured to receive the drive force from the opening or closing drive mechanism;

a hanger which is configured so as to be displaceable in the opening direction or the closing direction in conjunction with a displacement of the driving-side member and which supports the door;

pressable door rollers which are between an upper rail and a lower rail; and a movement conversion mechanism which is configured to convert a movement in which the driving-side member and the hanger are relatively displaced in the opening direction or the closing direction, into a movement of the pressable door rollers so that the pressable door rollers move to press against the upper rail from a position where the pressable door rollers do not press against the upper rail and the lower rail, wherein:

the movement conversion mechanism includes a linking mechanism, the linking mechanism includes a first spindle, a first linking member which is capable of swinging around the first spindle in accordance with relative movements of the driving-side member and the hanger in the opening direction or the closing direction, a second linking member which is coupled to the first linking member and which supports at least one of the pressable door rollers, and a second spindle which extends parallel to the first spindle and which couples the first linking member and the second linking member to each other so as to be relatively rotatable, and the hanger includes a guide section configured to guide a swinging displacement around the first spindle by the second spindle.

11. A door suspension device for supporting a door that is displaceable in an opening direction or a closing direction by receiving a drive force from an opening or closing drive mechanism, the door suspension device comprising:

a driving-side member which is configured to receive the drive force from the opening or closing drive mechanism;

a hanger which is configured so as to be displaceable in the opening direction or the closing direction in conjunction with a displacement of the driving-side member and which supports the door;

pressable door rollers which are between an upper rail and a lower rail; and a movement conversion mechanism which is configured to convert a movement in which the driving-side member and the hanger are relatively displaced in the opening direction or the closing direction, into a movement of the pressable door rollers so that the pressable door rollers move to press against the upper rail from a position where the pressable door rollers do not press against the upper rail and the lower rail, wherein:

the movement conversion mechanism includes a linking mechanism, the linking mechanism includes a first spindle, a first linking member which is capable of swinging around the first spindle in accordance with relative movements of the driving-side member and the hanger in the opening direction or the closing direction, a second linking member which is coupled to the first linking member and which supports at least one of the pressable door rollers, and a second spindle which extends parallel to the first spindle and which couples the first linking member and the second linking member to each other so as to be relatively rotatable, and the hanger includes a guide section configured to guide a swinging displacement around the second spindle by the first spindle.

* * * * *